US007090621B2

(12) United States Patent
Loane

(10) Patent No.: US 7,090,621 B2
(45) Date of Patent: Aug. 15, 2006

(54) SKI EXERCISING AND TRAINING APPARATUS

(76) Inventor: R. Joel Loane, P.O. Box 592, Park City, UT (US) 84060

( * ) Notice: Subject to any disclaimer, the term of this patent is extended or adjusted under 35 U.S.C. 154(b) by 88 days.

(21) Appl. No.: 10/447,014

(22) Filed: May 27, 2003

(65) Prior Publication Data

US 2004/0014569 A1 Jan. 22, 2004

Related U.S. Application Data

(60) Continuation-in-part of application No. 09/533,614, filed on Mar. 22, 2000, now Pat. No. 6,569,064, and a continuation-in-part of application No. 07/577,101, filed on Sep. 4, 1990, now Pat. No. 5,147,257, which is a division of application No. 07/178,354, filed on Apr. 6, 1988, now Pat. No. 4,953,853, which is a continuation-in-part of application No. 07/080,755, filed on Jul. 30, 1987, now Pat. No. 4,743,014.

(51) Int. Cl.
*A63B 69/18* (2006.01)

(52) U.S. Cl. ..... 482/71; 482/51

(58) Field of Classification Search ..... 482/70–71, 482/79–80, 146, 51–53, 148
See application file for complete search history.

(56) References Cited

U.S. PATENT DOCUMENTS 219,439 A * 9/1879 Blend ..... 601/23
3,547,434 A 12/1970 Ossenkop
3,704,885 A * 12/1972 Raciunas ..... 482/71
4,743,014 A 5/1988 Loane
4,900,013 A 2/1990 Rogers, Jr.
4,953,853 A 9/1990 Loane
5,020,793 A 6/1991 Loane
5,147,257 A 9/1992 Loane
5,279,532 A * 1/1994 Chen ..... 482/71
5,299,996 A * 4/1994 Chi ..... 482/70
5,413,545 A 5/1995 Bermann
5,490,823 A 2/1996 Awbrey et al.
5,496,239 A * 3/1996 Kallman et al. ..... 482/71
5,749,811 A * 5/1998 Wilson ..... 482/71
6,569,064 B1 * 5/2003 Loane ..... 482/71

* cited by examiner

*Primary Examiner*—Stephen R. Crow
(74) *Attorney, Agent, or Firm*—Donald R. Boys; Central Coast Patent Agency, Inc.

(57) ABSTRACT

A ski exercising apparatus has a set of at least two parallel, partially arcuate rails joined to an underlying frame structure at opposite ends, the rails providing a track rising from each end, a wheeled carriage riding on the track, such that the carriage, in side-to-side movement rises to a maximum height at the center of the track, and descends from the center to each side, at least one articulated footpad mounted to the wheeled carriage, and at least one power band providing constraint for the wheeled carriage as it rides on the track. A variety of improvements in such an exercising apparatus are taught and claimed.

21 Claims, 50 Drawing Sheets

SKI EXERCISING AND TRAINING APPARATUS

CROSS-REFERENCE TO RELATED DOCUMENTS

The present application claims priority as a continuation in part application of application Ser. No. 09/533,614, filed Mar. 22, 2000 (now U.S. Pat. No. 6,569,064 issued on May 27, 2003. The present application is also related in part to application Ser. No. 07/577,101, now U.S. Pat. No. 5,147,257 issued on Sep. 15, 1992 and filed on Sep. 4, 1990, which is a divisional of application Ser. No. 07/178,354, now U.S. Pat. No. 4,953,853 issued on Sep. 4, 1990 and filed on Apr. 6, 1988, which is a continuation-in-part of application Ser. No. 07/080,755, now U.S. Pat. No. 4,743,014 issued on May 10, 1988 and filed on Jul. 30, 1987. The present application is also related to U.S. Pat. No. 5,020,793 issued on Jun. 4, 1991 filed on Oct. 24, 1989, which is also a continuation-in-part of U.S. Pat. No. 4,743,014.

FIELD OF THE INVENTION

The present invention relates to exercising apparatus for a user to simulate the motions, exertions and techniques involved in skiing, and for rehabilitation that simulates the range of motion and balance required in many sports, while providing modality for dynamic balance and functional rehabilitation, thereby increasing the user's strength and skill, and more particularly to improvements in such apparatus.

BACKGROUND OF THE INVENTION

Apparatus for use by skiers on which they may simulate the motions, exertions and techniques required in skiing has been built and sold for several years. In particular U.S. Pat. No. 3,524,641 was issued to Robert J. Ossenkop on Aug. 18, 1970, for a device comprising a movable carriage on a set of rails. The carriage of that device is constrained in its movement on the rails by flexible members attached to both the carriage and to transverse members between the rails near each end of the set of rails, and a user can move the carriage from side to side on the rails to simulate the Wedeln or "parallel" technique of skiing.

U.S. Pat. No. 3,547,434 was issued to the same inventor on Dec. 15, 1970. This later patent is for a device similar to the first device, but comprising a number of improvements, such as movable footrests on the carriage whereby a user may simulate turning and edging techniques in addition to parallel skiing; and, in some embodiments may also move the feet relative to one another.

The inventions referenced above each include a safety strap attached to a transverse member between the parallel rails and to the carriage on the rails in addition to the flexible member by which the carriage is constrained to travel on the rails. The purpose of the safety strap is to provide for a situation in which the aforementioned flexible member might rupture on one side of the carriage, providing a sudden force urging the carriage to the side where the flexible member remains unruptured, which sudden force could dislodge a user and perhaps cause serious injury. The safety strap in such instance provides a restoring force toward the center tending to lessen the amplitude of carriage displacement that might otherwise occur.

In U.S. Pat. No. 4,743,014, to which this case is related, and by the same inventor, an exerciser is disclosed having a pair of spaced-apart rails, a platform for riding on the rails, a first resilient element providing a first restoring force on the platform, and a second resilient element providing a second restoring force on the platform. The second resilient element has an adjustment element contacting the second resilient element in at least three points.

In the latter exerciser, the rails are held in a spaced-apart relationship by a brace element in the center, which is fastened to the rails by screw-type fasteners, and by transverse elements fastened at the ends of the rails. The transverse elements at the ends are tubular in form, and the rails pass through openings in the tubular transverse elements, fastening to a bracket internal to each tubular transverse element. This joining arrangement is illustrated by FIG. 1A and FIG. 1B of the referenced patent. As shown in these figures rails 301 and 303 pass through holes 305 and 307 respectively into tubular transverse element 309. Inside, the rails are fastened to a bracket 311 by screw fasteners 313 and 315. Rubber-like end caps 317 and 319 close the ends of the tubular transverse element after assembly and act as non-skid pads in contact with the floor in operation. The end caps are of molded rubber-like material, and disk-like pieces carrying designs and lettering are added for identification and aesthetic effect. This particular method of joining and spacing the rails has not proved entirely satisfactory in terms of cost and ease of assembly, and in terms of strength and rigidity of assembly, and the multiple-piece construction of the end caps has also proved to be relatively expensive.

In U.S. patent application Ser. No. 09/533,614, (hereinafter '614), to which the present application is related, a ski-exercising machine is provided comprising a set of at least two parallel rails joined to cross members at the ends, the cross members providing support on a horizontal support surface, and joined to a central frame structure extending from the horizontal surface near the center to the rails, the rails extending from each cross member at each end upward at an acute angle with the horizontal rising to a maximum height in the center; a wheeled carriage riding on the rails; at least one articulated footpad mounted to the wheeled carriage; and a set of three power bands each anchored at both ends by a clamp to a bottom surface of the frame structure beneath the wheeled carriage, passing over separate roller sets, with one or more of the power bands anchored to the wheeled carriage and one or more passing over a roller anchored to the wheeled carriage.

Although related U.S. patents issued to the inventor address the above problem and other problems related to construction and function of various components of the parent ski exerciser, there are still non-obvious improvements desired in several areas related to construction or assembly techniques, profile, materials, operation and longevity of the apparatus. For example, in U.S. Pat. No. 5,147,257 (hereinafter '257), in FIGS. 5A and 5B, a ski exerciser is illustrated both in an elevation view (FIG. 5A), and in a plan view (overhead FIG. 5B). Arcuate rails 15 comprise tubing structures having a continuous arc or bow over their entire length.

Additionally, further non-obvious improvements are desired in several areas related to tension adjustability of the power bands, band roller operation, positioning of individual footpads on the wheeled carriage, simulation of actual skiing movements and dynamics, as well as rehabilitation and versatility of the skiing apparatus to simulate range of motion and balance required in many sports other than downhill skiing. Still further improvements are desired in areas relating to safety aspects of apparatus to minimize the possibility of injury to the user.

It has been discovered partly through empirical methods that an even better action may be simulated with rails shaped somewhat differently than in the prior art. Firstly, the arcuate portions of the parallel rails can be shortened, and the straight portions lengthened to provide more intensity in the simulation of the skiing action. Secondly, the inventor has discovered that further adjustability of the power bands, in addition to footpad positioning, pivoting and sliding action, provide more accurate skiing motion simulation than the apparatus in the referenced prior art.

FIG. 5A in '257 illustrates roller assemblies housing rollers such as rollers 25 and 27 which are identical in size and construction with other illustrated rollers which make rolling contact with resilient members 23 and 59. The diameter of the aforementioned rollers is disclosed as approximately 1 inch, and the rollers are generally cylindrical. It has been discovered that larger rollers, also crowned have a beneficial effect in smoother power band operation. The crowned rollers keep the belts better centered on the rollers.

The present inventor has also determined that improvements may be made in the positioning of wheels for the wheeled carriage, and in the form of the rails and how the wheels interface to the rails.

FIG. 16 in '614 illustrates a ski exercising apparatus 301 according to an embodiment of the present invention having an optional third power band assembled between the first, or outer power band, and the second, or inner, power band, and a pair of tensioning structures (303 and 304), each having a single roller assembly rotatably mounted to the tensioning structure such that consistent tension is provided to the wheeled carriage assembly given a specific range of motion of the carriage assembly.

What is clearly needed is a modularly enhanced ski-excising device that provides further distinct advantages for the expanding field of users. Such an improved device could provide further adjustability of power band tension, and additional pivoting action for suspended footpad assemblies to provide a more realistic simulation of skiing movements and dynamics in varying skiing terrain. What is also clearly needed is an improved method and apparatus enabling the user to quickly interchange footpad assemblies of a wheeled carriage assembly having additional attachments for rehabilitation and selective body strengthening, which simulates the range of motion and balance required in many sports other than downhill skiing, accurately reproducing lateral movements required in most sports, thereby optimizing rehabilitation and helping to prevent injury to the user. Such an improved apparatus incorporates additional safety features, which further protect the user from injury during operation of the exercise apparatus.

SUMMARY OF THE INVENTION

In a preferred embodiment of the present invention a ski exercising apparatus is provided, comprising a set of at least two parallel, partially arcuate rails joined to an underlying frame structure at opposite ends, the rails providing a track rising from each end, a wheeled carriage riding on the track, such that the carriage, in side-to-side movement rises to a maximum height at the center of the track, and descends from the center to each side, at least one articulated footpad mounted to the wheeled carriage, and a set of three power bands. The apparatus is characterized in that the power bands are arranged concentrically, with an outer, an inner, and a middle band, joined at one point each to the wheeled carriage and at at least two points each to the underlying frame structure, and in that the attachment of the middle power band to the underlying frame structure is through a pair of adjustment mechanisms having two rollers each, the adjustment mechanisms attached to the underlying frame structure on each side of center.

In a preferred embodiment, in each adjustment mechanism, the middle power band passes under one of the rollers and around the other. Also in a preferred embodiment the roller which the middle band passes around can be fixed at any one of at least three positions in the adjustment mechanism, each position at a different distance from the center of the apparatus, to adjust tension on the middle band.

In another aspect of the invention, in a mechanism for mounting a roller between two vertical walls spaced apart by a first distance, the roller for restraining and guiding a power band for a ski exercising apparatus having a wheeled carriage rolling on partially arcuate rails, the power band affixed to the carriage and passing around a roller in the mechanism, an improved roller axle is provided, comprising a first element including an axle portion of a first diameter and a length equal to the first distance, having a concentric threaded hole on a first end, an engagement portion concentric with the axle portion, of a length equal to a thickness of one of the walls, and larger in diameter than the axle portion to match a diameter of a hole in the one of the walls, and a head portion concentric with the axle portion and larger in diameter than the hole, for inserting through the hole and extending the axle portion between the two walls, and a second element including a head portion equivalent to the head portion of the first element and an engagement portion equivalent to the engagement portion of the first element, and also including a male threaded portion extending from the engagement portion for mating with the concentric threaded hole of the first element, the second element for inserting through a hole in the other of the two walls, equivalent to the hole ion the first of the two walls, and for engaging with the first element to form an axis for a roller to be mounted between the walls, and also for stabilizing and strengthening the mechanism.

In yet another aspect of the invention a ski exercising apparatus is provided, comprising a set of at least two parallel, partially arcuate rails joined to an underlying frame structure at opposite ends, the rails providing a track rising from each end, a wheeled carriage riding on the track, such that the carriage, in side-to-side movement rises to a maximum height at the center of the track, and descends from the center to each side, at least one articulated footpad mounted to the wheeled carriage, and at least one power band attached to the carriage and engaging mechanisms mounted to the underlying frame structure at opposite sides of center of the track. This apparatus is characterized in that the rails have a central arcuate portion of a width of twelve inches or less, joined to straight portions on each side of the arcuate portion, the straight portions extending at equal angles downward and outward from the central arcuate portion to the underlying frame structure. In a preferred embodiment the apparatus is characterized in that the overall height of the track above the underlying frame structure is a least ten inches.

In still another aspect a ski exercising apparatus is provided, comprising a set of at least two parallel, partially arcuate rails joined to an underlying frame structure at opposite ends, the rails providing a track rising from each end, a wheeled carriage riding on the rails, such that the carriage, in side-to-side movement rises to a maximum height at the center of the track, and descends from the center to each side, at least one power band attached to the carriage and engaging mechanisms mounted to the underlying frame structure at opposite sides of center of the track, and a slide plate mounting to the wheeled carriage for providing attachment of elements interfacing to a human user. This apparatus is characterized in that the slide plate comprises spaced apart rounded parallel rails extending in the direction of movement of the wheeled carriage, the rails for engaging rounded grooves of one or more separate elements to be mounted to the slide plate.

In another preferred embodiment the apparatus is characterized in that the slide plate further comprises a plurality of holes arranged in linear matrix in the direction of the extension of the rails, the holes for selective positional mounting of the separate elements to be mounted. In another one or more spring-loaded pin extensions extend from the slide plate to act as safety retainers for the separate elements joined to the slide plate by engaging with the rounded rails.

In still another preferred embodiment a ski exercising apparatus is provided, comprising a set of at least two parallel, partially arcuate rails joined to an underlying frame structure at opposite ends, the rails providing a track rising from each end, a wheeled carriage riding on the rails, such that the carriage, in side-to-side movement rises to a maximum height at the center of the track, and descends from the center to each side, at least one power band attached to the carriage and engaging mechanisms mounted to the underlying frame structure at opposite sides of center of the track, a substantially linear slide plate having spaced apart rounded rails extending in the direction of movement of the wheeled carriage, the slide plate mounting to the wheeled carriage, and at least one attachment plate having rounded grooves spaced-apart compatibly with the rounded rails, the attachment plate mounted to the linear slide plate by engaging the rounded grooves of the attachment plate with the rounded rails of the slide plate.

In this apparatus there may two attachment plates in a preferred embodiment. Further, attachment plates may comprise a normally extended spring pin, which, by being retracted, allows the attachment plate to be translated along the rails of the slide plate, and by being allowed to extend, engages a hole in the slide plate to position the attachment plate on the slide plate.

In yet another embodiment a ski exercising apparatus is provided, comprising a set of at least two parallel, partially arcuate rails joined to an underlying frame structure at opposite ends, the rails providing a track rising from each end, a wheeled carriage riding on the rails, such that the carriage, in side-to-side movement rises to a maximum height at the center of the track, and descends from the center to each side, at least one power band attached to the carriage and engaging mechanisms mounted to the underlying frame structure at opposite sides of center of the track, a substantially linear slide plate having spaced apart rounded rails extending in the direction of movement of the wheeled carriage, the slide plate mounting to the wheeled carriage, at least one attachment plate having rounded grooves spaced-apart compatibly with the rounded rails, the attachment plate mounted to the linear slide plate by engaging the rounded grooves of the attachment plate with the rounded rails of the slide plate, and a foot pad attached to the attachment plate for engaging a user's foot to operate the apparatus. Also in a preferred embodiment there are two attachment plates engaging the slide plate and two foot pads, one attached to each attachment plate. In some embodiments the foot pad comprises a planar portion for engaging a user's foot at a first height, and a pivot axis at a second height above the first height, such that the plane of the planar portion may rotate as the carriage descends from side to side.

In still another aspect of the invention a ski exercising apparatus is provided, comprising a set of at least two parallel, partially arcuate rails joined to an underlying frame structure at opposite ends, the rails providing a track rising from each end, a wheeled carriage riding on the rails, such that the carriage, in side-to-side movement rises to a maximum height at the center of the track, and descends from the center to each side, at least one power band attached to the carriage and engaging mechanisms mounted to the underlying frame structure at opposite sides of center of the track, and a handgrip apparatus joined to the wheeled carriage, enabling a user to grasp the handgrip apparatus and operate the exercising apparatus. Also in a preferred embodiment the handgrip apparatus provides two handgrips, one for each of a user's hands, spaced apart in the direction of translation of the wheeled carriage on the track. In some embodiments the handgrip apparatus provides four handgrips in two sets of two, one set provided at a height higher than the other set. In still other embodiments apparatus of further comprising a substantially linear slide plate having spaced apart rounded rails extending in the direction of movement of the wheeled carriage, the slide plate mounting to the wheeled carriage, and at least one attachment plate having rounded grooves spaced-apart compatibly with the rounded rails, the attachment plate mounted to the linear slide plate by engaging the rounded grooves of the attachment plate with the rounded rails of the slide plate, the handgrip apparatus attached to the attachment plate.

In yet another aspect of the invention a ski exercising apparatus is provided, comprising a set of at least two parallel, partially arcuate rails joined to an underlying frame structure at opposite ends, the rails providing a track rising from each end, a wheeled carriage riding on the rails, such that the carriage, in side-to-side movement rises to a maximum height at the center of the track, and descends from the center to each side, at least one power band attached to the carriage and engaging mechanisms mounted to the underlying frame structure at opposite sides of center of the track, and at least one substantially planar interface for a user's feet joined to the wheeled carriage by a linear translation mechanism allowing limited free motion of the interface in a direction at substantially a right angle to direction of travel of the wheeled carriage on the track. Also in a preferred embodiment the exercising apparatus comprises two planar interfaces for a user's feet, each joined to the wheeled carriage by a linear translation mechanism allowing limited free motion for each interface in a parallel direction at substantially a right angle to direction of travel of the wheeled carriage on the track. In other embodiments the linear translation mechanism comprises a foot-pad carriage mounted on rollers riding in linear slots in the translation mechanism. In still other embodiments the exercising apparatus comprises a substantially linear slide plate having spaced apart rounded rails extending in the direction of movement of the wheeled carriage, the slide plate mounting to the wheeled carriage, and at least one attachment plate having rounded grooves spaced-apart compatibly with the rounded rails, the attachment plate mounted to the linear slide plate by engaging the rounded grooves of the attachment plate with the rounded rails of the slide plate, the translation mechanism attaching to the attachment plate.

In still another aspect of the invention a ski exercising apparatus is provided, comprising a set of at least two parallel, partially arcuate rails joined to an underlying frame structure at opposite ends, the rails providing a track rising from each end, a wheeled carriage riding on the rails, such that the carriage, in side-to-side movement rises to a maximum height at the center of the track, and descends from the center to each side, at least one power band attached to the carriage and engaging mechanisms mounted to the underlying frame structure at opposite sides of center of the track, and at least one substantially planar interface for a user's feet joined to the wheeled carriage by an arcuate translation mechanism allowing limited arcuate motion of the interface about a pivotal axis located at a height greater than the height of the footpad and extending in the direction of motion of the wheeled carriage. Also in a preferred embodiment the exercising apparatus comprises two planar interfaces for a user's feet, each joined to the wheeled carriage by an arcuate translation mechanism allowing limited arcuate motion of the interface about a pivotal axis located at a height greater than the height of the footpad and extending in the direction of motion of the wheeled carriage. In other embodiments the arcuate translation mechanism comprises a footpad carriage mounted on rollers riding in arcuate slots in the translation mechanism. Also in other embodiments there may be a substantially linear slide plate having spaced apart rounded rails extending in the direction of movement of the wheeled carriage, the slide plate mounting to the wheeled carriage, and at least one attachment plate having rounded grooves spaced-apart compatibly with the rounded rails, the attachment plate mounted to the linear slide plate by engaging the rounded grooves of the attachment plate with the rounded rails of the slide plate, the arcuate translation mechanism attaching to the attachment plate.

In still another embodiment of the invention a ski exercising apparatus is provided, comprising a set of at least two parallel, partially arcuate rails joined to an underlying frame structure at opposite ends, the rails providing a track rising from each end, a wheeled carriage riding on the rails, such that the carriage, in side-to-side movement rises to a maximum height at the center of the track, and descends from the center to each side, at least one power band attached to the carriage and engaging mechanisms mounted to the underlying frame structure at opposite sides of center of the track, and at least one substantially planar interface for a user's feet joined to the wheeled carriage by a linear translation mechanism allowing limited free motion of the interface in a direction at substantially a right angle to direction of travel of the wheeled carriage on the track, and by a curvilinear translation mechanism allowing limited arcuate motion of the interface about a pivotal axis above the height of the footpad and extending in the direction of motion of the wheeled carriage. Also in a preferred embodiment thee exercising apparatus comprises two planar interfaces for a user's feet, each joined to the wheeled carriage through both of the linear and arcuate translation mechanisms. In other embodiments the linear and arcuate translation mechanisms may comprise carriages mounted on rollers riding in separate linear and arcuate slots in the translation mechanism. In still other the exercising apparatus may further comprise a substantially linear slide plate having spaced apart rounded rails extending in the direction of movement of the wheeled carriage, the slide plate mounting to the wheeled carriage, and at least one attachment plate having rounded grooves spaced-apart compatibly with the rounded rails, the attachment plate mounted to the linear slide plate by engaging the rounded grooves of the attachment plate with the rounded rails of the slide plate, the arcuate translation mechanism attaching to the attachment plate.

In still another preferred embodiment of the invention a ski exercising apparatus is provided, comprising a set of at least two parallel, partially arcuate rails joined to an underlying frame structure at opposite ends, the rails providing a track rising from each end, a wheeled carriage riding on the rails, such that the carriage, in side-to-side movement rises to a maximum height at the center of the track, and descends from the center to each side, at least one power band attached to the carriage and engaging mechanisms mounted to the underlying frame structure at opposite sides of center of the track, and a system for monitoring travel of the wheeled carriage in operation.

In some preferred embodiments the system for monitoring comprises an endless tether attached to the carriage and passing over rollers mounted to the underlying frame structure at points spaced to either side from center. In other preferred embodiments the system for monitoring further comprises a sensing roller turned by the tether as the carriage translates, the sensing roller enabled to provide a signal proportional to the direction and extent of rotation of the sensing roller. The sensing may be accomplished by interruption of an optical sensor. Further, the rollers mounted to the underlying frame structure may be integrated with rollers provided for anchoring and guiding the at least one power band.

In yet a further embodiment of the invention there is an electronic system including a display for compiling and displaying movement statistics related to the exercising apparatus. In this system input and output elements of the electronic system, including the display, are located at a position observable by and accessible to a user of the apparatus.

In still another preferred embodiment of the invention a ski exercising apparatus is provided, comprising a set of at least two parallel, partially arcuate rails joined to an underlying frame structure at opposite ends, the rails providing a track rising from each end, a wheeled carriage riding on the rails, such that the carriage, in side-to-side movement rises to a maximum height at the center of the track, and descends from the center to each side, at least one power band attached to the carriage and engaging mechanisms mounted to the underlying frame structure at opposite sides of center of the track, a support frame mounted to the underlying frame structure, providing a support bar in a convenient position for a user to grasp by hands for support during use of the exercising apparatus, and an elastic tether system including an anchor point to the exercising apparatus and an attachment interface for a user's body, the tether system for imposing variable tension on the user's body while operating the exercising apparatus.

In preferred embodiments the elastic tether system includes at least one pulley through which the tether passes between the user and the anchor point. Also in some preferred embodiments the anchor point is to the support frame to one side of the user, and the pulley is mounted to the support frame to the other side of the user. The attachment interface to the user's body may comprise a band for mounting to one of a user's upper leg, knee, or lower leg.

In yet another preferred embodiment of the invention a ski exercising apparatus is provided, comprising a set of at least two parallel, partially arcuate rails joined to an underlying frame structure at opposite ends, the rails providing a track rising from each end, a wheeled carriage riding on the rails, such that the carriage, in side-to-side movement rises to a maximum height at the center of the track, and descends from the center to each side, at least one power band attached to the carriage and engaging mechanisms mounted to the underlying frame structure at opposite sides of center of the track, at least one substantially planar interface for a user's feet joined to the wheeled carriage, and a set of two flag mechanisms joined to the underlying frame structure at opposite ends of the structure, each flag mechanism having a mechanical interface activated by contact with the wheeled carriage in operation, such that the user may see the flag of either of the flag mechanisms move each time contact is made with the wheeled carriage.

BRIEF DESCRIPTION OF THE DRAWING FIGURES

DESCRIPTION OF THE PREFERRED EMBODIMENTS

Figure 1A:
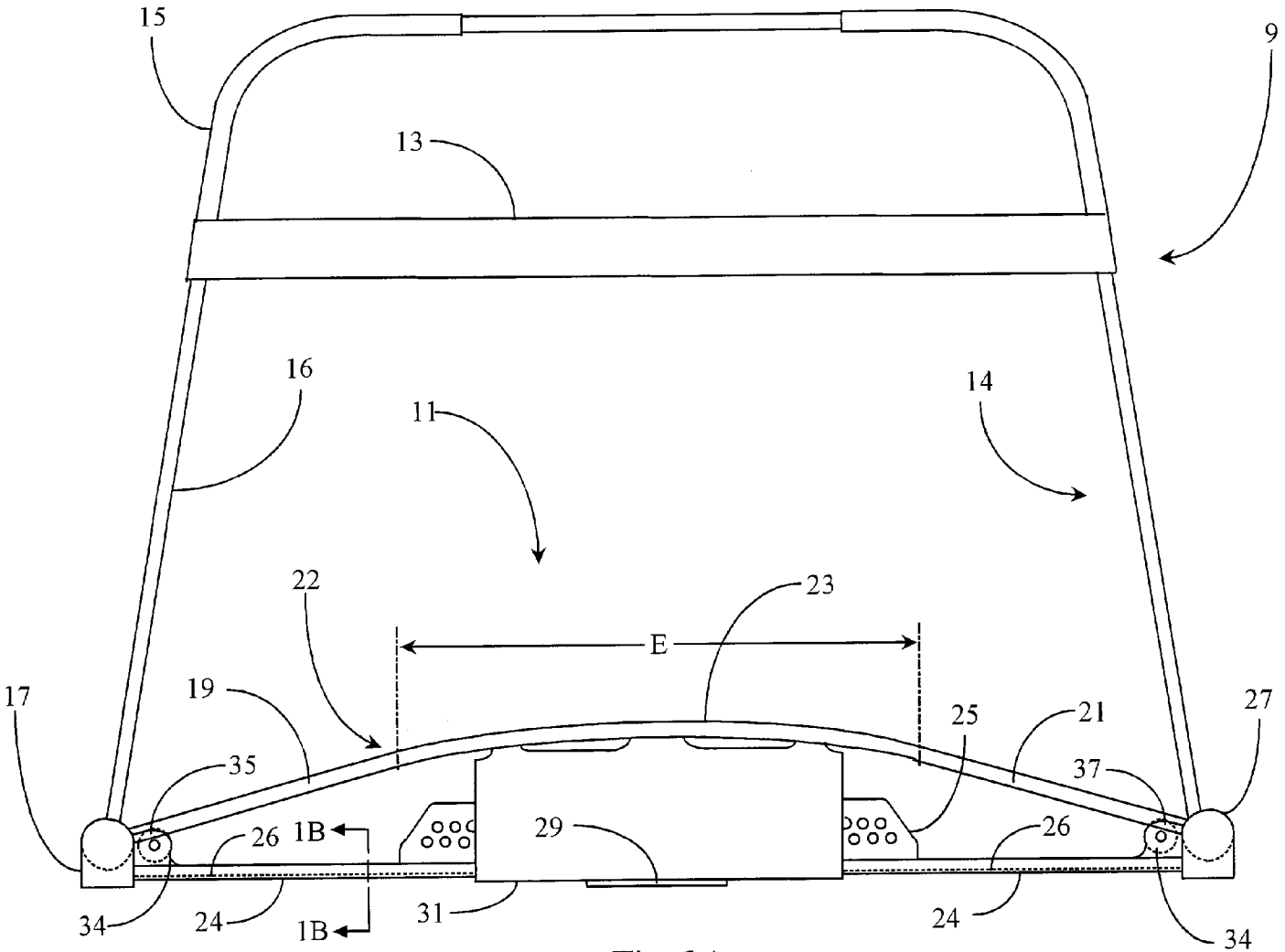
FIG. 1A is an elevation view of a frame structure of a ski-exercising device according to an embodiment of the present invention.

It is the object of the present invention to provide a ski exercising apparatus similar to that apparatus covered in cross-related documents above that is modularly enhanced such that, among other improvements, changing applications on the apparatus may be performed with minimal effort. It is also an object of the present invention that the above apparatus be generally and innovatively improved to accomplish a goal of maintaining a light weight while increasing strength and durability of the apparatus. A further object of the present invention is to provide such an apparatus as described above having a lower profile, improved safety features, and having fewer assembly parts with which to contend. It is also an object of the present invention to more accurately simulate the motions and dynamics of skiing in terrain, which varies in steepness, bumpiness and other aspects of the terrain, as well as skiing in such terrain at varying speeds and aggressiveness. Yet another object of the present invention is to provide a ski apparatus having a monitoring system integrated therein which provides the user with information pertaining to the workout in order to enable the user to best utilize the apparatus and maximize effectiveness of the workout or training. Such information may include elapsed time from start to finish of the workout, goal determination and accomplishment, energy or calories expended by the user, speed of turns, side travel distance of the wheeled carriage, and so on. It is still further an object of the present invention to provide such a ski exercising apparatus which, when used with special attachments and other new and novel apparatus, becomes a versatile rehabilitation and training tool that simulates the range of motion and balance required in many sports other than downhill skiing. Such an apparatus is enabled for selectively stretching, strengthening or rehabilitating specific areas of the body, core stabilization, balance training and many other aspects of selected training and exercise. Such an apparatus and system accurately reproduces the lateral movements required in most sports, thereby optimizing rehabilitation and helping to prevent injury to the user. Such a ski-exercising apparatus is described in enabling detail below.

FIG. 1 is an elevation view of a frame structure 11 of a ski-exercising apparatus 9 according to an embodiment of the present invention. Apparatus 9 is provided having a generally similar frame-architecture to previously described exercisers disclosed in related U.S. patents issued to the inventor except for novel improvements that are described below. For the purpose of clarification, only a frame structure 11 of apparatus 9 is described in this embodiment. Additional components not seen here are described later in this specification.

In a preferred embodiment of the present invention, frame structure 11 comprises a pair of semi-arcuate rails 22 that are held parallel to each other and are affixed at either end of each rail to a pair of transverse end-members 27. As this is an elevation view, only one of the pair of rails is seen. The spacing and parallelism is seen in plan view FIG. 2. This arrangement of rails 22 affixed to members 27 forms the basic frame-structure of apparatus 9. One notable difference between semi-arcuate rails 22 and the fully arcuate rails disclosed in related patents such as rails 15 of U.S. Pat. No. 5,147,257, is as the respective descriptors imply. That is, as in FIG. 1A, rails 22 are arced only in their center portions 23 and illustrated by a dimensional notation E. The dimension lines associated with portion 23 mark the locations where the arced portion of each rail 22 ends at positions sharing an equal distance from a theoretical vertical center of rails 22.

The total distance E in a preferred embodiment is approximately 26 inches, defined as that portion of each rail 22 that is arced. The stated arc of arcuate portion 23 has a radius of approximately 76 inches although a somewhat higher or lower radius may be used in other embodiments. Non-arcuate portions of rails 22 are witnessed by element numbers 19 and 21 on the left and right side of apparatus 9 as seen in this view. The lengths (taken horizontally) for rail portions 19 and 21 are approximately 15 inches respectively. Rail portions 19 and 21 are substantially straight from their junctures with arcuate portion 23. The dimensions cited above are intended to be approximate only. When including an approximate 2.36-inch (6 cm) diameter for each transverse member 27, the approximate overall length of frame structure 11 is about 61 inches. Semi-arcuate rails 22 may be manufactured from heavy-gauge steel tubing as described in U.S. Pat. No. 5,147,257. In one embodiment, rails 22 may be made of extruded steel or aluminum bars rather than steel tubing, and rails may be solid or hollow in different embodiments. Such rails may often also be formed in a forming die to manufacture tracks.

Solid aluminum bars may in some circumstances offer more strength than steel tubing in terms of flexing or bending while retaining a lightweight characteristic. Moreover, such bars may be extruded to comply with varied shapes as may be desired, and may also be produced in hollow configurations. In this particular embodiment, rails 22 are solid and round in cross-section (rods). The semi-arcuate design and solid structure of rails 22 adds considerable strength and durability causing less flex when rails are in use. It is not specifically required that rails 22 be of round cross-section in order to practice the present invention. The inventor intends merely that keeping a round cross-section consistent with previously used steel tubing is consistent with conventional wheels used on wheeled-carriage assemblies such as carriage 11 described in U.S. Pat. No. 5,147,257.

In another embodiment, rails 22 may be extruded and then die-formed to a shape that may conform to an alternate wheel design. Such an embodiment is described later in this specification. The size of rails 22 is approximately 2.5 cm. (1-inch) in diameter as is consistent with previous related embodiments. However, this should not be construed as a limitation in diameter but only a preference in balancing durability with lightweight characteristics. Other diameters for rails 22 are plausible. Transverse members used in an embodiment where rails are aluminum will also be made of aluminum tubing to facilitate welding. However, where rails are steel tubing or rods, transverse members will typically be manufactured from steel tubing. A durable polymer coating is applied to all visible parts and surfaces of apparatus 9 in order to provide a resistance to corrosion and for appearance purposes.

The straight portions of rails 22 to each side of arcuate portion 23 provide a carriage movement in operation that more nearly simulates an actual skiing experience, as has been testified to by users of the apparatus.

In a preferred embodiment of the present invention, rails 22 are welded to transverse members 27 to form a one-piece truss-frame insuring long life and durability along with ease of assembly of associated elements. However, many fastening methods are known and practiced in the art and could also be used to affix rails 22 to transverse members 27. The frame structure 11 of apparatus 9 also comprises belt guides 24 located in a substantially centered and parallel position in-between rails 22 and welded, at opposite ends, to transverse members 27 and to a support frame member 31 supporting the rails in the centered arcuate portion. Belt guides 24 allow a power band such as element 23 of FIG. 5A of '257 to be separated from the floor or carpet during operation, thus contributing to longer life and sparing wear and discoloration of the floor or carpet. A belt guide of the type disclosed herein has not been previously taught. A pair of raised ribs 26 running the length of belt guides 24 on each side of member 31 are provided and adapted to allow a power band to avoid contact with the bottom of belt guide 24 further reducing wear and noise.

Support member 31 is provided for the purpose of lending additional support to the frame structure 11 of apparatus 9, and for housing mechanisms associated with operation of the exerciser. A structure of the same name is illustrated in FIG. 5A (element 55) of '257 and member 31 is analogous to that member, but improved in function. For example, support member 31 as illustrated herein, is longer in length than the aforementioned member 55 thereby supporting more area of rails 22. Support member 31 may be provided as one piece or as a plurality of components welded together such that one single piece is formed. Support member 31 is made wider than previously disclosed support members such that it may be welded in some embodiments to the outside edges of rails 22 instead of having rail-inserted tabs as described with member 55 of FIG. 5A in '257. Welding support member 31 to the outside edges of rails 22 increases the strength and durability of frame structure 11, and allows further improvements described more fully below.

Support member 31 is further welded to belt guides 24 as previously described, effectively adding these components to frame structure 11 so as to form a single contiguous and integral frame, thereby lending strength, durability, and eliminating assembly requirements. Also welded to support member 31 is a tension-adjustment structure 25. Structure 25 in this embodiment is a u-shaped structure welded to the bottom of member 31 such that two vertical planes are presented, one on each side of the power band path, with holes for positioning rollers for adjustment of power band tension. The length of structure 25 is such that it extends beyond each side of member 31, as shown, and guides 24 weld to structure 25. In this manner structure 25 becomes a part of the overall welded structure 11 adding durable strength to the structure as a whole. Additionally, two roller brackets 34 are illustrated, housing rollers 35 in this embodiment, and these are also welded to transverse members 27 and to belt guide 24, and are part of frame structure 11 of apparatus 9. Much assembly is avoided and much durability and strength is added by providing a multi-component but single piece welded frame architecture for apparatus 9 as will readily be appreciated by one with skill in the art.

A protective resilient, non-skid pad 29 is provided and mounted in a position beneath support member 31. Pad 29 may be affixed to support member 31 by gluing, fastening such as by recessed screws, or other known methods. The purpose of pad 29 is to protect floor coverings from contact with support member 31 so as to avoid scratching and the like, as well as to keep apparatus 9 from skidding when in use. This pad also provides service in reducing vibration and noise. Four resilient end-caps 17 are provided to cover the ends of transverse members 27. End-caps 17 provide non-skid contacts between apparatus 9 and a floor or other support surface.

Another component illustrated in this embodiment is an optional support frame 14 for a novice user to hold on to for stabilization while using apparatus 9. Support frame 14, termed an Assistant Coach by the inventor, comprises a tubing structure 16, a cross member 13, and padded gripping areas 15. Tubing structure 16 may be a one-piece tube bent to form structure 16, or a combination of straight and curved pieces, which are provided and assembled to form structure 16. Steel or another form of durable tubing of an approximate 1-inch diameter may be used. Other sizes are also useful.

Gripping areas 15 (one on each side) may be formed of a durable synthetic material such as a dense polyurethane foam, vinyl, or other materials known for providing a gripping surface to tube handles and the like that are common in the field of exercise equipment. In one embodiment, gripping areas 15 may be removed such as by conventional methods known in the art. In another embodiment, gripping areas 15 are permanent such as sprayed on or glued. Cross member 13 may be manufactured from a durable plastic or other material such as sheet steel or aluminum. Cross member 13 may in some embodiments be welded to tube structure 16. In other embodiments, other known fastening techniques such as nut and bolt, or metal screws may be used. There are many possibilities.

Figure 2:
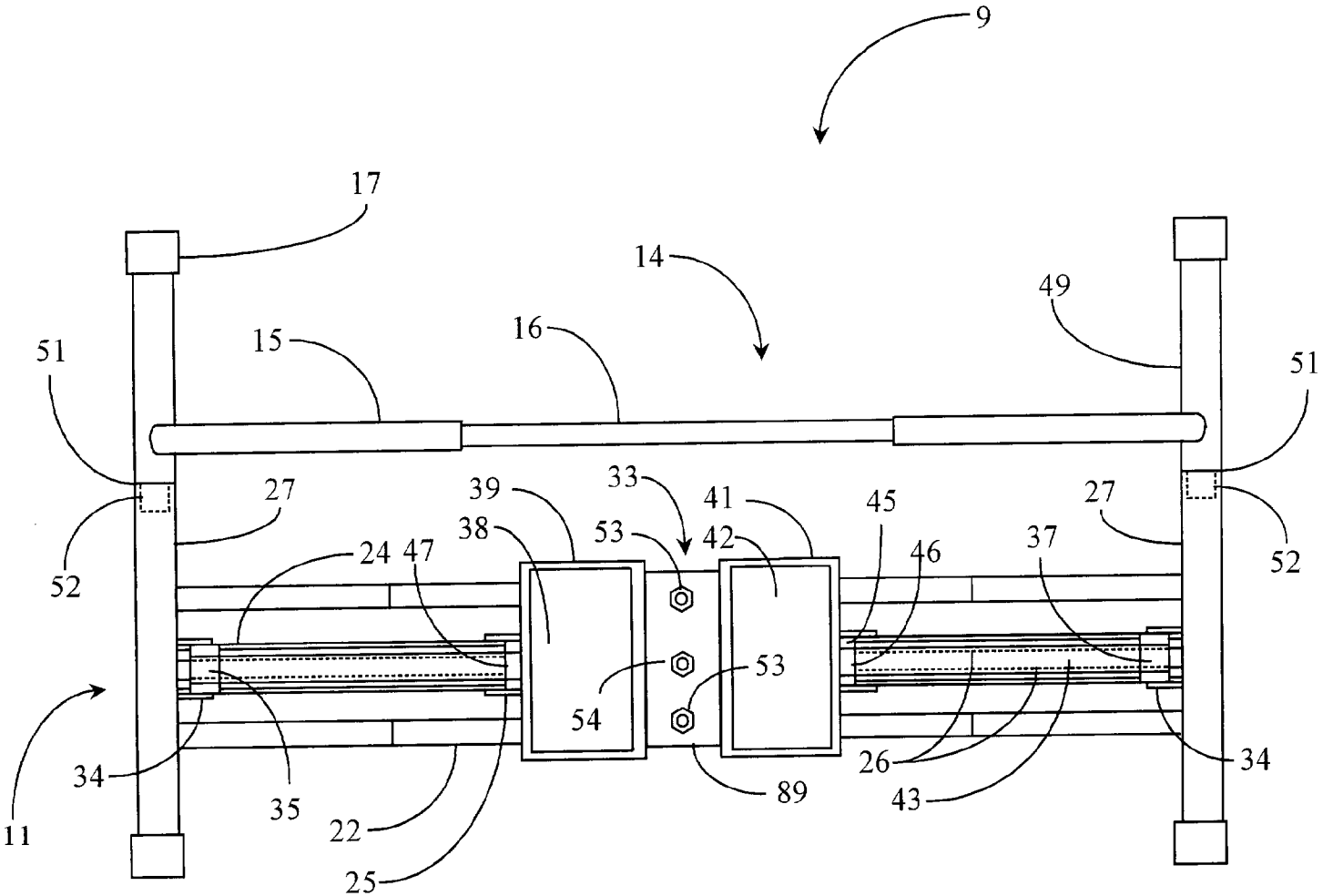
FIG. 2 is a plan view of the frame structure of FIG. 1 with added components illustrated according to an embodiment of the present invention.

Support frame 14 is welded or fastened to two transverse members similar to members 27 but not seen here because of the direction of view (see FIG. 2 element 49). Such members act as an optional extension to transverse members 27 at the rear of apparatus 9. By removing resilient end-caps 17 from the rear or front of apparatus 9, support structure 14 may be connected to the transverse members 27 of frame structure 11. In some embodiments an additional interface and support element is added between elements 11 and 27.

FIG. 2 is a plan view of the frame structure 11 of apparatus 9 of FIG. 1 with added components illustrated according to an embodiment of the present invention. As previously described, support frame 14 is an optional extension to frame structure 11 of apparatus 9. A user wishing to install support frame 14 simply removes two end caps 17 from the rear of frame structure 11 and connects the support frame. The point of connection for the two structures is illustrated as line 51 at either end of device 9.

Transverse members 49 each have a fitting end 52 that is of a smaller diameter over a suitable length than the inside diameter of transverse members 27. The diameter is small enough so that transverse members 49 may be easily fit into transverse members 27 such that when fully inserted lines 51 are formed representing the joining of each structure. Circular shims (not shown) that are once split through along a longitudinal edge of each shim are used to obtain a snug fit between transverse members 27 and 49. Such shimming methods are well known in the art. Setscrews (not shown) or other known types of fasteners may be used to secure the installation.

As seen in this overhead view, power band guides 24 extend from each end of the structure (members 27) toward the center and are welded at opposite ends to structure 25, which in turn welds to member 31 (FIG. 1A). Roller brackets 34 are welded to transverse members 27 and to belt guide 24 as previously described above. Two rollers 47 and 45 are illustrated as mounted to tensioning structure 25. Rollers 47 and 48 are provided and adapted to support a central power band 46. Likewise, a power band 43 is supported by rollers 35 and 37. An additional roller (not shown) is provided for further support of power band 46 and is centered in-line and in-between rollers 47 and 45 at a raised position such that a triangular configuration of the three rollers is formed. Power bands 43 and 46 are manufactured of a proprietary rubber compound or similar material as described in U.S. Pat. No. 5,147,257. Aforementioned rollers such as rollers 35 and 37 are manufactured of polypropylene or similar material in a preferred embodiment.

Tension-adjustment structure 25 acts as a rigid mounting location for rollers 47 and 45. A plurality of openings provided in collinear arrangement through opposite-facing sides of structure 25 are used to mount rollers 47 and 45 via a quick-release pin-and-shaft mounting technique that is described in detail later in this specification. By removing and re-mounting rollers in different positions on structure 25, tension adjustments to power band 46 may be affected.

Figure 4:
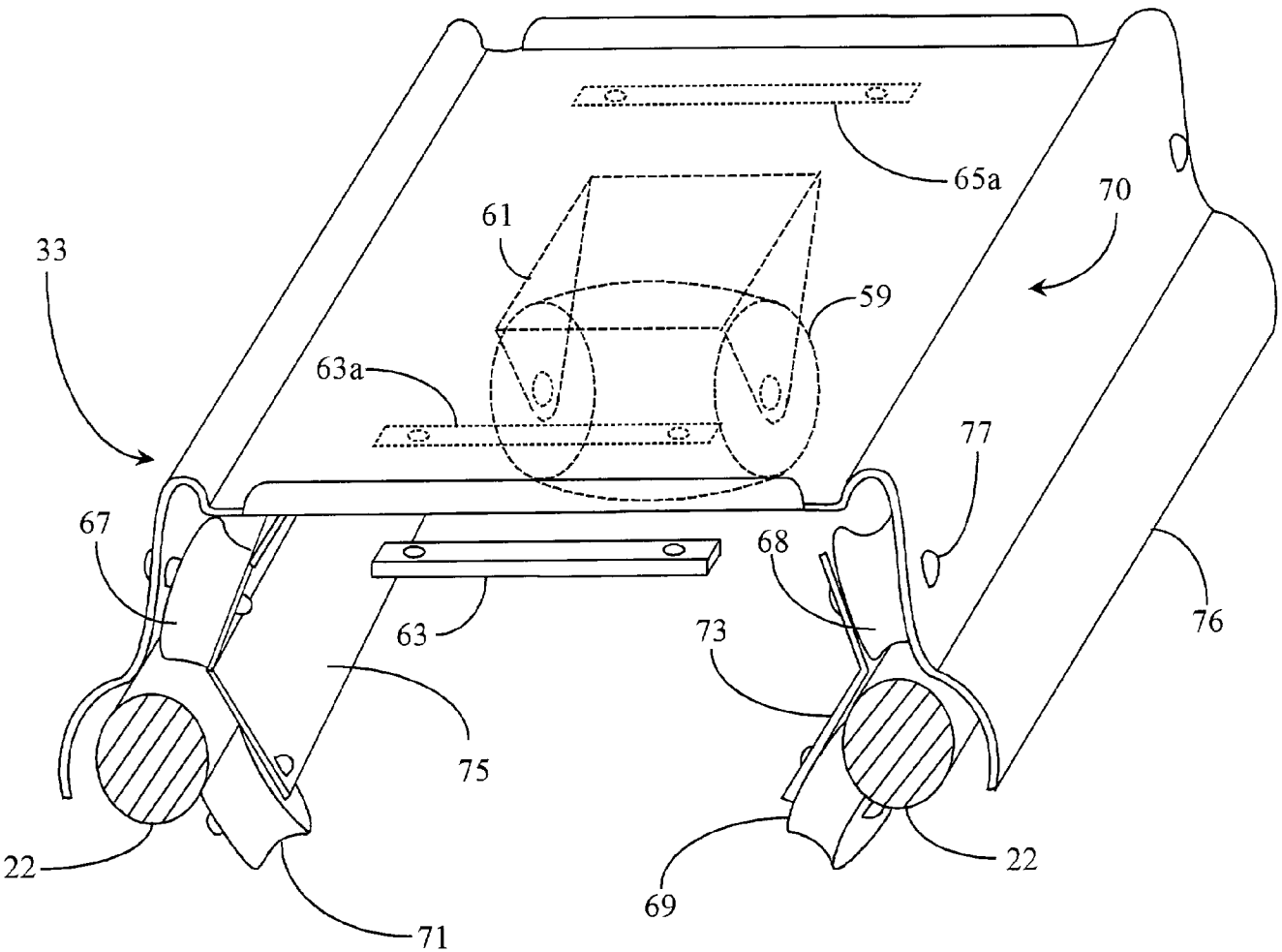
FIG. 4 is a perspective view of a wheeled carriage-assembly shown without an upper carriage according to an embodiment of the present invention.

A wheeled lower carriage assembly indicated as element 33 in FIG. 2, but best seen in FIG. 4, rides on rails 22. This carriage is described in further detail below with reference to FIG. 4. Foot platforms 39 and 41 are mounted to an upper platform unit 89, which in turn mounts to the lower wheeled carriage assembly by fasteners 53. The arrangement of an upper platform for footpads mounting as a unit to a lower wheeled carriage allows different footpad arrangements to be quickly and easily traded on a standard wheeled carriage.

Center fastener 54 is not used when installing and removing upper foot platforms, because it is a mounting fastener for a power-band roller beneath carriage 33. A clearance hole is provided in the upper platform for this fastener.

Foot platforms 39 and 41, in the arrangement shown, provide a parallel skiing simulation that is one option for mode of operation with apparatus 9. By swapping upper platforms with different foot interface arrangements the overall apparatus can be quickly adapted to other applications, as will be clearer with following description.

In the embodiment shown, foot platforms 39 and 41 each have a footpad surface thereon. Footpad surface 38 is affixed to platform 39, and footpad surface 42 is affixed to platform 41. Footpad surfaces 38 and 42 are preferably made of a non-skid durable rubber material. Surfaces 38 and 42 may be installed using an adhesive, or other known methods such as screw fasteners or the like. Similarly, other materials may be used instead of rubber as long as a non-skid effect is maintained.

Rollers 35, 37, 47, 45, and the previously described roller (not shown) that completes a triangular configuration with rollers 47 and 45 are now significantly larger in diameter than rollers previously disclosed in related applications. Whereas previously disclosed rollers were described as having about a 1-inch (2.5 cm) diameter, the rollers of the present invention have substantially a 2-inch (5 cm) diameter and are crowned. That is, the rollers are somewhat curved on the outer surface that meets the power band, so there is a marginally larger diameter at the center plane of the roller than at the roller edges. This improvement in design ensures that the power bands always remain centered on the rollers, which obviates contact with roller brackets and the like, reducing frictional wear to the power bands, and leads to smoother and quieter operation of apparatus 9.

Figure 3:
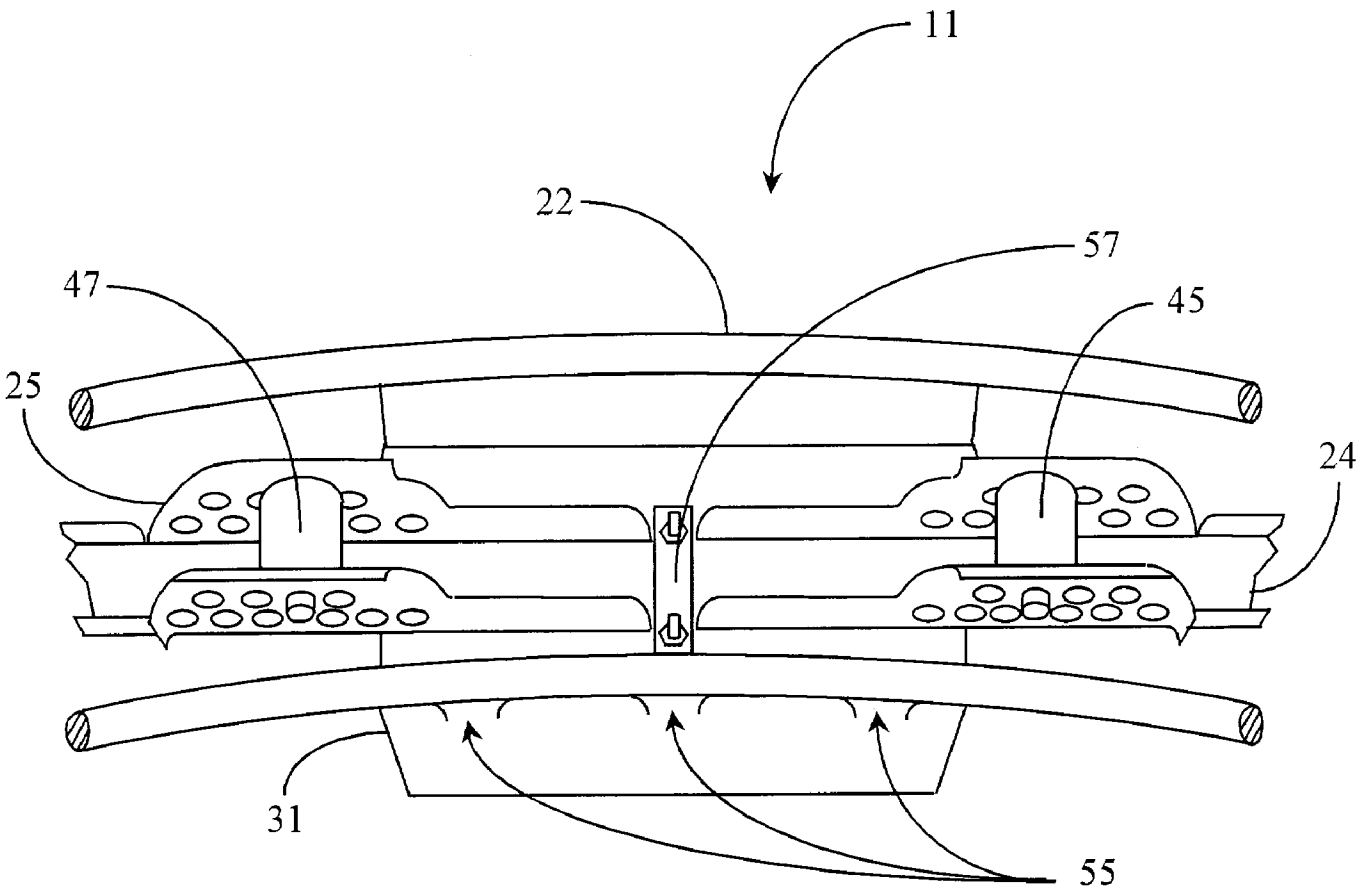
FIG. 3 is a perspective view of a center portion of the structure of FIG. 1 with covering components removed.

FIG. 3 is a perspective view of the center portion of frame structure 11 of FIG. 1 with covering components removed to show the elements beneath. As previously described, support member 31 is welded to rails 22. In this example, a plurality of individual welds 55 is placed symmetrically along the length of support member 31. There are three welds 55 shown in this example, however, there may be more or fewer such welds without departing from the spirit and scope of the present invention. In one embodiment, a continuous weld may run the entire length of support member 31. Also in this example, welds 55 are illustrated as being placed from the outside edges (rear-edge welds not visible) of support member 31 to the outside of rails 22. There are many possibilities regarding number of and location of welds 55.

Tensioning structures 25, as described with reference to FIGS. 1 and 2, are welded to belt guides 24 and to support member 31. Brackets 25 are shown with rollers 47 and 45 mounted thereon. A suitable thickness for the material used to manufacture support member 31 and belt guide 24 is about 3 mm, or ⅛ of an inch. In one embodiment of the present invention, aircraft quality aluminum may replace sheet steel for such components where possible. Using high quality aluminum instead of materials such as steel cited in related applications helps to strengthen frame structure 11 as well as to reduce weight.

Yet another marked improvement over the prior art is in the method of clamping the ends of power bands. In related documents it is described that the central resilient element has it's ends clamped at one location while a second resilient element has its ends clamped at locations on either side of the central clamp. Therefore three clamping locations exist for securing the free ends of power bands. In this example, only one clamping location 57 is required. Clamp 57 secures both the ends of power band 43 and those of power band 46 of FIG. 2. This method reduces work-steps required to install power bands. A single clamping location also ads considerable safety in that only one clamp must be checked for integrity therefore lessening the possibility of error in set-up. In this particular example, clamp 57 is a bar clamp utilizing two standard hex-head nuts and bolts to effect tightening.

FIG. 3 also illustrates the positioning of rollers 45 and 47 in structures 25. The position of the rollers in this embodiment can be changed into any other of the holes in the sides of structures 25 to adjust the tension on the inner power band.

FIG. 4 is a perspective view of wheeled carriage-assembly 33 shown without an upper foot-platform 89 according to an embodiment of the present invention. As disclosed in related applications such as U.S. Pat. No. 5,147,257, for example, there are four main weight-bearing wheels that are mounted to the carriage body and adapted to make contact on the upper surfaces of rails 22 such that the carriage assembly may ride side-to-side on the rails as urged by a user. The wheels are approximately 2 cm wide and are machined using an ultra high molecular weight (UHMW) long-chain polymer material as described in U.S. Pat. No. 5,147,257. A standard button-head shoulder-bolt (not shown) forms the shaft of each wheel. Ball bearings, washers, a lock washer, and a castle nut complete the assembly components for mounting wheels to the carriage body as described in U.S. Pat. No. 5,147,257.

As in '257, there are four main wheels that ride on upper surfaces of rails 22. Two are visible in this embodiment and are represented by element numbers 67 and 68. The remaining two main wheels are located toward the rear portion of carriage assembly 33 and are therefore hidden from view by carriage body 70, and are not represented in FIG. 4 to avoid unnecessary detail. These main wheels are mounted rotationally to carriage body 70.

Wheels 67 and 68 in a preferred embodiment are mounted at an approximate 12 degree angle from vertical with the angle toward the space in-between rails 22 such that they make contact with a more inwardly surface of each rail. The rolling surface of each wheel is concave such that the radius across the width of each wheel substantially matches the cross-sectional radius of rails 22. Wheels 67 and 68 as well as two main wheels that are not visible here are mounted through provided openings strategically located on carriage body 70.

In this embodiment, an additional set of four keeper wheels is provided of which two wheels 71 and 69 are visible in this view. Two other keeper wheels are located toward the rear of carriage assembly 33 and are hidden in this view by carriage body 70. Components forming the shaft and mounting hardware for keeper-wheels 71 and 69 are the same as those already described for wheels 67 and 68.

Keeper wheel 71 and 69 are strategically located beneath rails 22 at angled positions that are inverted from the angled positions of main wheels 67 and 68, and directly below weight-bearing wheels. Two angled mounting brackets 75 and 73 are provided and adapted to secure keeper wheels 71 and 69 by being also mounted to upper wheels 67 and 68. Wheels at the rear of carriage assembly 33 (not shown) are similarly secured as brackets 75 and 73 run the entire length of carriage assembly 33.

In this embodiment brackets 73 and 75 are secured to the upper wheels and the lower wheels, so the lower keeper wheels are positioned by the upper wheels, which are mounted to the carriage body. In other embodiments brackets 73 and 75 may extend further upward and be fastened to the underside of the carriage, such as by rivets or welding. The brackets may, for example, be fastened by any convention joining means. Angled mounting-brackets 75 and 73 assume an inclusive angle of approximately 140 degrees such that each wing is substantially parallel to desired wheel positions when mounted. Ideally, carriage assembly 33 will remain resident on rails 22 when changing applications. This will allow for interchangeability of pre-assembled modules that are complete with selected foot platforms mounted. Upper platforms such as platform 89 of FIG. 2 may vary in physical appearance depending on the application; however, identical fastening locations allow interchangeability with carriage assemblies such as carriage assembly 33.

There are yet additional improvements made to assembly 33 over the prior art. One such improvement is the provision of two clamping locations 63*a* and 65*a* located on the under-surface of carriage body 70 for the outer power band. A clamp bar 63 is illustrated as one of two such clamp bars that are used to secure resilient element 43. A second clamp bar for clamping location 65*a* is not shown, but may be assumed to be present. Previous embodiments disclosed in related documents describe only one clamping location located directly beneath the center of the carriage assembly. An advantage of having power band 43 clamped in two locations is that noise caused by a resilient element flapping against the underside of the carriage body is eliminated, and the carriage is stabilized even further.

Roller 59 is a third roller previously described to form a triangular configuration of rollers to support power band 46 of FIG. 2. Like all rollers described in this specification, roller 59 is crowned for the purpose of guiding resilient member 46 such that it remains centered on the rollers.

In this embodiment, roller 59 assumes a position much nearer in proximity to the underside of carriage body 70 than in the cross-referenced patents. This is due in part to the larger diameter (2 inch) attributed to rollers of the present invention as opposed to previously disclosed 1 inch diameter rollers in related documents. In addition, roller 59 is simply mounted in a position that is nearer the underside of carriage body 70 by means of a roller bracket 61. This is done to reduce wear caused by resilient members rubbing and slapping against each other, and also, to reduce associated noise. The clearance is carefully designed as well so that, as the roller carriage moves to each side and back on the rails, the slack portion of the outer power band is carried to the side in the direction of carriage motion, which also reduces noise and sudden engagement.

It will be apparent to one with skill in the art that there are other possible wheel arrangements that may be used with carriage assembly 33 than the one illustrated herein without departing from the spirit and scope of the present invention. For example, the tilt angle of main and keeper wheels may be more or less than 20 degrees as mentioned in this embodiment. There may also be more or fewer main and or keeper wheels than is illustrated here.

In one embodiment, independent wheel pairs comprising one main wheel and an associated keeper wheel may be bracketed independently such that there are four independently movable wheel sets.

Figure 5:
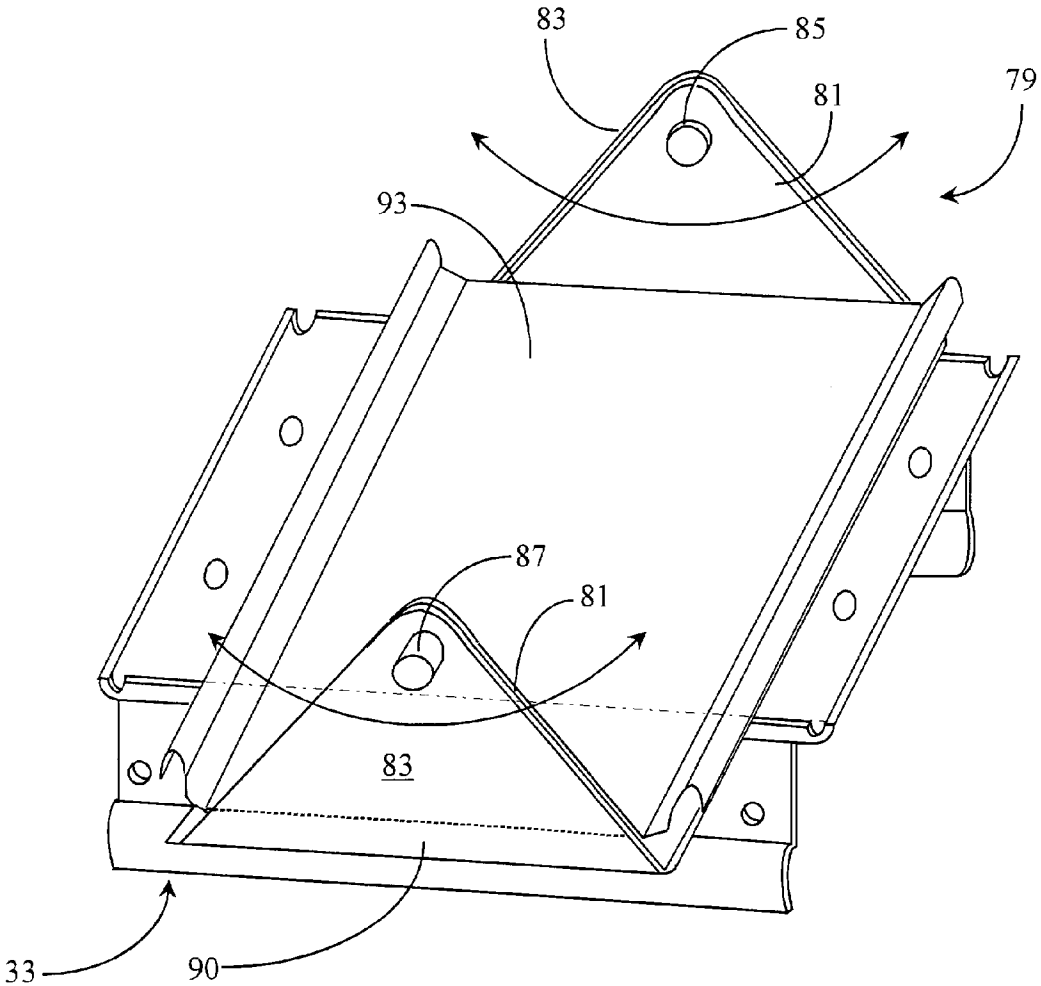
FIG. 5 is a perspective view of an upper carriage-assembly supporting a suspended footpad mounted according to an embodiment of the present invention.

FIG. 5 is a perspective view of an upper platform assembly 90 supporting a suspended footpad 79 mounted to a carriage assembly 33 (wheels and brackets not shown) according to an embodiment of the present invention.

In this example, a single suspended footpad 79 is provided and adapted to be pivotally suspended over upper platform assembly 90, termed a cradle in related U.S. Pat. No. 5,020,793, by means of two pivot points 85 and 87. Each pivot point 85 and 87, in a preferred embodiment, comprises a journal bearing, a spacer bushing, and a threaded stud with suitable lock washers and a nut fastener. There are equivalent ways known in the art to accomplish such a pivot. A suitable rubber cover is provided and adapted to fit over pivot points 85 and 87 to protect components from corrosion and general exposure. Pivot points 85 and 87 are arraigned in collinear fashion on opposite facing support wings represented by element number 81. The pivots are fixedly mounted in vertical structures 83, which are a part of the platform that mounts to carriage 33. As described in U.S. Pat. No. 5,020,793, footpad 79 may swing freely about pivot points 85 and 87 as illustrated by double arcs that represent direction of swing.

The general application illustrated in this example is as stated in the aforementioned related document whereas a user places only one foot in footpad 79 after it is installed on apparatus 9 of FIG. 1. By traversing back and forth over rails 22 of FIG. 1, he or she experiences a benefit of simulated edging. As the length of traversing approaches maximum length of rails 22, footpad 79 pivots maximally about pivot ends 85 and 87.

Also noted herein is a no-skid surface 93 provided in the same fashion as previously disclosed in FIG. 2 (elements 38 and 42). The fasteners for mounting the upper platform to carriage 33 are not seen in this view, but are the same as previously described for upper platforms in this disclosure.

According to a preferred embodiment of the present invention, footpad 79 with upper platform assembly 90 may be removed as one unit from and installed as one unit onto any wheeled carriage assembly having suitable mounting locations. In this way, a carriage assembly such as assembly 33 of FIG. 2 may be kept resident on apparatus 9 of FIG. 2 with the loosening, removing, and re-tightening of only two hex-head nuts being required to change applications. This method reflects the modular nature of accessories such as footpad 79 mounted to upper platforms according to a preferred embodiment. Loosening and tightening bolts may be performed with the aid of a convenient T-handle socket tool (not shown) adapted to fit hex-head nuts 53. In a preferred embodiment, all hex-head nuts subject to requirements of being removed and replaced due to the change of applications are the same size fitting the T-handle socket tool.

Carriage assembly 33 is shown in this example to illustrate orientation of footpad 79. Carriage assembly 33 may be of a different overall length than assembly 33 of FIG. 2. For example, a single footpad such as footpad 79 does not require a longer carriage assembly whereas a dual footpad installation would require a longer carriage assembly. In a preferred embodiment, carriage assembly 33 of FIG. 2 has a maximum length such that all modular accessories are supported. That is not to say, however, that a modular accessory cannot have it's own carriage of a different overall length.

Carriage assembly 33 of FIG. 2 would preferably remain resident on rails 22 of apparatus 9 (FIG. 2), especially if keeper wheels are used as previously described. However, in an alternate embodiment where keeper wheels are not used, the carriage assembly illustrated in this example may have main wheels installed and may be thought of as one module comprising assembly 33, upper platform 90, and footpad 79. In this embodiment, a roller such as roller 59 of FIG. 4 may be shared between different applications. A quick release of roller 59 and removal of bar clamps such as clamp 63*a* of FIG. 4 will also allow removal and replacement of different modules. However, removing bar clamps entails much more effort on the part of a user. The added effort may be offset by the fact that different applications may require different tensioning adjustment with respect to a resilient member such as member 46 of FIG. 2.

In addition to providing a single footpad in modular fashion as illustrated herein, in a further embodiment an upper platform is provided having two such single suspended footpads may be mounted in spaced-apart fashion. In yet another embodiment an upper platform assembly is provided wherein the spacing between suspended footpads is adjustable, and the adjustment apparatus is described further below with reference to FIG. 12. Also, because of added keeper wheels such as wheels 69 and 71 of FIG. 4, retaining a wheeled carriage on rails 22, footpad(s) 79 may be significantly extended in length without the risk of tipping carriage 33 off of rails when in use.

Figure 6:
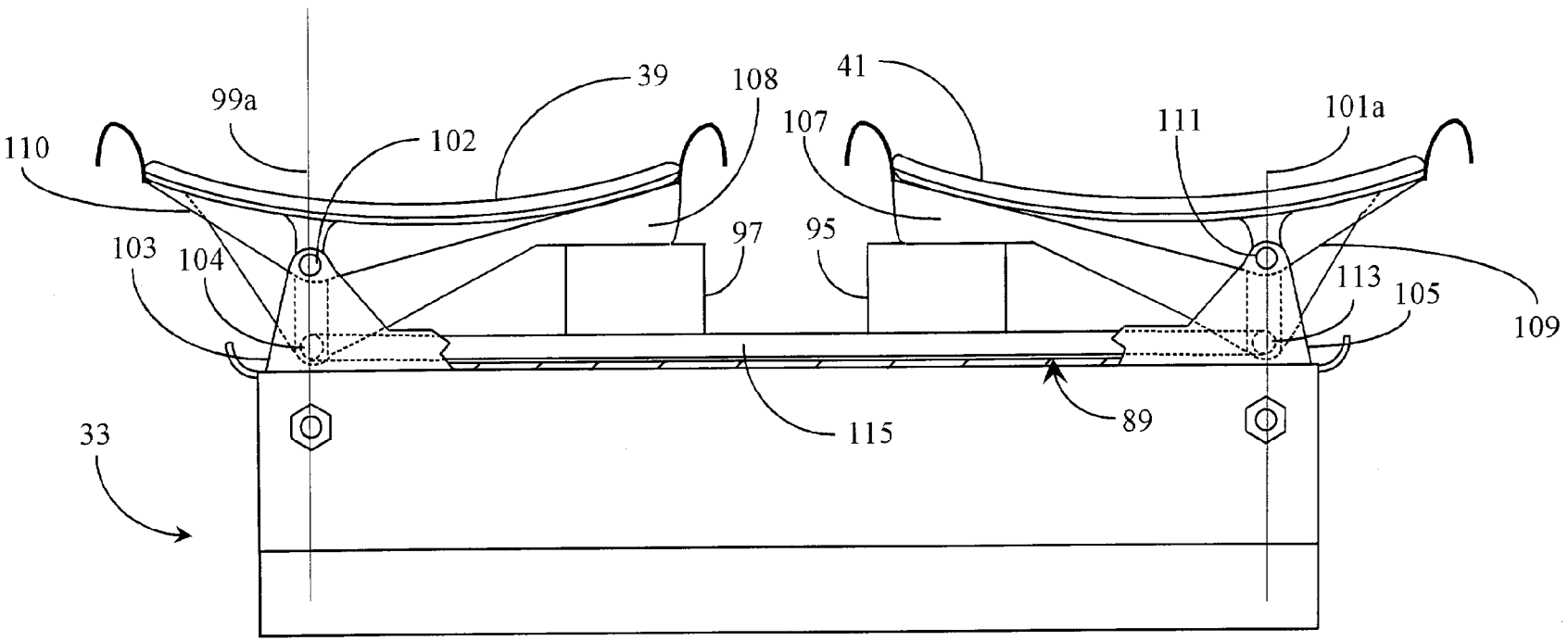
FIG. 6 is an elevation view of a wheeled carriage-assembly and mounted foot platforms according to an embodiment of the present invention.

FIG. 6 is an elevation view of wheeled carriage-assembly 33, upper platform 89, and mounted foot platforms 39 and 41 of FIG. 2 according to an embodiment of the present invention. Part of the upper carriage walls are broken out in this figure for the purpose of enabling a view of inner components, and the bottom plate of upper platform 89 is therefore shown partially in cross-section.

As with previously disclosed embodiments described in related documents, footpads 39 and 41 are pivotally mounted to pivot supports 103 and 105 respectively. Supports 103 and 105 are part of the upper-platform assembly not removed in this example. There are four pivot supports such as supports 103 and 105 with the remaining two identical supports positioned directly behind and to the backside of assembly 33 and therefore not seen in this view. Pivot pins 102 and 111 form a pivotal connection between depended ears 109 and 110 and an identical set of depended ears (not shown) located at the backside of footpads 39 and 41 respectively. A section-view of this relationship is detailed and described in '257 FIG. 6. Footpads 39 and 41 are die-cast in one embodiment to include the described depended ears.

A link-rod 115 is provided and attached to pivot points 104 and 113. The above-described configuration including components is duplicated at the backside of the assembly.

The connected link-rod assembly enables footpads 39 and 41 to pivot in unison during operation of apparatus 9 of FIG. 2. Resilient blocks 97 and 95 are provided as shock absorbers and are made of rubber or other suitable resilient materials.

Link-rod 115 is of a length such that when attatched to pivot points 104 and 113 with footpads 39 and 41 brought to their center-most position about pivot rods 102 and 111, that each footpad is canted, in some embodiments, somewhat toward the center (canted positions not specifically shown). However, in other embodiments it is desired that footpads 39 and 41 may be adjusted to assume a more level profile to facilitate use by more experienced users.

There are two ways to accomplish this task. In one embodiment, a second set of link-rods (not shown) is provided of a shorter overall length than the set represented by link-rod 115. By replacing link-rods 115 with the shorter rods, footpads 39 and 41 may be canted to a more level position. This, of course assumes that footpads 39 and 41 as used, in this embodiment, with link-rod 115 are canted in as described above. This method requires that four link-rods be provided with the modular footpad-assembly, two for the canted-in configuration, and two for the more level configuration.

In another embodiment link rods are provided that are themselves adjustable, so the effective length of the rods, and therefore the degree of cant of the footpads may be adjusted within certain limits.

Figure 7A:
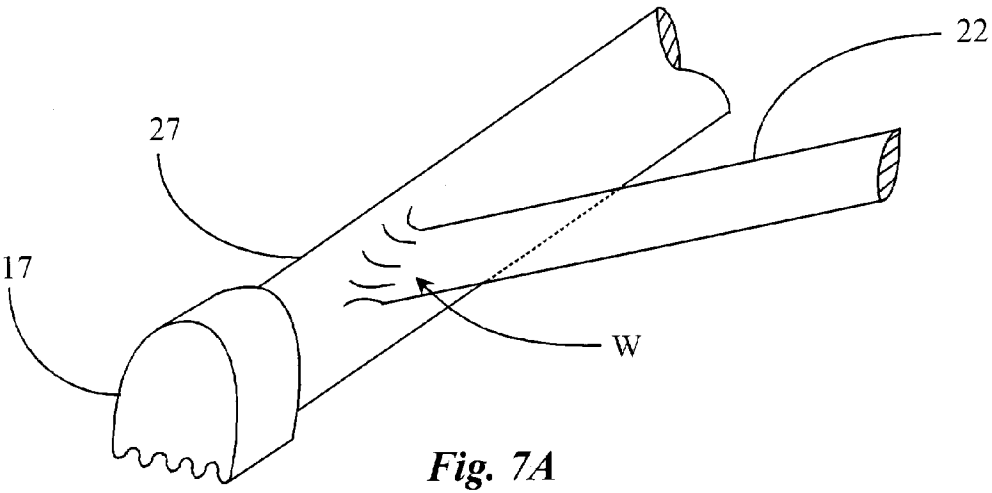
FIG. 7A is perspective broken-view of a portion of a rail, transverse end member, and end-cap according to an embodiment of the present invention.

FIG. 7A is perspective broken-view of a portion of a rail 22, transverse end-member 27, and end-cap 17 according to an embodiment of the present invention. In a preferred embodiment, rails 22 are welded to a location (W) above the longitudinal centerline of transverse end-members 27. The higher location allows keeper wheels such as wheels 71 and 69 of FIG. 4 from coming in contact with the floor at maximally traversed locations on rails 22. End-cap 17 now has a corrugated bottom for shock absorption as well as additional no-skid protection.

Figure 7C:
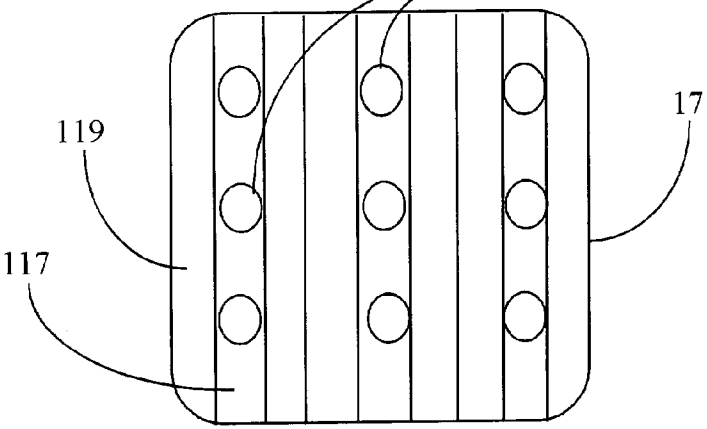
FIG. 7C is an elevation view of a bottom-side of the end cap of FIG. 7B.
Figure 7B:
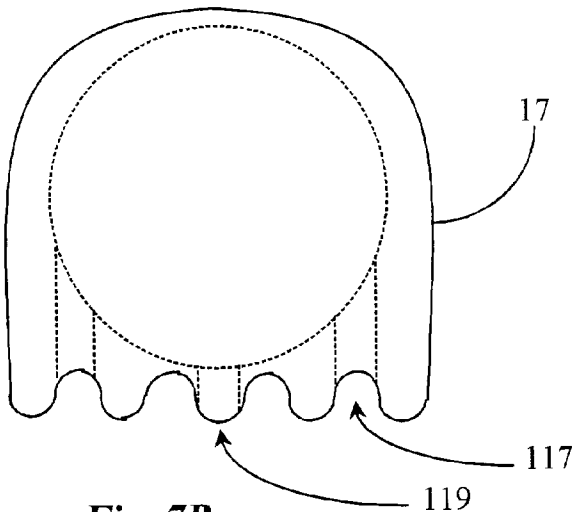
FIG. 7B is an elevation view of an end-side of the end cap of FIG. 7A.

FIG. 7B is an elevation view of an end-side of end cap 17 of FIG. 7A. End-cap 17 is molded of rubber-like material as described in previous embodiments. In order to improve over previous designs, a series of alternating raised portions 119 and grooves 117 are provided to form a corrugation feature extending across the bottom surface of cap 17. As described above, this adds a no-skid enhancement and a shock absorption enhancement.

FIG. 7C is a plan view of a bottom-side of end cap 17 of FIG. 7B. In addition to a corrugation formed by hills 119 and valleys 117, a pattern containing a plurality of through openings is provided generally through the bottom surface of end cap 17 and extending into the inner space reserved for housing the circular end of transverse member 27 of FIG. 7A. These openings are also illustrated in FIG. 7B as vertical dotted lines but are not described or witnessed. Openings 121 provide additional shock absorption capability. There are nine such openings in this example, however, it will be apparent to one with skill in the art that more or fewer openings 121 may be provided. Moreover, differing patterns may be used as well.

Figure 8:
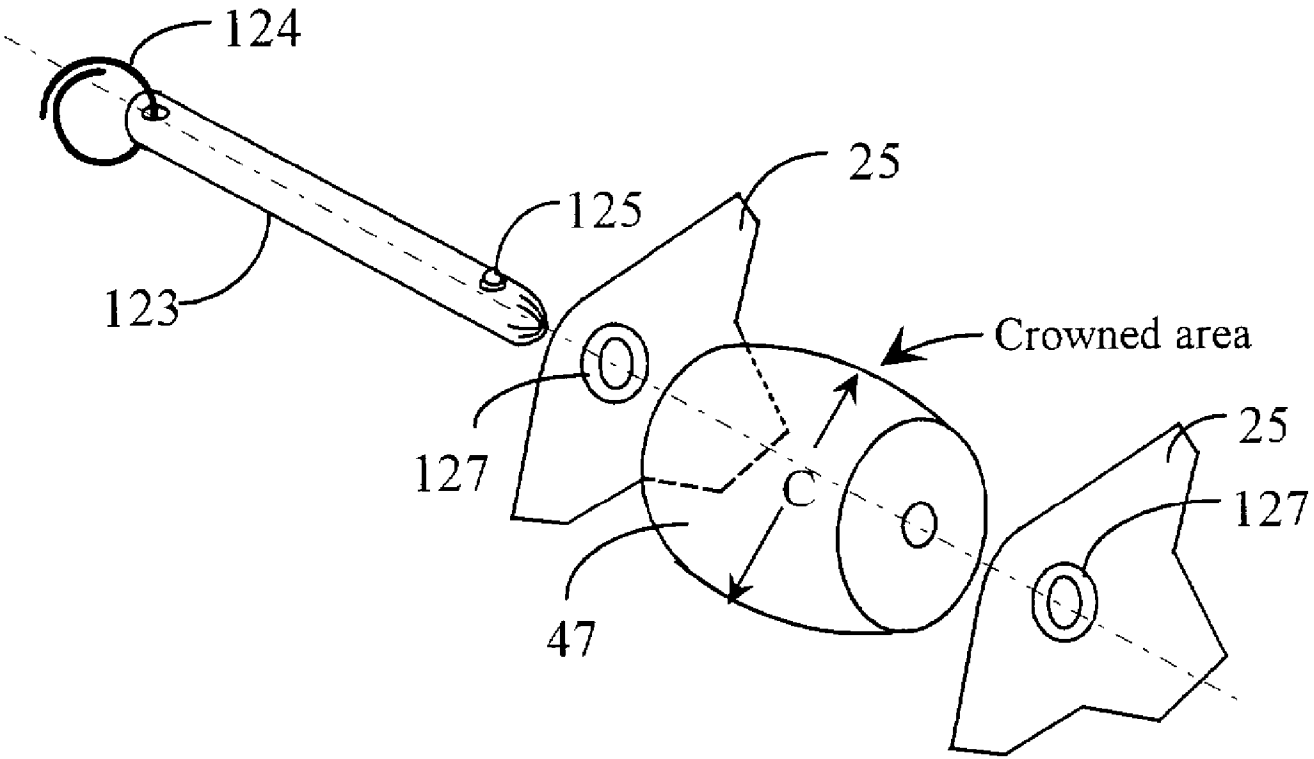
FIG. 8 is a perspective view illustrating various components of a quick-release roller assembly according to an embodiment of the present invention.

FIG. 8 is a perspective view illustrating components of a quick-release roller-assembly according to an embodiment of the present invention. As previously described in FIGS. 2 and 4 above, rollers supporting power bands such as roller 47 illustrated here, are crowned. Such a crowned area is labeled and illustrated by an accompanying witness arrow. A dimension C represents the diameter of roller 47 at the crowned area. It has been described above that a preferred diameter is 2-inches for rollers, which is assumed to be taken at the crowned area leaving the end diameters of each roller less than two inches in diameter. However, in some embodiments, the crowned area of a roller such as roller 47 may be larger than 2-inches.

A roller shaft or pin 123 is provided and adapted to be an axle for roller 47 between elements of structure 25 of which broken portions are represented here. Pin 123 has a spring-loaded detent 125 in one end and a pull ring 124 through a hole in the other end. Through-openings in elements 25, each having a polymer bushing 127, are provided to receive pin 123. By placing a roller in position between brackets 25, pin 123 may be placed through selected collinear bracket-holes with bushings 127 and roller 47. Pin 123 is of sufficient length such that it protrudes past the outer surfaces of structure 25 on both sides, and when in place detent 125 prevents accidental withdrawal. The quick-release pins for rollers provide a means of quickly re-positioning rollers in structure 25 for tensioning adjustment. In an alternative embodiment later described, the rollers may be adjustably spaced even more simply using a dialed adjustment mechanism.

Figure 9:
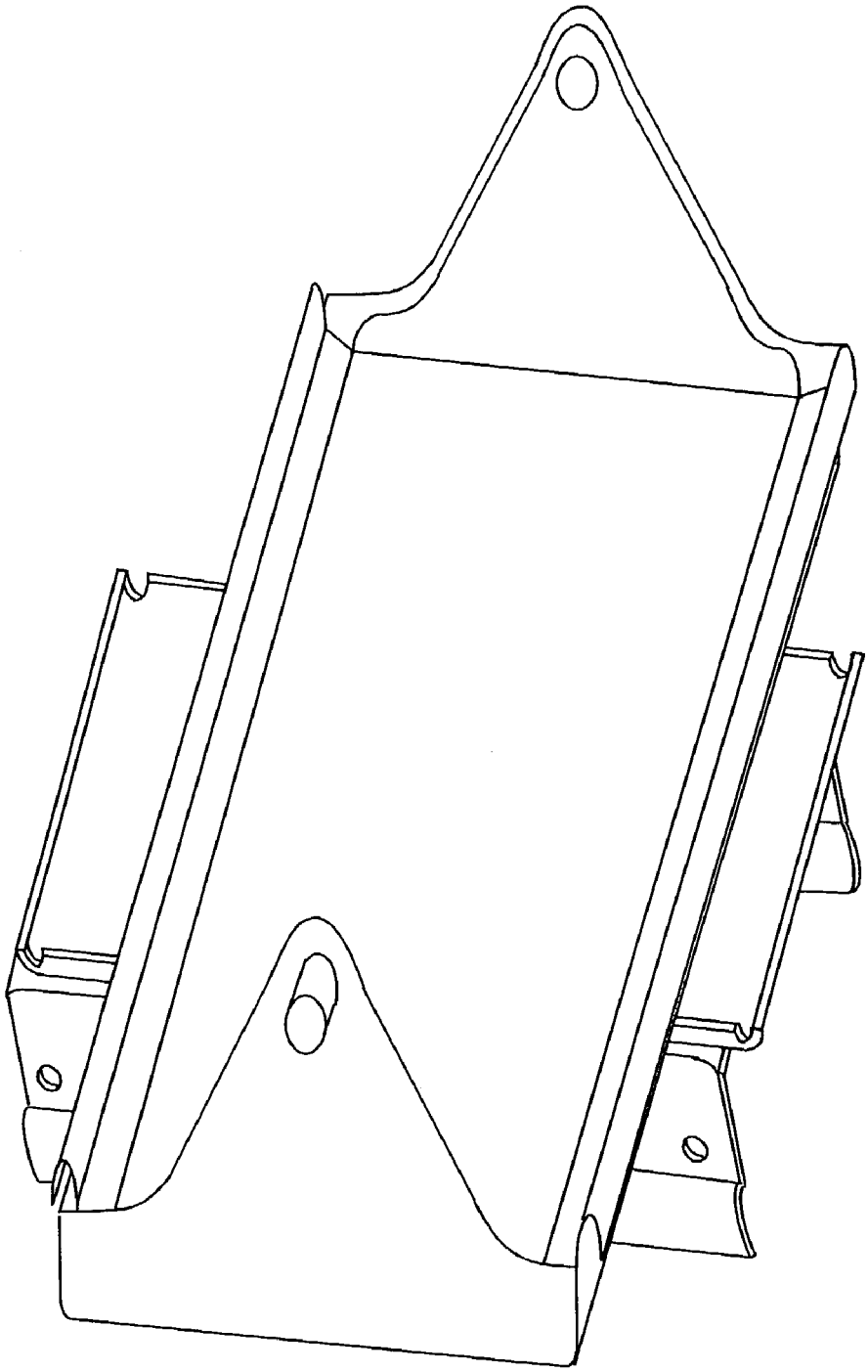
FIG. 9A is a plan view of an elongated footpad and carriage-assembly according to an embodiment of the present invention.
FIG. 9B is an elevation view of the footpad and carriage assembly FIG. 9A.
Figure 9A:
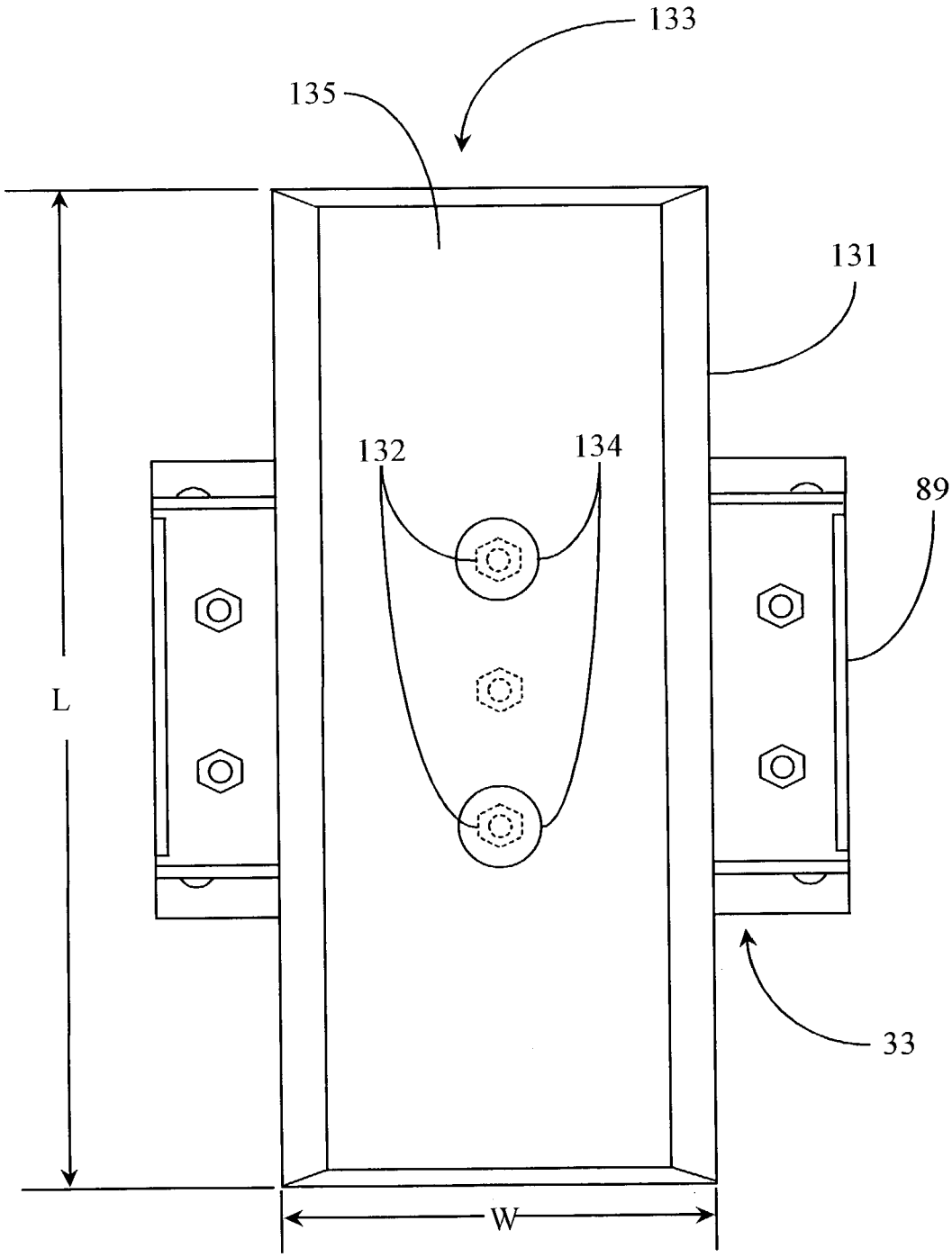

FIG. 9A is a plan view of an elongated footpad 133 and carriage-assembly 33 according to an embodiment of the present invention. A single footpad 133 is provided and adapted as a snowboard simulator presented as an option for apparatus 9 of FIG. 2. Footpad 133 is pivotally mounted to an upper platform assembly 89 in much the same fashion as footpads 39 and 41 of FIG. 6 except that footpad 133 is centrally mounted and there is no link-rod assembly required. Carriage assembly 33 is also illustrated in this example to show orientation only. A non-slip surface 135, preferably made of rubber-like material, is provided as in other embodiments previously described. Raised edges 131 are provided around the outer edges of footpad 133 for added protection from slipping.

A dimension L (length) is provided to be sufficient for allowing a user to place both feet on footpad 133 in positions similar to those used in snowboarding. A standard example would be standing sideways one foot spaced apart from the other about shoulder width. The exact dimension may vary according to application, however 25 inches should be sufficient for most users. A dimension W (width) is provided to be sufficient for covering the length of a users shoe or boot, about 15 inches.

In some embodiments not shown, there may be molded or otherwise formed positions to engage a user's feet, and fastening arrangements are also possible.

In another preferred embodiment of the invention the mounting of the single footpad for simulating operation of a snowboard is as shown for the footpads of FIG. 5, with the footpad suspended from pivots higher than the foot position.

The application presented here is only possible in an embodiment wherein keeper wheels are used such as wheel 71 and 69 of FIG. 4. Footpad 133 and upper platform 89 is a modular accessory and may be easily mounted to carriage assembly 33 of FIG. 2 by removing two hex-head nuts 132, placing the unit over carriage assembly 33 of FIG. 2 and then replacing and re-tightening the nuts. Clearance holes 134 are provided through footpad 133 to allow access for a T-handle socket-tool such as the one previously described in FIG. 5.

Figure 9B:
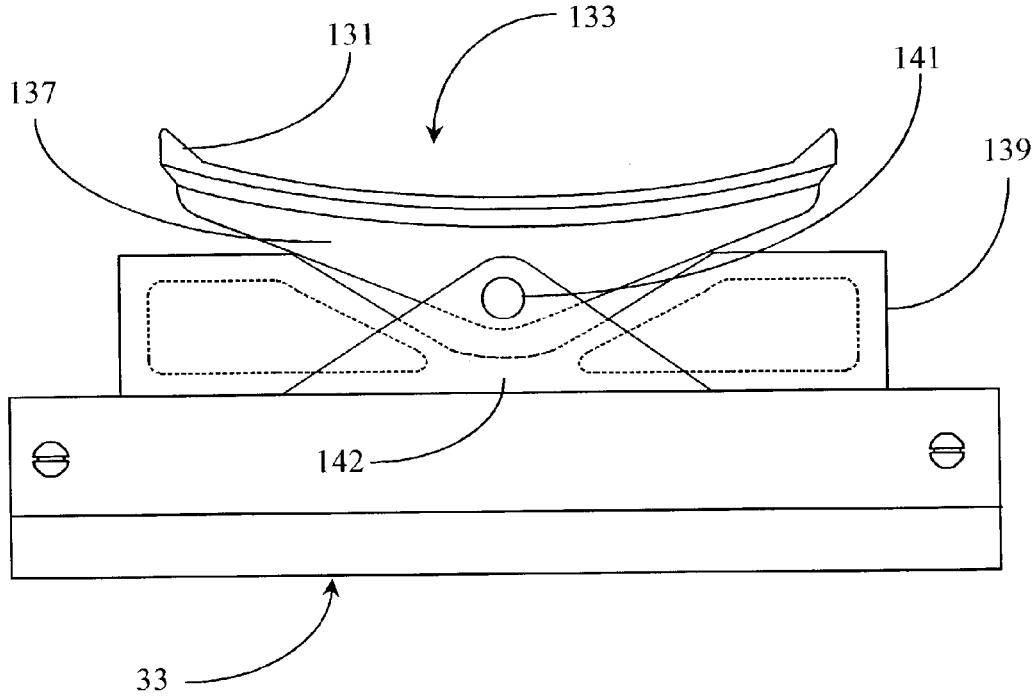

FIG. 9B is an elevation view of mounted footpad 133 of FIG. 9A. As described in previous embodiments, footpad 133 is die-cast. However, other suitable materials and forming methods may also be used. Depended ears 137 are provided at either end on the underside of footpad 133 for the purpose of accepting a pivot rod 141 through collinear and opposite facing openings. Pivot rod 141 also extends through collinear openings provided in support wings 142 arranged in similar opposite facing fashion as depended ears 137. When mounted, pivot rod 141 extends through all four collinear openings in depended ears 137 and support wings 142. Pivot rod 141 also extends through both walls of the upper platform assembly 89 of FIG. 9A (not shown). Pivot rod 141 may be secured to the above mentioned carriage walls by castle nuts or other types of fastening nuts (not shown) as described in U.S. Pat. No. 5,147,257.

In this example, there are no link-rods or other required hardware to direct rotation of footpad 141. Rather, a resilient stop is provided and adapted to stabilize the rotation of footpad 133 while in use. Stop 139 is analogous to resilient blocks 97 and 95 of FIG. 6 in that it acts to impede and direct rotation. However, resilient stop 139 is provided as one piece rather than two pieces in this example. Stop 139 also extends the length of carriage assembly 89 such that maximum support is afforded. When not in use, footpad 133 rests against stop 139 in a centered and level position.

In one embodiment, stop 139 has two areas within its molded architecture that are hollow or perhaps filled with a less dense material than rubber. These areas are shown here by dotted polygonal shapes. The respective areas lie, one beneath the left side of footpad 133, and one beneath the right of footpad 133. When footpad 133 is in use such as on apparatus 9 of FIG. 2, the areas within stop 139 are caused to collapse under pressure of a respective side of footpad 133 during normal rotation. For example, each time a user traverses to one side of apparatus 9, the opposite-side area is caused to collapse. Several factors dictate the amount of collapse. These factors include a user's weight, speed of traverse, and any hard motions urged on footpad 133 by the user. Preferably, resilient stop 139 is manufactured to withstand sudden shock, and be strong enough to support a considerable stress without complete collapse. Advanced users may simulate back and forth movements experienced in snowboarding.

Figure 10:
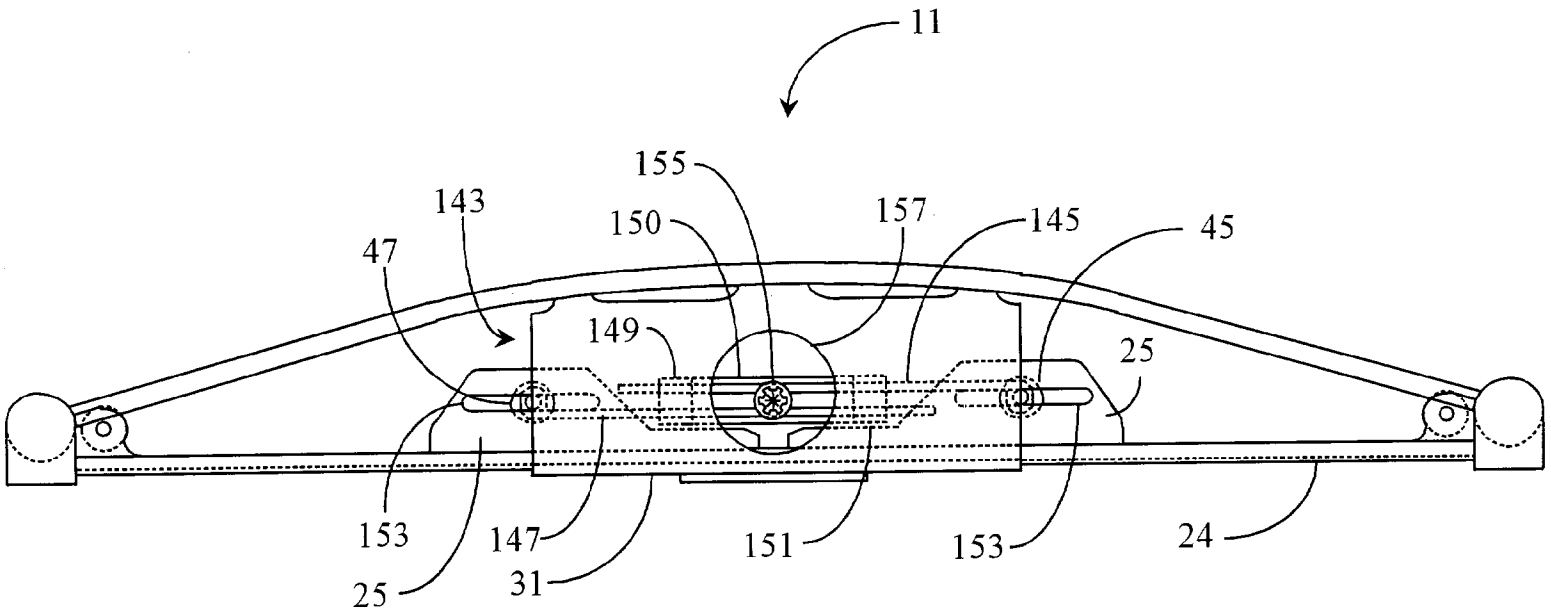
FIG. 10 is an elevation view of the frame structure of FIG. 1 illustrating roller-band tensioning hardware according to an embodiment of the present invention.

FIG. 10 is an elevation view of frame structure 11 of FIG. 1 illustrating an optional roller/band tensioning hardware 143 according to an embodiment of the present invention. According to this embodiment of the present invention, an optional apparatus and method is provided for tensioning a central power band such as band 46 of FIG. 2. Instead of a quick-release method for rollers as described in FIG. 5, whereby rollers are removed and then re-mounted in different positions, structure 25 on each side now has an elongated slot 153 for enabling a mounted roller such as roller 45 to be loosened and slidably positioned. Each structure 25 has opposite slots 153 on either side of belt-guide 24 such that a pair of slots 153 may accept a roller assembly such as for rollers 45 and 47.

Figure 11A:
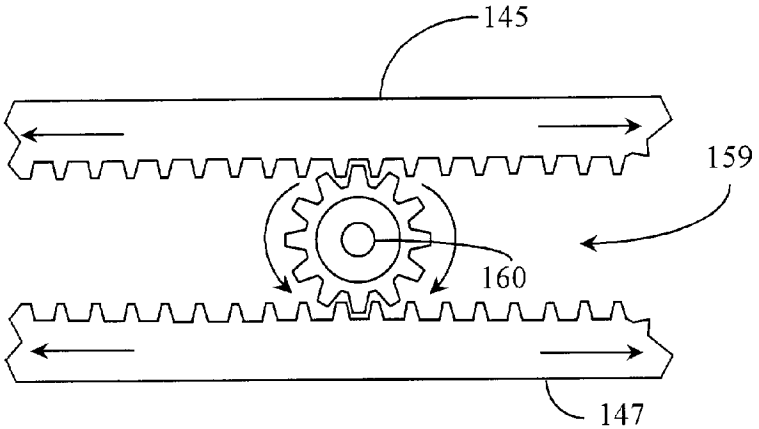
FIG. 11A is a broken view of a potion of toothed rails and a toothed gear of FIG. 10 according to an embodiment of the present invention.

Rollers 47 and 45 are, in this embodiment, held by an upper toothed-rail 145 for roller 45, and a lower toothed-rail 147 for roller 47, further illustrated in following FIG. 11A. Bracketed roller mounts (not detailed) on the roller side of each toothed rail form a rigid connection between the roller shafts of respective rollers to respective toothed rails. Toothed rail 145 is rectangular in cross-section and has a plurality of gear-teeth (not shown) arraigned along its length in the manner of a gear rack. In some embodiments a standard gear rack may be used.

When positioned properly, toothed rail 145 presents its gear teeth in a downward direction or along its bottom surface. Toothed rail 147 is identical to toothed rail 145 and they are, in fact, interchangeable. An inverse positional relationship exists with toothed rails 145 (top rail) and 147 (bottom rail) such that respective gear tracks will face each other. Toothed rails 145 and 147 are held parallel and in position by a rail guide 150, as shown in FIGS. 10 and 11C and D. Rail guide 150 has two rail-keepers installed thereon and adapted to hold toothed rails 145 and 147 in a parallel relationship and at the required distance apart. These are a rail keeper 149 positioned left of center, and a rail keeper 151 positioned right of center. The above-mentioned components of hardware 143 are manufactured of a durable material to provide wear resistance, for example, and there are several suitable materials for such applications.

A gear (pinion) 159, as shown in FIGS. 1A and B, is provided and adapted to mesh with opposite-facing gear tracks as presented on toothed rails 145 and 147. In this example, the gear is positioned directly behind of and forms a part of a gear-handle assembly 155. Hardware 143 may be conveniently mounted to the inside front surface of U-shaped support member 31 with conventional fasteners as known in the art. A cutout opening 157 is provided through the front wall of U-shaped support structure 31 to enable user access to a gear-handle assembly 155 for the purpose of adjusting tension. In some embodiments there is an access door.

In operation, a user adjusts power band tension to a greater or lesser amount by turning gear-handle assembly 155 clockwise (more tension) or counterclockwise (less tension). When the desired tension is achieved, he or she then releases a spring-loaded handle, and the positions are maintained. It may be assumed, of course, that a power band such as band 46 of FIG. 2 is in place during this operation. An incremental scale is preferably provided as a stamped or otherwise marked convention on the front face of support member 31, or along surfaces of the guides for the adjustment assembly. This will allow a user to return to known tension amounts without experimentation.

It will be apparent to one with skill in the art that a method for mounting hardware 143 to frame structure 11 may differ from the specific apparatus illustrated here without departing from the spirit and scope of the present invention. For example, U-shaped support member 31 may have a suitable slot running along its length for hardware 143 to fit into. There are other possibilities.

FIG. 11A is a broken view of a portion of toothed rails (racks) 145 and 147 and a toothed gear (pinion) 159 of FIG. 10 according to an embodiment of the present invention. Gear 159, as previously described in FIG. 10, is positioned between and meshes with toothed rails 145 and 147.

Figure 11B:
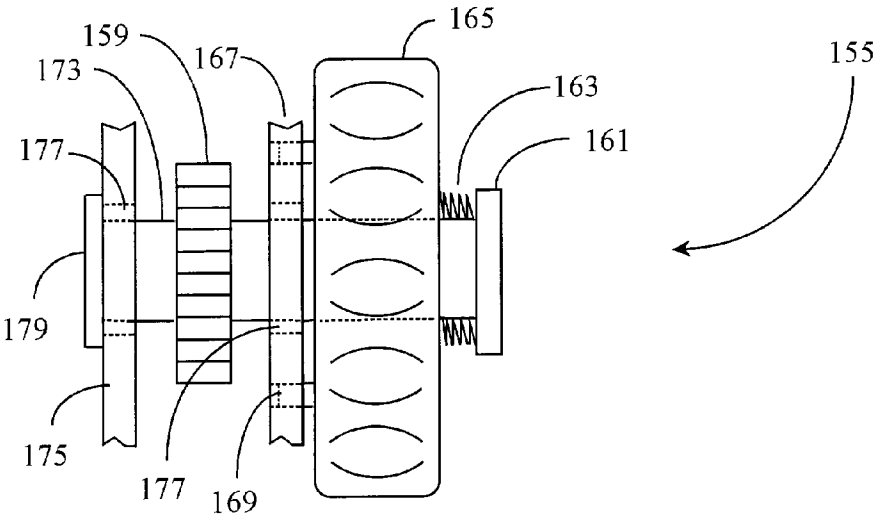
FIG. 11B is an elevation view of the handle assembly of FIG. 10.
Figure 11C:
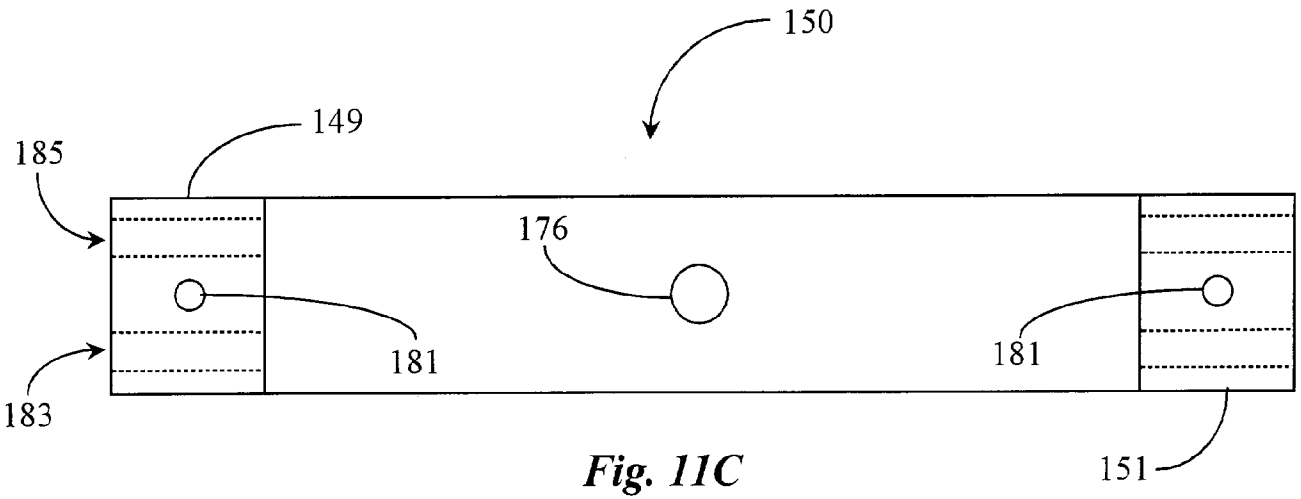
FIG. 11C is an elevation view of the rail-guide bracket of FIG. 10.

FIG. 11B is an elevation view of the handle assembly 155 of FIG. 10, and its integration with gear 159 and its mounting and operation. In this embodiment gear 159 is fixedly mounted to a shaft 173 that extends through opposite frame members 167 and 175 carried by bearings 177. A serrated wheel 165 is slidably mounted to shaft 173 outside the area of gear 159 by a spline on the shaft and the wheel. Shaft 173 has an end 161 and a compression spring which urges wheel 165 toward frame member 167. Pins 169 fit into matching holes in frame member 167, urged by spring 165. A user may grasp wheel 165, pull it toward end 161 against spring 165, whereby pins 169 are withdrawn from the matching holes in frame member 167, and the wheel is free to turn the gear. By turning the gear in either direction the user can then move rollers 47 and 45 either closer together or further apart, thus adjusting the tension on the power band. When the user releases the wheel, the spring causes the pins to re-engage, and the rollers are then retained in the new positions.

It will be apparent to one with skill in the art that there are many other mechanisms that may be employed to create a spring-loaded engagement handle for gear 159 without departing from the spirit and scope of the present invention. Other handle functions and assembly requirements may differ from the example shown here. The inventor intends the above-described handle assembly to be only one example.

Figure 11D:
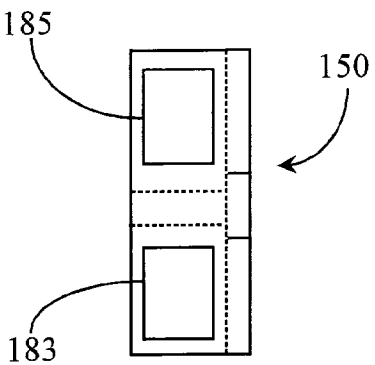
FIG. 11D is a right-side view of the bracket of FIG. 11C.

The skilled artisan will understand that supporting guide 150, as shown in FIG. 11C and FIG. 11D, and other supporting elements for the rack-and-pinion mechanism described above may be accomplished in a number of different ways, and is within the skill of engineering practitioners. Detailed description of this portion of the mechanism is therefore not undertaken here.

Figure 11E:
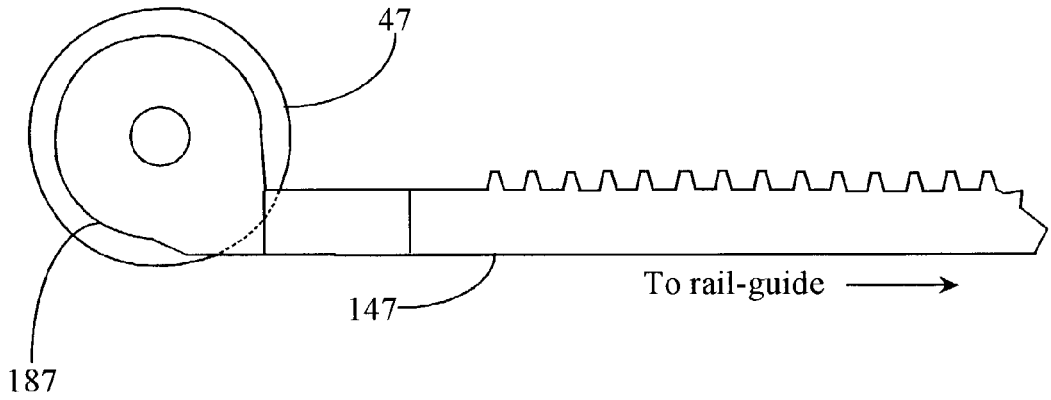
FIG. 11E is a broken view of a portion of the bottom toothed-rail, roller, and bracketed roller-mount of FIG. 10.

FIG. 11E is a broken view of a portion of lower rack 147, roller 47, and a bracketed roller-mount 187 of FIG. 10. As previously described, a roller such as roller 47 is mounted to a rack such as rack 147 by means of a bracketed roller mount shown here as element 187. Roller mount 187 is adapted to fit over the ends of a roller axle by virtue of a forked construction, similar in some respects to a mount for a paint roller, for example.

Figure 11F:
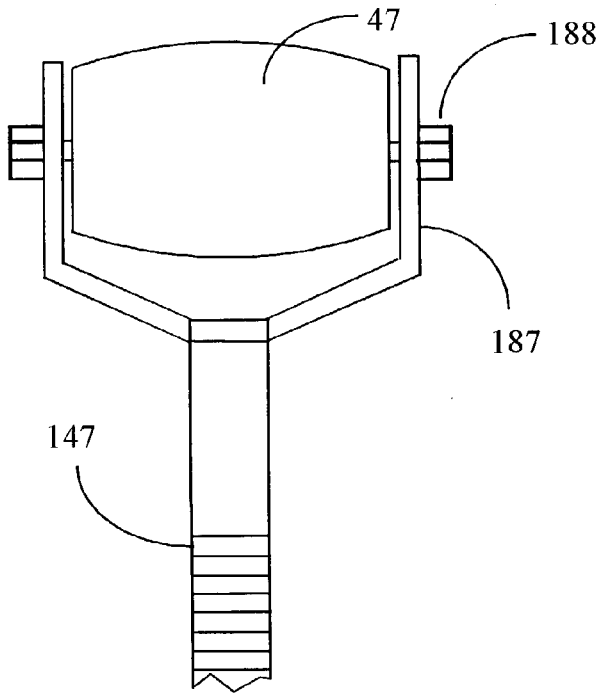
FIG. 11F is a broken view of the bottom toothed-rail, roller, and bracketed roller-mount of FIG. 10 as seen from an overhead vantage.

FIG. 11F is a plan view of the assembly of FIG. 11E. As can be seen in this view, roller mount 187 is a simple forked bracket structure fastened to the end of rack 147. Guide ends 188 are provided for guiding in slots of the rail guides 150 to constrain the translation direction in operation. In a preferred embodiment these guides are of a UHMW material for low-friction and for noise and vibration reduction.

Figure 12:
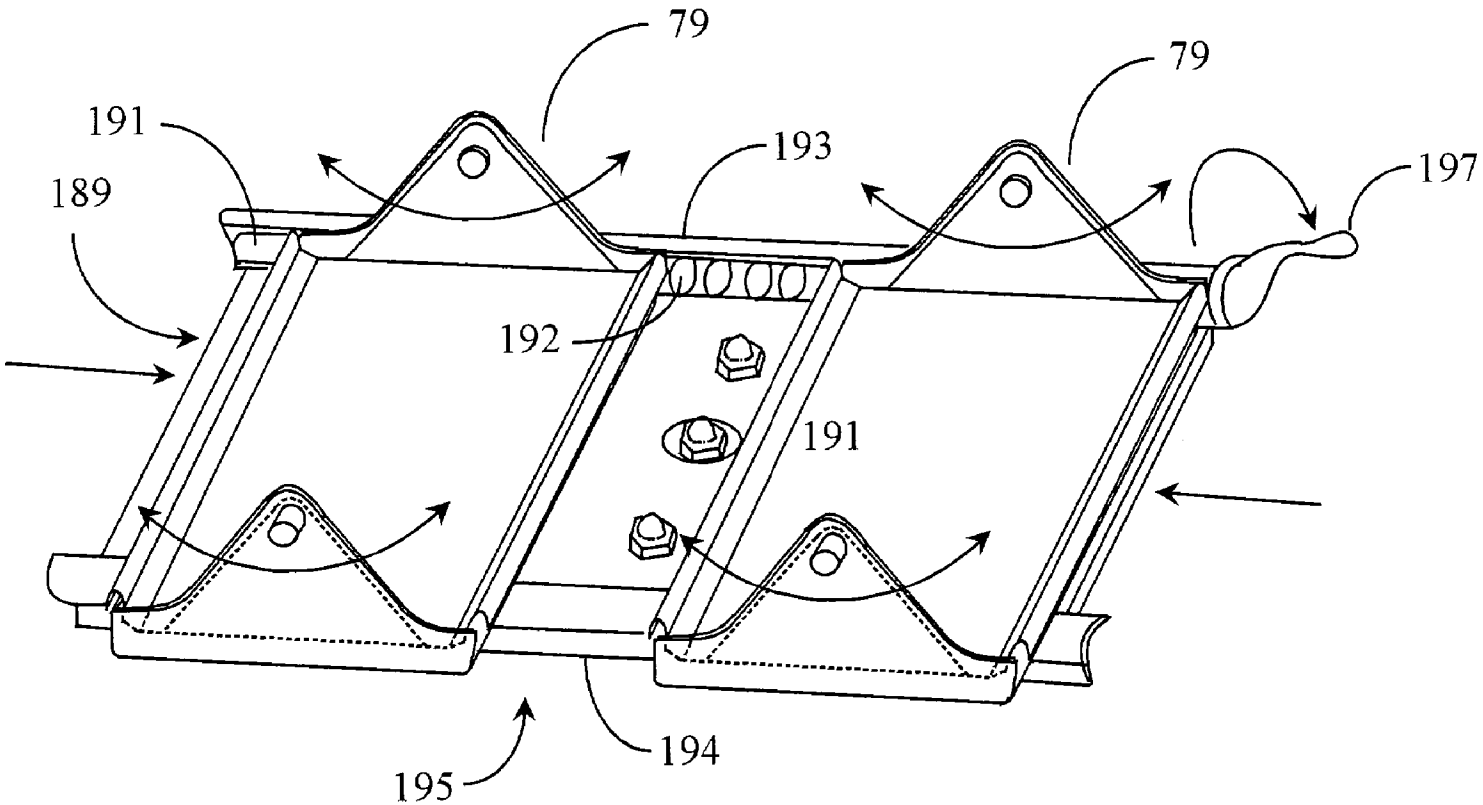
FIG. 12 is a perspective view of an adjustable double footpad module according to an embodiment of the preset invention.

FIG. 12 is a perspective view of an adjustable double-footpad upper module 195 according to a further embodiment of the present invention. This model is termed the Double Black Diamond model by the inventor. As previously noted in FIG. 5, a suspended footpad assembly such as footpad 79 may be double mounted in an adjustable manner. Two suspended footpads 79 are illustrated in this embodiment mounted in a locked position on an adjustable plate assembly 189. Footpads 79 are similar in construction to footpad 79 of FIG. 5; hence they retain the same element number here.

Plate assembly 189 is an intermediary base that bolts on to a wheeled carriage such as carriage 33 of FIG. 4. Plate 189 has two opposite facing edges that provide guide channels 193 and 194 for movable suspended footpad assemblies. Channel 193 on one side is best illustrated in FIG. 12. Channel 193 is adapted to house a slotted cam-rod 191, which is adapted to lock the movable footpad assemblies in place.

Cam-rod 191 has a plurality of slots 192 arranged in equally spaced and collinear fashion, and presented over the entire length of channel 193 along one side of the plate assembly. The purpose of slots 192 is to engage a plurality of equally spaced teeth provided on one edge each of two toothed base-plates (not shown here but illustrated below), one each affixed to the bottoms of footpad assemblies 79.

A spring-loaded lever 197 is provided on one end of cam-rod 191 and is adapted to cause rotation of cam-rod 191 within channel 193 enabling slots 192 to be presented inward as shown or rotated back into channel 193 as directed by a user. Spring lever 197 in this embodiment fastens to channel 193 such that a wound spring engages a fixed location in the channel while the opposite end of the spring is retained by lever 197 creating a spring tension. There are several ways known in the art for a spring lever to be mounted such that a shaft or other part is put under spring tension. The spring-loaded arrangement provides for the cam rod to be always urged into the locked position for the footpad assemblies, so these assemblies may only be moved to adjust center distance under positive direction of the user.

By manually rotating spring lever 197 a user can unlock the footpad assemblies and manually move each to a new position as desired. In this way, footpads may be slidably inserted from either end of adjuster-plate 189, as indicated by directional arrows, and adjusted to any desired spacing related to center distance. When desired positions are attained, letting go of spring lever 197 locks the footpads in place on plate assembly 189. In one embodiment, a safety lock is provided to give added assurance that the footpad assemblies will stay in position during operation. Channel 194 on the opposite side is adapted to house non-toothed edges of the aforementioned toothed base-plates.

Figure 13A:
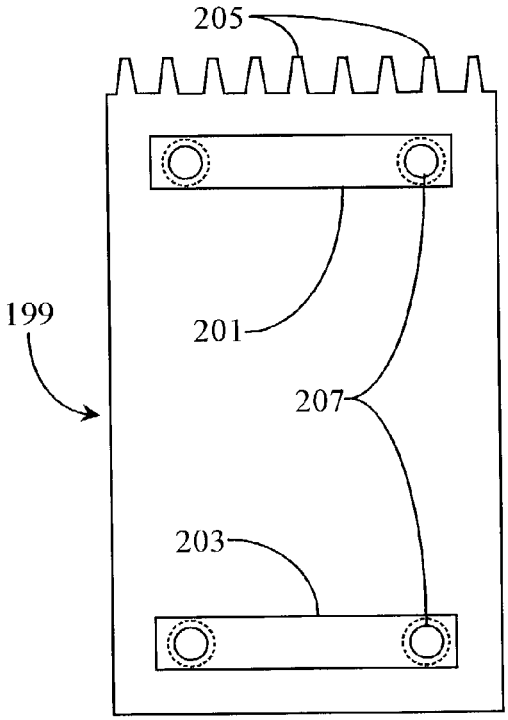
FIG. 13A is a plan view and FIG. 13B is a side view of a slotted base-plate according to an embodiment of the present invention.
Figure 13B:
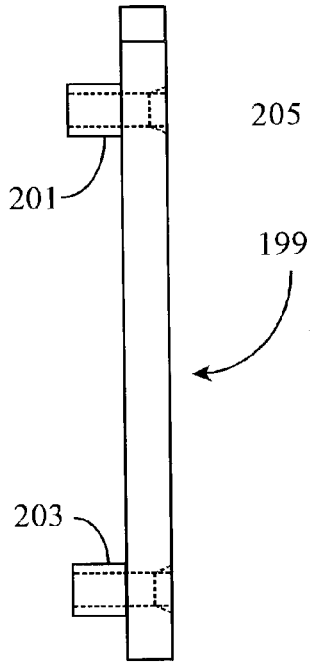

FIG. 13A is a plan view of a toothed base-plate 199 according to an embodiment of the present invention, and FIG. 13B is a side view of the base plate of FIG. 13A. As previously described, footpads 79 of FIG. 12 each have a toothed base-plate 199 installed on the bottom surfaces of associated footpad assemblies 79 (FIG. 12). Each base-plate 199 has a row of equally spaced teeth 205 presented along one edge for the purpose of engaging slots 192 of FIG. 12 in cam 191. In this embodiment, base-plate 199 has two spacer bars 201 and 203 adapted to space it from the underside of the outer frame member of a footpad assembly when mounted.

Bars 201 and 203 are, in this example, formed of one piece with base-plate 199, however, in other embodiments, they may be separate mounted structures. There are four threaded holes 207 (two for each spacer bar) provided through base-plate 199 and spacer bars 201, and 203 for mounting purposes. Machine screws or the like may be used for mounting plate 199 to the outer frame member of each footpad assembly. As seen in FIG. 13B, bolt holes 207 are chamfered on the side making contact with carriage assembly 33 such that they lay flat and may slide without scratching or marring the surface.

Figure 13C:
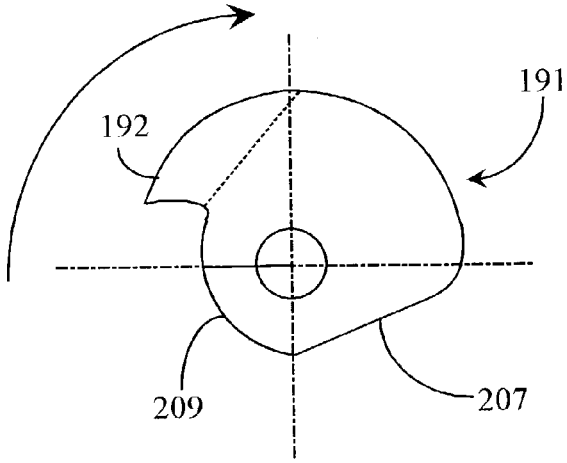
FIG. 13C is an end-view of the slotted cam-rod of FIG. 12.

FIG. 13C is an end-view of the slotted cam-rod 191 of FIG. 12 in this embodiment. Cam-rod 191 has a slotted portion 192 as previously described, a radiused back-grind 209, and a flat portion 207. As slots 192 are rotated in the direction of the arrow, engaging teeth 205 on base-plate 199 of FIG. 13A are released at the beginning point of back-grind 209. As flat 207 rotates so as to face teeth 205, a small amount of space is created between the top land portions of teeth 205 and the surface of flat 207 enabling footpad assemblies such as footpads 79 to be moved to a different position or removed altogether.

It will be apparent to one with skill in the art that there may be more than one general configuration of slots and teeth than is illustrated here without departing from the spirit and scope of the present invention. For example, a base-plate such as plate 199 may be slotted while a cam-rod such as rod 191 is toothed. There may be more or fewer slots and teeth presented, and so on. In an alternate embodiment, footpad assemblies may be lowered in from the top with teeth and slots remaining in a rigid configuration on both sides of a base-plate and on opposite facing structures mounted to an adjuster-plate wide enough to support this type of fitting. Clamps could be used to secure the footpad assemblies after lowering them into place.

In another embodiment of the present invention an alternative adjustment mechanism for footpads may be used comprising one or more spring-loaded pop-up detents. A first footpad assembly may be mounted to the plate assembly separately, allowing for individual adjustment, or with a second footpad as an assembly. A pop-up detent can be mounted on an edge of a footpad assembly in a position so that when a user manually pulls back and then releases a spring-loaded pin within the detent assembly, the pin slides in and out of a slot or hole on the face or edge of the plate assembly, the pin and slot or hole being in-line when the desired footpad position is attained. The plate assembly can have a plurality of such slots or holes arranged in equally spaced and collinear fashion. A spring-loaded detent assembly could comprise a cylindrically shaped casing open on the end facing the hole or slot and containing a pin that slides in and out in both directions. A protrusion or attachment to the pin serves as a handle enabling a user to manually pull the pin back within the casing. Within the casing and located behind the pin a spring of roughly the same diameter of the pin provides outward tension to the pin when a user manually pulls it back using the handle. When a user manually releases the pin in the mounted detent assembly the spring tension behind the pin pushes the pin into the aligned slot or hole and locks the footpad assembly into the desired position. Once locked into the desired position by the pin assembly, the footpad assembly may be otherwise mainly secured to the plate assembly by utilizing many different methods. By again pulling back the pin a user can unlock the footpad assembly and adjust to another position as desired. This manner of spring-loaded pin arrangement within the detent assembly provides for the locking pin to be always urged into the outer or locked position. In addition to the footpad adjustment functionality of the pop-up detent assembly, in various alternative embodiments the detent assembly may have more or less of an integral role of securing the footpad assembly to the plate assembly.

It will be apparent to the skilled artisan that there are alternative arrangements and mechanisms that might be used to allow the footpads to be spaced and secured with the new spacing. The mechanisms described above are but a few of the possibilities. There are many others. For example, an intermediate plate assembly could be provided wherein there are two plates with one telescoping into the other, and having a locking apparatus to fix the relative positions when the desired separation is achieved. In this embodiment one footpad would be mounted to one of the telescoping plates and the other footpad to the other.

Figure 14:
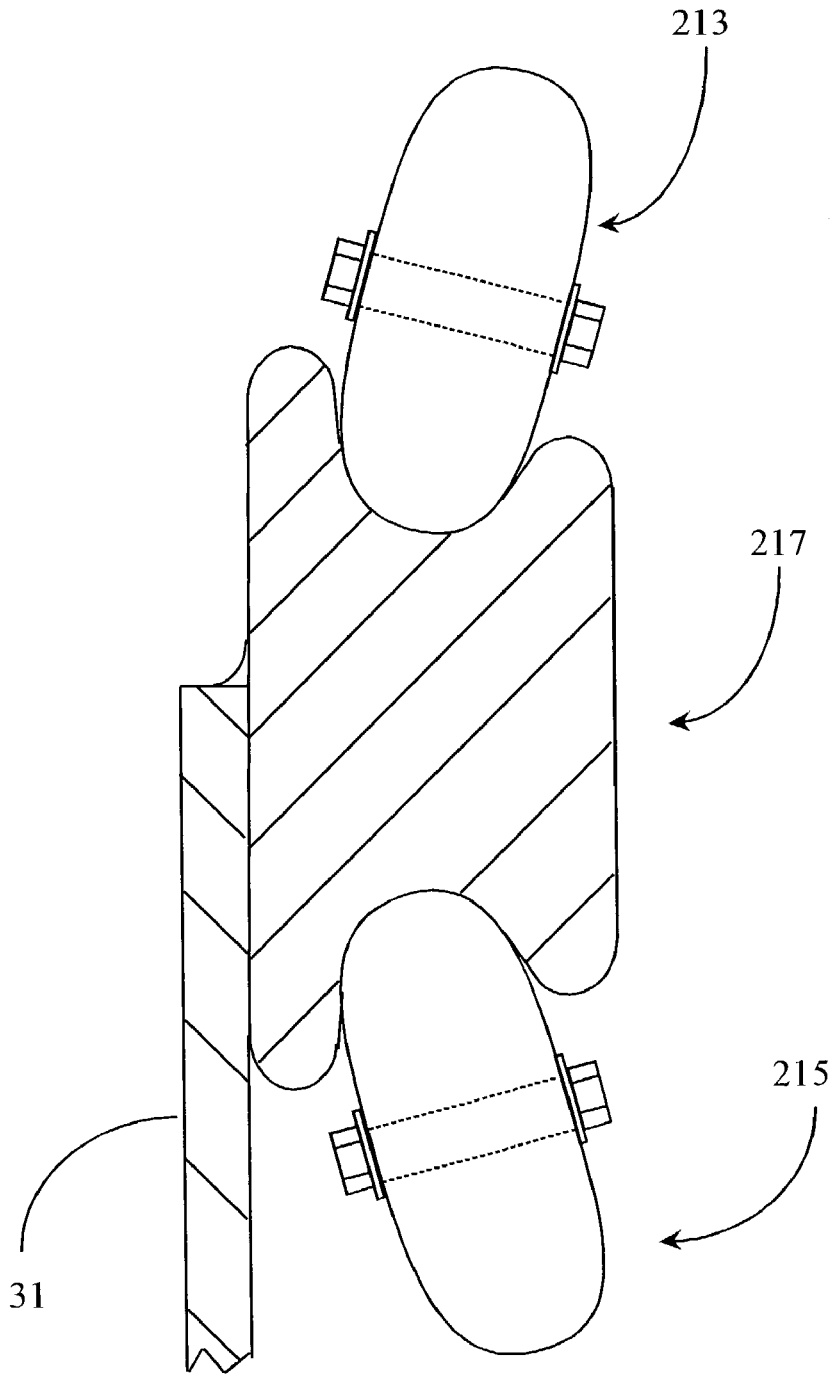
FIG. 14 is a cross-sectional view of a main wheel, a keeper wheel, and a semi-arcuate rail according to an alternate embodiment of the present invention.

FIG. 14 is a cross-sectional view of a semi-arcuate rail 217 with a main wheel 213, and a keeper wheel 215 in position according to an alternate embodiment of the present invention. As previously described in FIG. 1 above, semi-arcuate rails, shown round in FIG. 1 and other Figs. in embodiments described above, may also be extruded to provide opposite channels for wheels, and then die-formed to obtain a desired semi-arcuate shape. This embodiment is especially useful for applications having footpads or platforms of exceptionally large dimensional features (length and width) than standard assemblies. Keeper-wheels such as wheels 215 and wheels 71 and 69 of FIG. 4 provided added restraint in order to prevent an assembly from tipping or otherwise being lifted from rails during operation.

Rail 217 is shown welded in this illustration to frame member 31, and in embodiments of the overall apparatus using such extruded rails, the rails would also be welded to end rails 27 as described previously for rails 22. Wheels 213 and 215 are not shown as assembled to a wheeled carriage in this illustration, but would in practice be mounted to such carriages in much the same manner as already described for wheels used with round rails.

Figure 15:
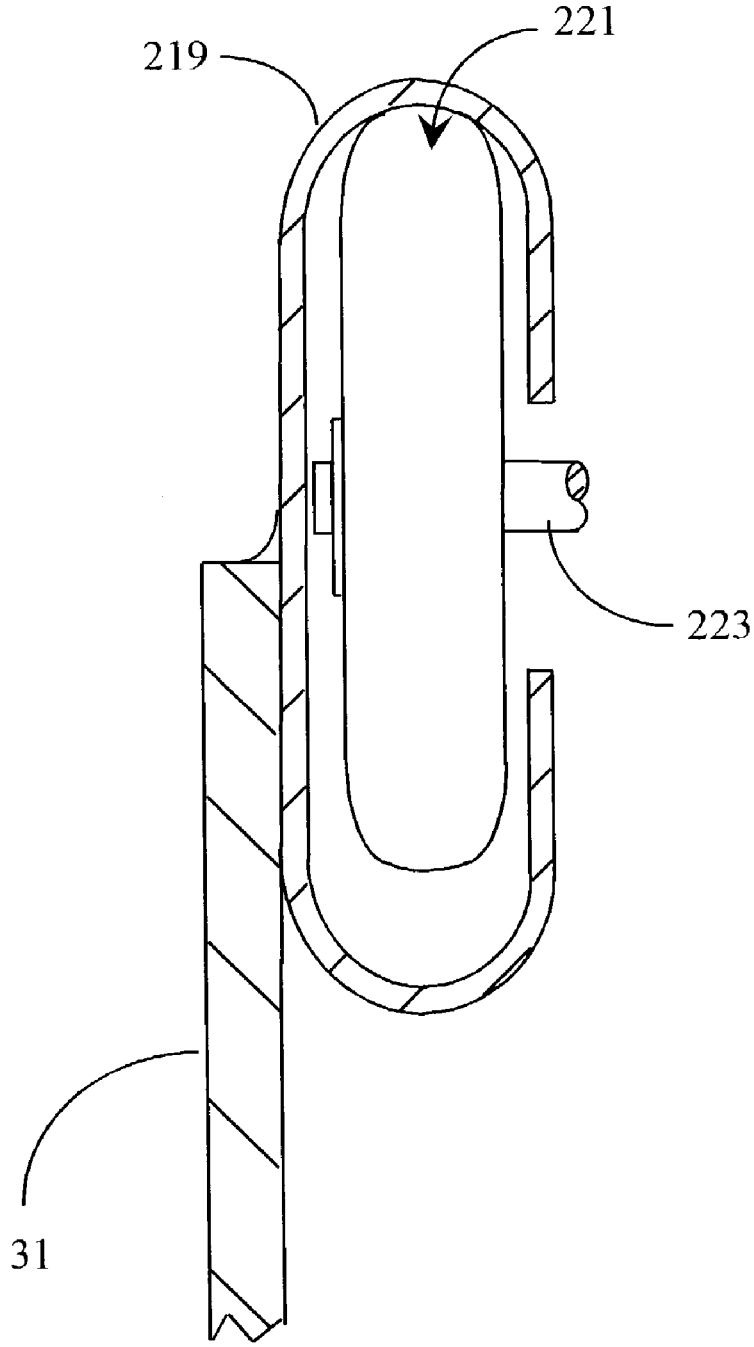
FIG. 15 is a cross section of an integral captive rail and wheel arrangement in an embodiment of the present invention.

FIG. 15 is a cross-section view through a rail 219 in yet another embodiment of the invention, showing a wheel assembly 221 having a shaft 223, with the wheel engaged in rail 219. In this embodiment rails 219 replace rails 22 or 217 shown in other embodiments, and are formed in an arc or an arc with straight-leg portions as taught elsewhere in this disclosure. Rails 219 may be extruded from suitable material, or may be formed by bending a plate and then forming the necessary arc using a die or other suitable tool. In preferred embodiments rails 219 are welded to structure 31 as shown, and also to end rails 27 (not shown).

In this embodiment Wheels 221 are mounted to a wheeled carriage by shafts 223 in various positions to support the carriage in its to-and-fro movements on (in) rails 219. Some wheels are mounted to contact the upper portion of rails 219 as shown in FIG. 15, and others are mounted to contact the lower portion of rails 219, thus accomplishing the functions of the wheeled carriage taught with reference to FIG. 4 having keeper wheels. It will be apparent to the skilled artisan that there are a variety of positions wheels may be mounted to accomplish the purpose.

Figure 16:
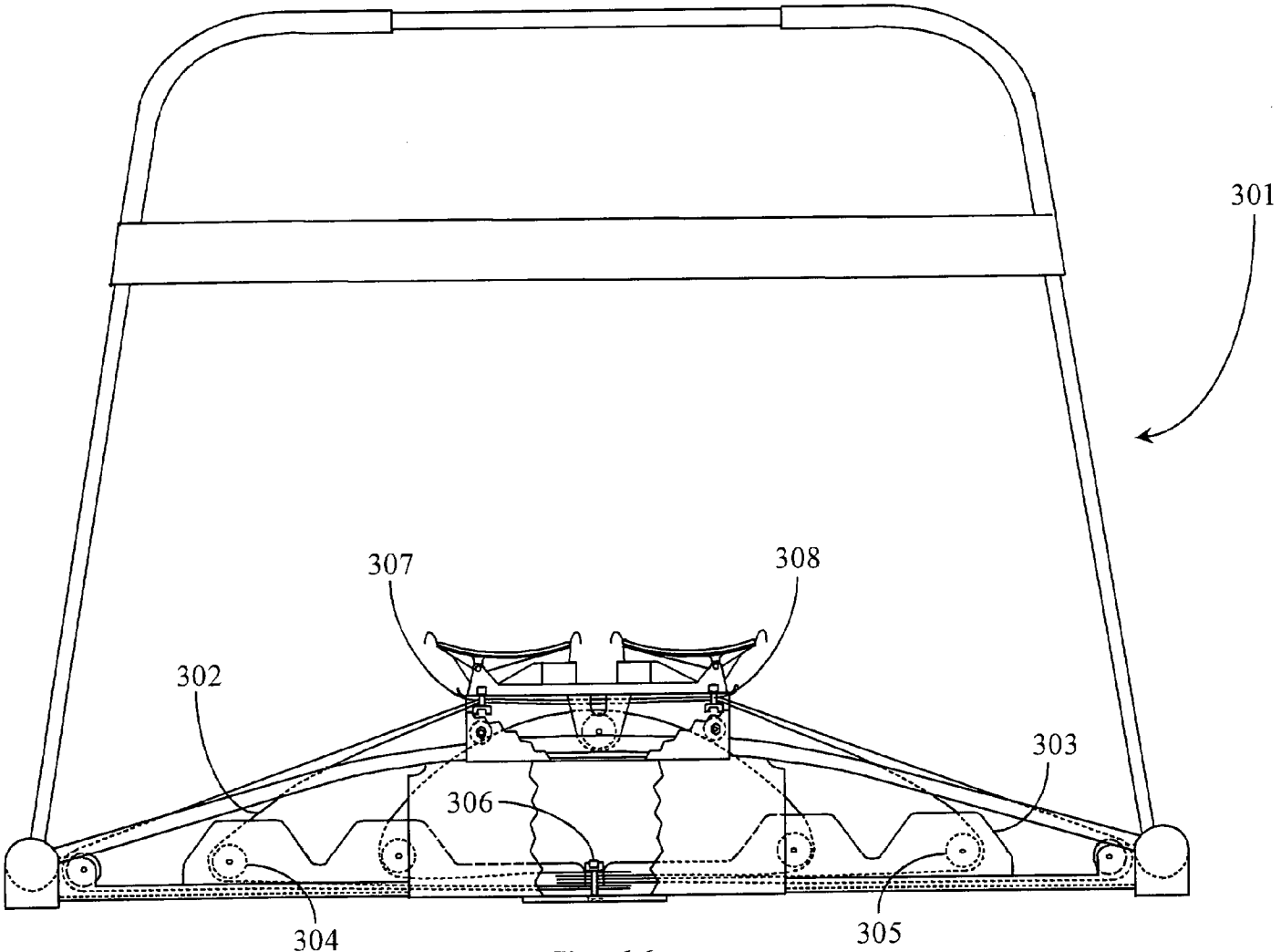
FIG. 16 is an elevation view of a ski-exercising device illustrating an optional third power band according to another embodiment of the present invention.

FIG. 16 is an elevation view of a ski-exercising apparatus 301 according to an embodiment of the invention illustrating an optional third power band. Apparatus 301 is provided having elements similar to those of exercisers previously described herein except for novel improvements described below. For this reason only the improvements are described. To better illustrate elements within, additional roller-mount openings similar to those of tensioning structure 25 of FIG. 1A are not shown but may be assumed to be present, and cut-away views are shown of the wheeled carriage and support member.

Apparatus 301 provides a third power band 302 assembled between the first, or outer, power band and the second, or inner, power band. In this embodiment the free ends of third power band 302 are illustrated as fastened at clamp 306, having one end clamped between the free ends of the outer band and the other end in between the ends of the outer and inner bands. It will be apparent that the clamping locations of power bands and positions of clamped free ends may vary. A tensioning structure 303 is provided, illustrated as a modification to a tensioning structure such as that of FIG. 1A, having a longer length and properties to support a third power band and hardware. Tensioning structure 303 is welded in this embodiment to the bottom surface of the central frame structure similarly to embodiments previously described. Rollers 304 and 305 are rotatably mounted to the outer positions of tensioning structure 303 providing support to third power band 302, third power band 302 extending from clamp 306 passing under the inner rollers mounted between rollers 304 and 305 and passing under and over rollers 304 and 305 back toward center, over a third roller rotatably mounted under the wheeled carriage and fastened with the outer power band to the underside of the wheeled carriage by clamps 307 and 308.

Improvements

Figure 17:
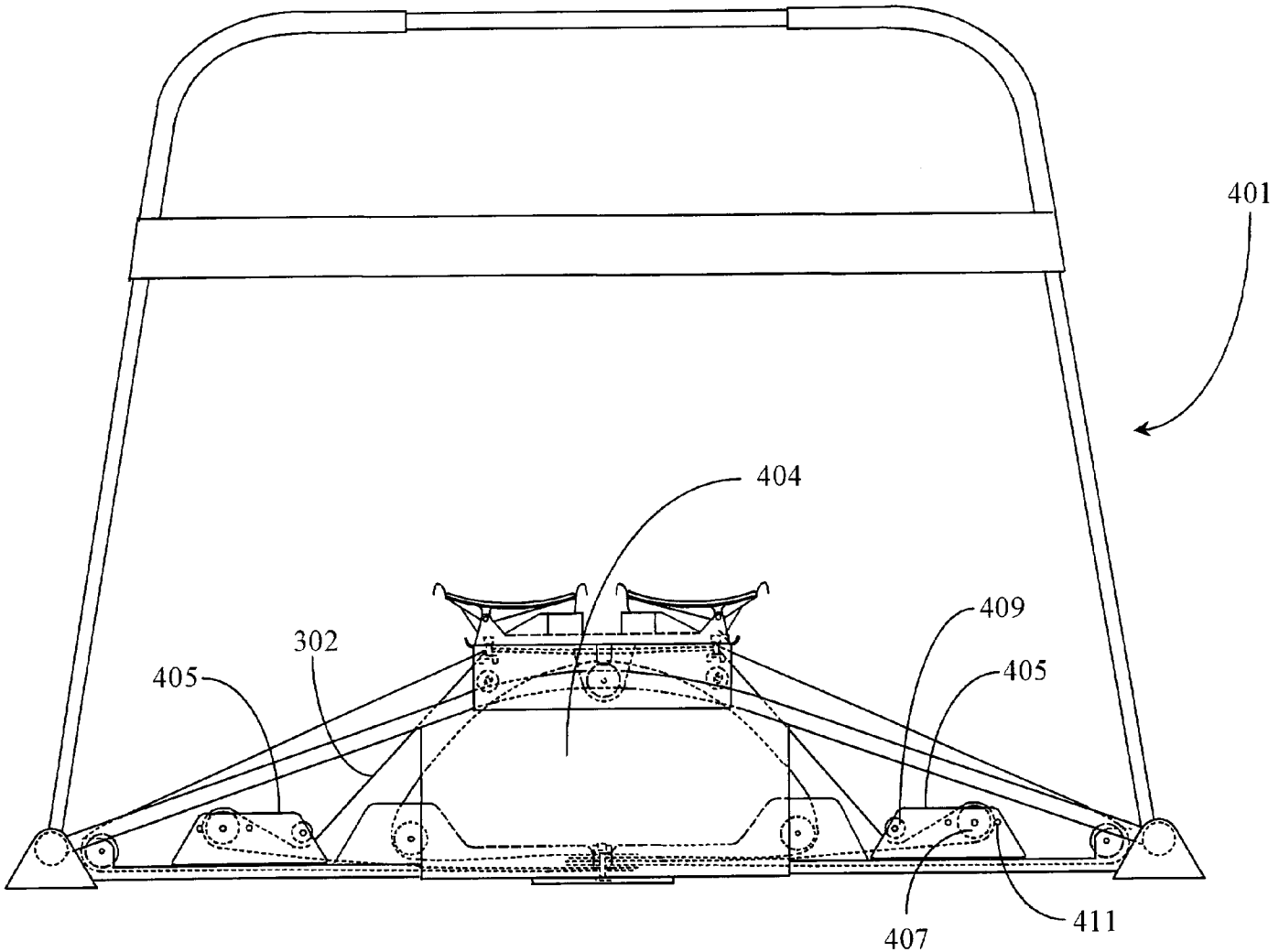
FIG. 17 is an elevation view of a ski-exercise device illustrating adjustable tensioning structures for an optional third power band according to an embodiment of the present invention.

FIG. 17 is an elevation view of a ski-exercise apparatus 401 illustrating adjustable tensioning structures for an optional third power band according to an embodiment of the present invention. Apparatus 401 in this embodiment provides many of the features and elements of apparatus previously described herein except for new and novel improvements described in detail below, therefore, only the improvements are described.

Apparatus 401 provides a third power band 302 assembled between the first, or outer power band, and the second, or inner power band, as described previously for apparatus 301 of FIG. 16. However, apparatus 401 provides a pair of improved tensioning structures for the optional third power band.

Tensioning structure 405 is illustrated as a modification to a tensioning structure such as structure 303 of FIG. 16, and is provided as a separate structure which, in the embodiment illustrated is affixed at each end to the bottom surface of the central frame structure 404 in similar locations to embodiments described in previous embodiments, utilizing a common fastener such as a bolt and nut. In alternative embodiments, tensioning structures 405 may be welded directly to central frame structure 404. Tensioning structure 405 is somewhat longer in length and has a lower profile than that of structure 303 of FIG. 16. Tensioning structure 405, in a preferred embodiment, is manufactured of strong, lightweight aluminum material, and may be die cast, machined, or otherwise formed utilizing similar strong, lightweight material in alternative embodiments.

Tensioning structure 405 differs significantly, however, from that of FIG. 16 in that a second tension roller 409 is provided to increase smoothness of operation of the ski apparatus under extreme tensioning as the wheeled carriage travels from side to side on the parallel rails during operation. As shown in the illustration, the optional third power band 302 is assembled between the first, or outer power band, and the second, or inner power band, the ends clamped at the bottom of the central frame structure 404, and the upper portion of the power band clamped at two locations under the wheeled carriage, similarly to apparatus 301 of FIG. 16.

The routing of power band 302 differs, however, from that of apparatus 301 of FIG. 16 in that it passes under the second tension roller 409, and then over and under the main roller 407 and then back towards the center of the central frame structure where it is clamped along with the ends of the first, outer power band and second, inner power band.

A plurality of through openings 411 are provided for tensioning structure 405 enabling the resistance point to be altered, thereby enabling the user to adjust the amount of tension encountered by the wheeled carriage when it travels to the outermost lateral positions. A total of three through openings 411 are provided in the embodiment illustrated, located near the upper edge of the body of structure 405 starting near the center and linearly arranged towards the outer edge of the structure. However, in alternative embodiments number and exact location of through openings 411 may differ to provide a varying range of tension adjustment positions.

Figure 18A:
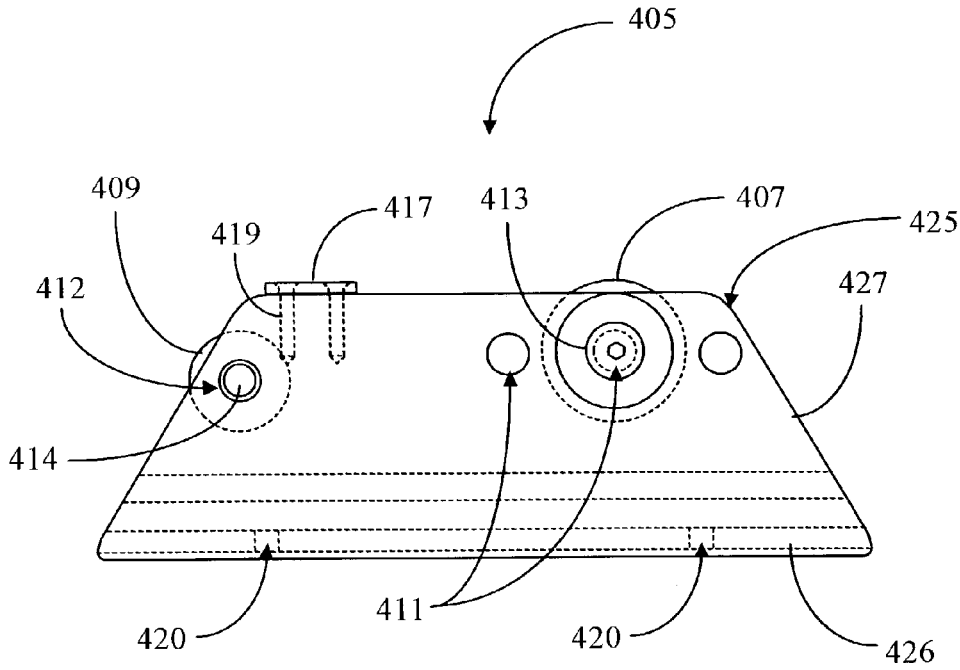
FIG. 18A is an elevation view of an adjustable tensioning structure of FIG. 17, and a roller axle.

FIG. 18A is an elevation view of adjustable tensioning structure 405 of FIG. 17, and a roller axle. The support structure of tensioning structure 405 is provided by bracket 425 which is unshaped, comprising a base 426 and a pair of walls 427 extending upward from base 426 on either side. Through openings 420 extend through base 426 for the purpose of fastening tensioning structure 405 to the bottom of the central frame structure of the ski apparatus.

Structure 405 utilizes an improved roller axle 413 for rotatably securing roller 407 to the structure through one of the sets of through openings 411. Through openings 412 are provided at the opposite end of bracket 425 for rotatably securing tension roller 409 utilizing a standard clevis pin fastener 421.

A plate 417 is provided for adding stability and preventing flexing of walls 427 of tensioning structure 405. Another function is to prevent the third band from interfering with the second band. Plate 417 is rectangular in shape and substantially flat, and has a plurality of through openings located near each of the corners for accommodating screw fasteners (not shown), securing plate 417 is adapted to fasten down to the upper surface of each wall 427, utilizing holes 419 which extend down into walls 427 for accommodating the screw fasteners, and once fastened, bridges the gap between the inner surfaces of each wall 427.

Tensioning structure 405 is adapted to mount to the bottom of the central base structure of ski apparatus previously described in the present application and in related patents and applications referenced herein, using standard fasteners inserted through openings 420, which extend through the thickness of base 426, and a slight modification to the existing bottom central base structure of existing ski apparatus by adding mounting holes for such fasteners, or in other embodiments, tensioning structure may be fixedly attached by welding structure 405 to the central base structure of existing ski apparatus, for example.

Figure 18B:
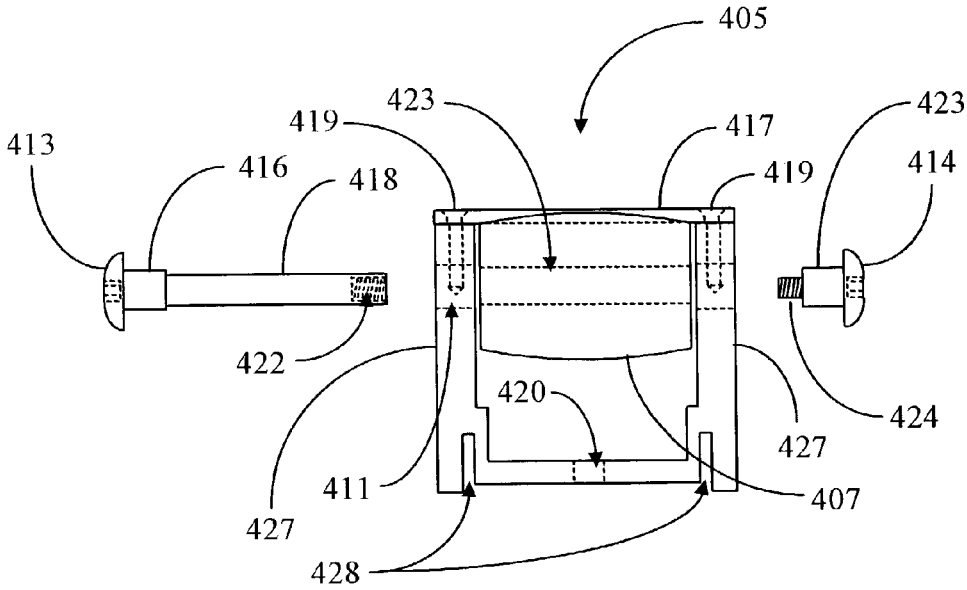
FIG. 18B is an elevation end view of the adjustable tensioning structure and roller axle of FIG. 18A and a roller axle nut.

FIG. 18B is an elevation end view of tensioning structure 405 and roller axle 413 of FIG. 18A and a roller axle nut. In this view, walls 427 are shown extending up from either end of base 426 forming the U-shape of the overall structure of the bracket, and conical roller 407 is located in its mounting position between the inner surfaces of each wall 427. Roller 407 is rotatably secured to walls 427 by inserting roller axle 413 through a first opening 411 of wall 427, completely through passage 423 extending through the center of roller 407, and is then secured with roller axle nut 414. Roller axle 413 and roller axle nut 414 each have a collar, collar 416 and 423 respectively, each of which has a diameter somewhat less than that of through openings 411 of walls 427, such that a snug fit is achieved when roller axle 413 and roller axle nut 414 are inserted into walls 427.

Roller axle 413 has an internally-threaded end portion 422 on the opposite end of roller axle 413 from collar 416, matching and externally-threaded end portion 424 of roller axle nut 414, for enabling roller axle nut 414 to be securely affixed to the threaded end of roller axle 413. Roller axle 413 is of such a length that when fully inserted through the first opening 411 in wall 427, the far edge of threaded portion 422 extends only to the edge of roller 407, stopping just short of the inner surface of the opposing wall 427 through which roller axle nut 414 is inserted, such that roller axle 413 and roller axle nut 414 may be securely tightened together when attaching roller 407 to walls 427, and still allow for free rotation of roller 407 around shaft portion 418 of roller axle 413. In some embodiments a clevis pin with an R-clip is used instead.

When securely tightened together through openings 411 of walls 427 and through roller 407 as described above, the roller axle assembly additionally becomes a stabilizing cross member adding strength to the overall structure at one end of structure 405, and adds significantly to the overall structural integrity also enhanced by cross member plate 417 at the opposite end of the structure.

Figure 1B:
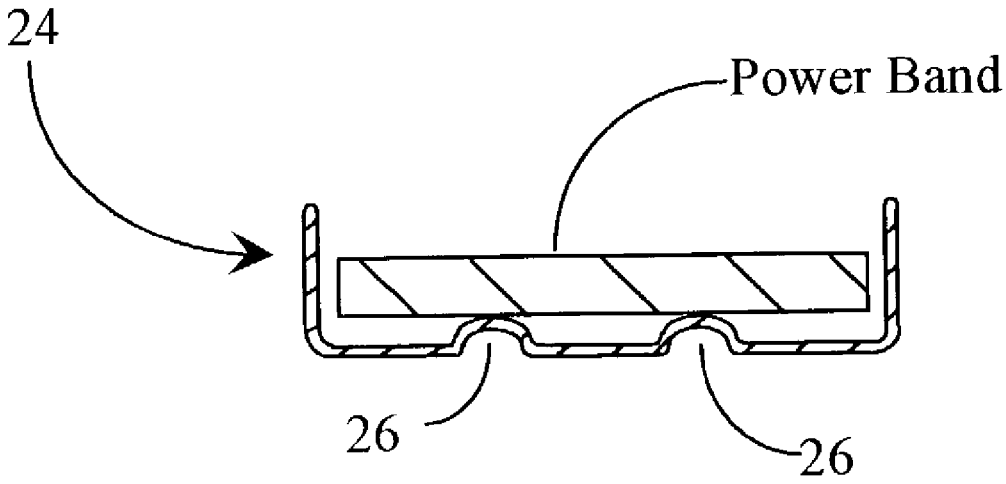
FIG. 1B is a cross section taken along line 1B—1B of FIG. 1A.

A pair of slots 428 extend up into the bottom of each wall 427 of tensioning structure 405 at each edge of base 426 and extend along the entire length of structure 405, and are adapted to fit snugly over the upwardly extending portions of power band guide 24 of ski apparatus 9, for example, of FIG. 1B and FIG. 2. Power band guides 24, as is more clearly seen in FIG. 1B, has sides on either end that extend upward from the base of the frame structure. Slots 428 of tensioning structure 405 extend up into walls 427 to a distance somewhat greater than the height of the overly extending sides of power band guide 24, thereby allowing the bottom surface of base 426 to securely rest upon the upper surface of the bottom of power band guide 24, and enabling for a more secure attachment of tensioning structure 405 to the bottom central frame structure of the ski apparatus. In alternative embodiments of the present invention, slots 428 of tensioning structure 405 may also enable the user to slide structure 405 in its aligned position along band guides 24, for example, and relocate structure 405 towards the center of the frame structure of the ski apparatus, or outward, in various predetermined attachment locations, thereby enabling still further adjustability of the location of the additional tension point provided by tensioning structure 405 in embodiments herein described.

Figure 19:
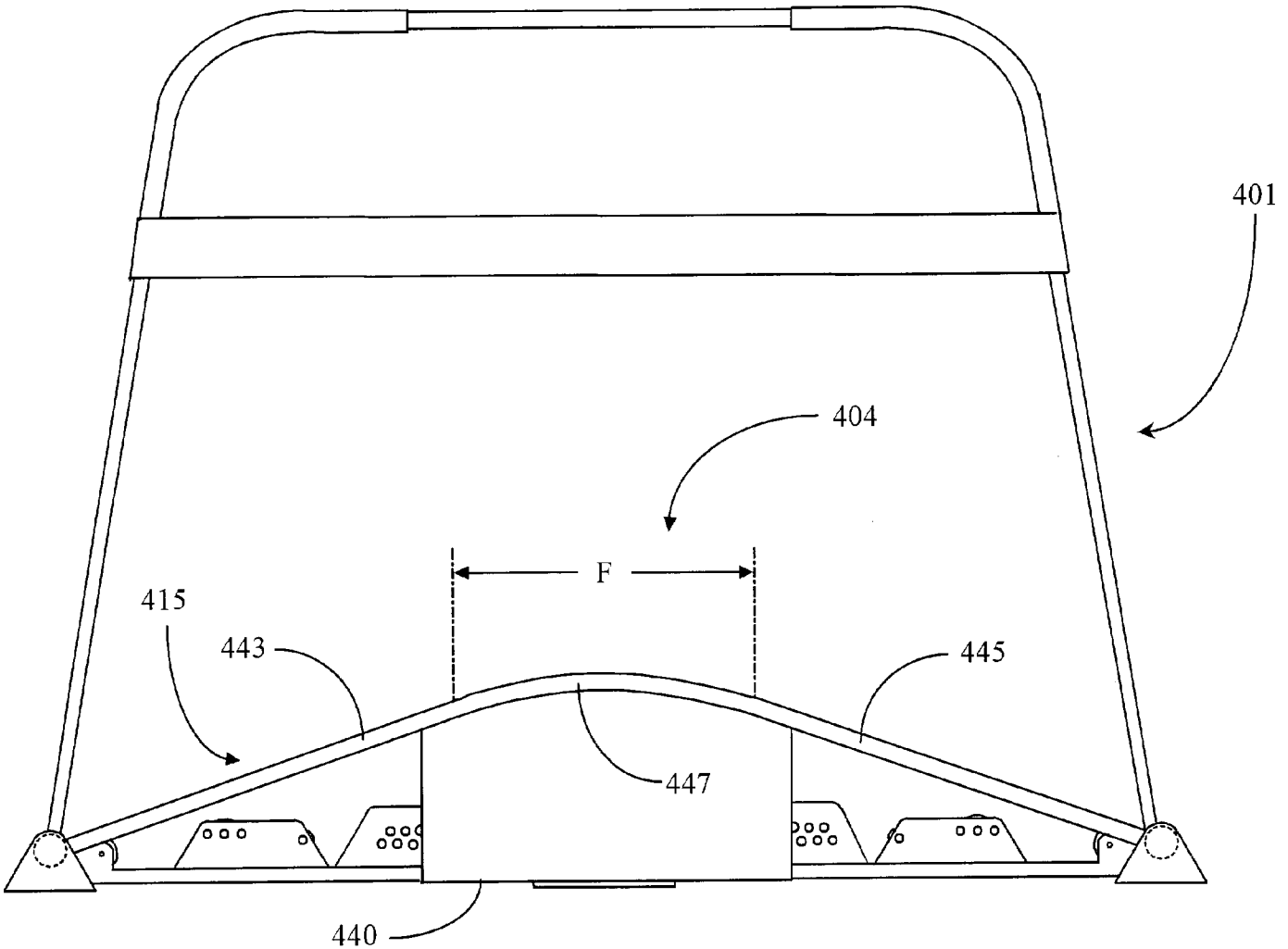
FIG. 19 is an elevation view of a frame structure of the ski-exercising device of FIG. 17.

FIG. 19 is an elevation view of the frame structure of ski-exercising apparatus 401 of FIG. 17. Frame structure 404 is provided in this embodiment having generally similar frame architecture to frame structure of ski apparatus described in the present application and in related U.S. patents and applications referenced herein except for novel differences relating to the parallel rails described below. For clarity, only the frame structure is described in this embodiment, as additional elements, such as power bands, and wheeled carriage assembly and related hardware have been adequately described herein in the preceding specification, and are removed in the present illustration.

Frame structure 404 comprises a set of semi-arcuate rails 415, only one of which is visible as this is an elevation view, which are held parallel to each other and affixed to transverse members at either end of frame structure 404, generally similar to previous embodiments, along which a wheeled carriage assembly, such as carriage assembly 33 of FIG. 4, travels during normal operation of the ski exercising apparatus, as described herein for other embodiments. Rails 415, however, have several notable differences when compared to rail sets utilized in ski apparatus of previous embodiments described thus far.

Rails 415 extend at an angle upward beginning at either end of frame structure 404, towards the center, and are held parallel to each other and affixed at either end of each rail to a pair of transverse end-members, the center portion supported by support members 440, similarly to that for previous ski apparatus embodiments. As this is an elevation view, only one of the pair of rails is seen. One notable difference between semi-arcuate rails 415 and those disclosed in the present and related patents is that rails 415 are arced in their center portions 447, as illustrated by a dimensional notation F, and the arcuate portion of rails 415 is substantially shorter than that of previous embodiments. The dimension lines associated with arcuate portion 447 mark the locations where the arced portion of each rail 415 ends at positions sharing an equal distance from a theoretical vertical center of rails 415.

The total dimension F in a preferred embodiment is substantially less than the approximately 26 inches defined by dimension (E) of frame structure 11 of FIG. 1A of the present application, for example.

Non-arcuate portions of rails 415 are witnessed by element numbers 443 and 445 on the left and right side of frame structure 404 as seen in this view. Non-arcuate rail portions 443 and 445 are substantially straight from their junctures with arcuate portion 447. The lengths (taken horizontally) for rail portions 443 and 445 are substantially longer than the approximately 15 inches respectively, of rails portions in previous embodiments, such as non-arcuate portions 19 and 21 of frame structure 11 of FIG. 1A, for example. It must be noted that the dimensions cited above are intended to be approximate only, and may vary somewhat in alternative embodiments. The approximate overall length of frame structure 404 is about 61 inches, similar in length to frame structure 11 of FIG. 1A.

Another notable difference between rails 415 and those of previous embodiments, such as those of frame structure 11 of FIG. 1A, is that non-arcuate portions 443 and 445 of rails 415 each extend upward from the transverse members at the outward ends of frame structure 404, at a steeper angle towards the center compared to previously described embodiments, and the arcuate portion, which is substantially shorter than those of previous embodiments, has a maximum height at the center which is measured substantially higher, approximately three inches in this example, than the maximum arcuate portion height of rails 19 of FIG. 1A, for instance.

The steeper angle and longer length of non-arcuate portions 443 and 445 of rails 415, and the shorter length and increased height of arcuate portion 447 provides for a faster descent of a wheeled carriage assembly traveling from side-to-side along rails 415, thereby enabling a stronger more abrupt stop at the end of each lateral stroke, particularly when an optional third power band, as shown for ski exercise apparatus 401 of FIG. 17, is utilized. The inventor has discovered that operating a ski exercise machine utilizing rails having such an increased angle and height more closely simulates the increased lateral dynamic forces actually encountered during extreme downhill skiing, and other sports requiring explosive power in lateral movements, and therefore provides exercise for a participant in such activity, having maximum benefit to the user of such an exercise machine.

Such specific high-intensity training for the enhancement of explosive power is often termed plyometric training in the art, and it is to exercise apparatus improvements in this field of exercising that many of the embodiments described presently and subsequently in the specification are related. The plyometric training method utilizing exercise apparatus elements in embodiments of the present invention is to be used in conjunction with other power development methods in a complete training program to improve the relationship between maximum strength and explosive power. Emphasis in such a training method is placed on generating the highest possible force in the shortest period of time, and reducing or stopping this force at the end of the action. Plyometric training has a primary role in training as well as rehabilitation programs, and, as will be further detail below, apparatus and methods of the present invention provide improvements to the current art relating to exercise apparatus and other hardware providing such training capability.

It is known in the art that plyometric training may be applied in various exercises which specifically target certain areas of the body for muscle strengthening or rehabilitation. The specific areas of the body often include those other than areas of the legs or hips, for example. In these cases it is desirable to be able to quickly and easily interchange exercise attachments utilizing a single exercise apparatus, and be able to utilize a single exercise apparatus, such as that described herein having a tensioned lateral movement primarily designed for ski exercising, for providing such varied exercises targeting different specific areas of the body.

Figure 20A:
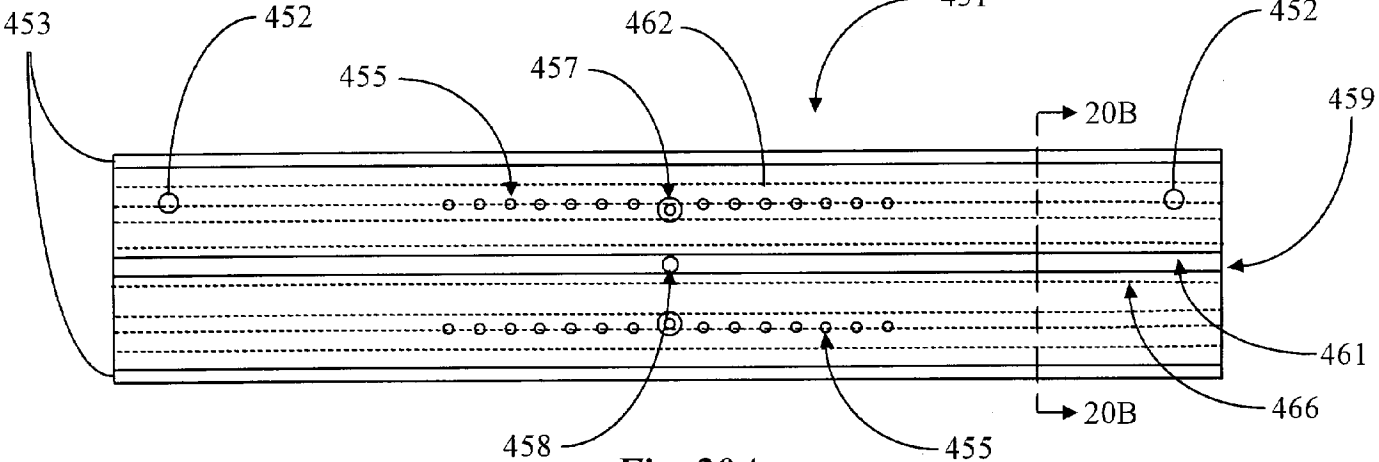
FIG. 20A is a top view of an adjustable mounting plate according to an embodiment of the present invention.

FIG. 20A is a plan view of an adjustable slide plate according to an embodiment of the present invention. Slide plate 451 is provided for enabling the user to quickly and easily interchange exercise attachments utilizing a ski exercise apparatus and wheeled carriage assembly of the present invention. Slide plate 451 is adapted for mounting to a wheeled carriage assembly, such as carriage assembly 33 of FIG. 4, and allowing exercise attachments to be adjustably mounted to plate 451, easily repositioned at different locations along slide plate 451, and quickly remove for interchanging with other additional exercise attachments, and further is provided with additional safety features not disclosed in previous embodiments, such as plate assembly 189 of FIG. 12.

Slide plate 451 is preferably manufactured of strong, lightweight aluminum material, or other suitable material having similar properties providing the best combination of strength, rigidity, and light weight, and has an elongated, rectangular shape having a length substantially greater than the width, the length being such that a pair of footpad assemblies may be mounted at the desired width stance in accordance with that used typically for downhill skiing, for example or for other sports and exercise motions, as will be further detail below in other embodiments of the present invention.

Slide plate 451 is adapted for mounting to the upper surface of a wheeled carriage assembly, such as carriage assembly 33 of FIG. 4, in a location centered on the carriage assembly. A pair of through openings 457 are provided in the center of plate 451 for slide plate 451 to the upper platform of the wheeled carriage, and are spaced apart from each other at a distance equal to the spacing between the pair of mounting holes for carriage 33 of FIG. 2, fastened by the pair of nuts 53.

Slide plate 451 in the present embodiment described, however, improves significantly over upper mounting platform 89 of carriage 33 of FIG. 2, for example, in that slide plate 451 allows a pair of footpad assemblies, or other exercise attachments, to be independently and adjustably mounted to the carriage assembly such that various width stance positions can be utilized, and each independently mounted attachment assembly may be quickly repositioned along plate 451 and then re-secured in the new position.

Slide plate 451 has a center through opening 458 for allowing access to the center fastener used as previously described for mounting the power band roller bracket 61 to the underside of carriage 33 as shown for FIG. 4. A plurality of holes 455 extending partially down into the upper surface of plate 451, are arranged linearly along the length and on either side of the center of plate 451, and each hole 455 is equally spaced from an adjacent hole 455 on either the left or right side of through holes 457. Holes 455 represent the locations for a wide choice of width stance positions for mounting a pair of footpad assemblies, as will be described further below in enabling detail.

Slide plate 451, has on each side extending along the length, a rounded edge 453, the rounded portion extending somewhat upward from the upper flat surface of slide plate 451. The rounded shape of edges 453 is better illustrated in FIG. 20B. Edges 453 provide a guide rail on each longest side of plate 451, and have the purpose of locating and guiding an attachment plate for mounting a footpad assembly, or other exercise attachment assembly, as will be shown in further embodiments presented below.

Plate 451 also has a push-pin safety button 452 located near each end, provided as an additional safety feature in the embodiment presented. Safety buttons 452, are standard spring-tensioned push-pins which, in their normal relaxed position, extend upwardly from the surface of plate 451 by the spring tension. Safety buttons 452 may be manually depressed into a cavity which extends down into the surface, such that the upper surface of the pin portion of safety pin 452 is at least flush with the surface of plate 451. The safety function of these pins is to retain any carriage unit engaged to the slide plate from moving off the ends of the plate after assembly, unless the pin is intentionally depressed. This function is described and illustrated additionally in description below.

Plate 451 has a groove channel 459 extending along the entire length of plate 451 in a center location. Channel 459 comprises a slot opening 461 which opens into an internal passage 466 (hidden view) beneath the surface of plate 451. The internal space formed by passage 466 is substantially wider than slot opening 461, and has the purpose of allowing a special nut fastener, fastened to a standard bolt fastener, to slide freely within passage 466 along the entire length of plate 451, enabling adjustability in mounting positions for attaching a sliding attachment plate.

Figure 20B:
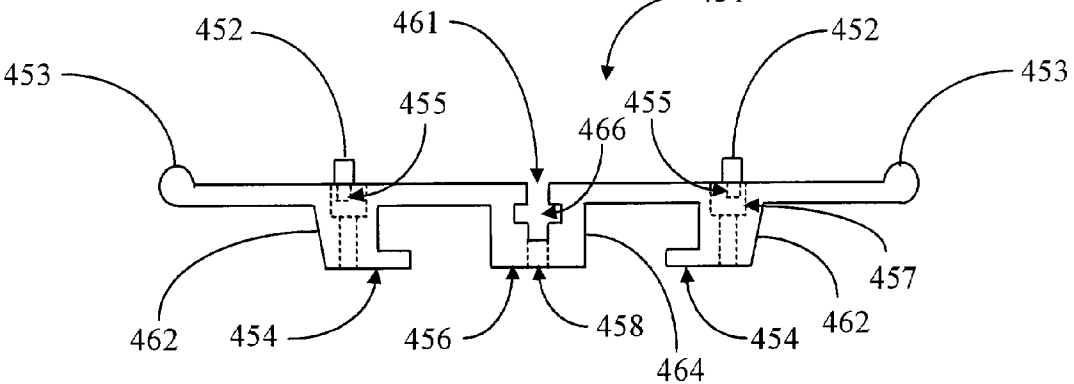
FIG. 20B is a section view of the mounting plate of FIG. 20A taken along section line 20B—20B.

FIG. 20B is a section view of plate 451 of FIG. 20A taken along section line 20B—20B. The inventor provides FIG. 20B to better illustrate several of the elements described above for FIG. 20A, as well as additional elements not shown in FIG. 20A. Plate 451 has a rectangular central structure 464, which protrudes down from the bottom surface of plate 451, and extends along the entire length of plate 451. Structure 464 encompasses internal passage 466, and additionally provides added strength and rigidity to the overall structure of plate 451. Plate 451 also has a pair of L-shaped side structures 462 extending down from the bottom of plate 451 to a distance equal to that of structure 464, and located approximately midway between edges 453 and central structure 464, on either side of structure 464. Structures 462 also extend the entire length of plate 451, adding still further to the overall structural rigidity of plate 451, and accommodate push-pin safety buttons 452.

Structures 462 each have a substantially flat and level bottom surface 454, and central structure 464 has a bottom flat surface 456, which is flush with bottom surfaces 454 of structures 462. Bottom surfaces 456 and 454 form the base surface which contacts the upper surface of a wheeled carriage assembly to which plate 451 is mounted according to an embodiment of the present invention, detailed further below. Through openings 457 are shown extending completely through side structures 462 and width stance adjustment holes 455 are shown extending partially down into plate 451 from the surface. Through opening 458 is shown extending down from the bottom of passage 466, providing an opening through flat bottom surface 456 of structure 464.

The rounded shape of guide rail edges 453 on each side of plate 451, and the substantially flat upper surface are readily apparent in this view. Safety buttons 452 are shown in their relaxed positions, extending upwardly from the surface of plate 451. As described above, safety buttons 452 may be manually depressed down into cavities (not shown) within structures 462 adapted for the purpose.

Slot opening 461 is shown extending down into the surface of plate 451, opening into internal passage 466, the internal rectangular space formed by passage 466 having a width substantially greater than that of slot opening 461.

Figure 21A:
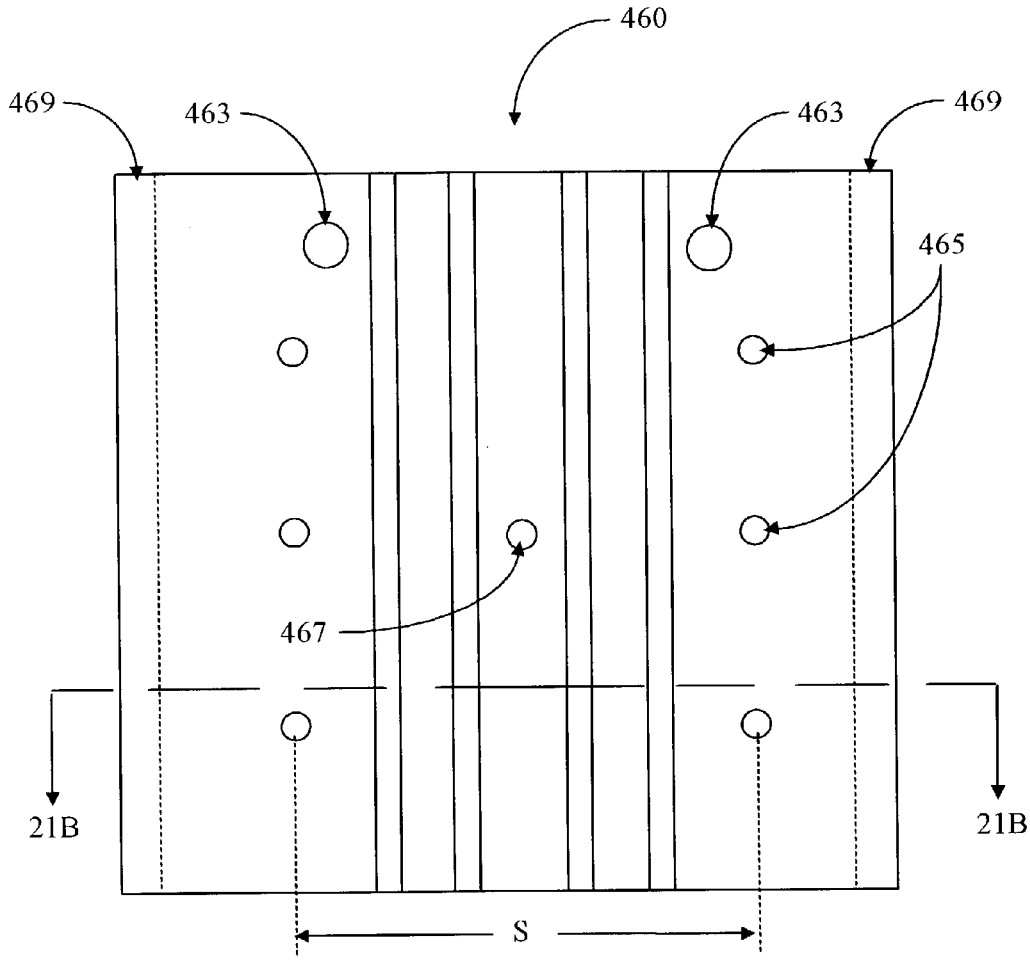
FIG. 21A is a top view of a sliding attachment plate according to an embodiment of the present invention.

FIG. 21A is a top view of a sliding attachment plate according to an embodiment of the present invention. Attachment plate 460 is provided in a preferred embodiment of the present invention as an interface for adjustably mounting various independent exercise attachments, such as a suspended footpad assembly as described above, to the wheeled carriage assembly of a ski exercise apparatus. Attachment plate 460 is provided to enable the user to quickly and easily attach, reposition or remove such exercise attachments to plate 451, which attaches to a wheeled carriage assembly.

Plate 460 is manufactured similarly to slide plate 451, utilizing strong, lightweight material such as aluminum, or some other material having similar properties. Plate 460 is substantially rectangular in shape, substantially flat, and has a pair of edge channels 469, one on each side of plate 460, extending along the entire length of plate 460. Edge channels 469 are rounded on the outside surface, extending somewhat down from the bottom surface of plate 460, and are adapted to closely fit over the rounded edges 453 of slide plate 451. Each edge channel 469 has a rounded inner surface, whose dimensions closely equal the outer dimensions of edges 453 of plate 451.

Attachment plate 460 is adapted for sliding over an end of slide plate 451, and, guided by rounded edge channels 469 encompassing rounded edges 453 of plate 451, is enabled to freely slide back and forth along the length of plate 451. Plate 460 has a plurality of mounting holes 465, arranged on either side from the center of plate 460, which are provided for attaching such as an independent suspended footpad assembly, or some other attachment, to upper surface of plate 460 utilizing standard bolt or screw fasteners. Mounting holes 465 are spaced apart on either side of the center of plate 460, at a distance defined by dimension (S).

Plate 467 is also provided with through opening 467 located in the center, and passing completely through the thickness of plate 460. Through opening 467 has the purpose of enabling insertion of a bolt fastener through plate 460, for attaching plate 462 slide plate 451, utilizing a special nut, as will be detailed further below.

A pair of pull-pins 463 are provided for the embodiment shown, one pull-pin 463 located on either side of the center of plate 460, near one end. Pull-pins 463 are standard, spring-tensioned devices which are provided for locating attachment plate 460 in the exact desired position on slide plate 451, according to the various positions of width stance adjustment holes 455 of plate 451. Pull-pins 463, each have a pin portion (not shown) which extends below the bottom surface of plate 460, adapted to fit securely into locator holes 455 of plate 451. Spring tensioning of each pull-pin 463 urges the pin portion into the extended position, and by manually raising pull-pins 463 from above, the pin portions may be retracted up into the body of attachment plate 460.

Figure 21B:
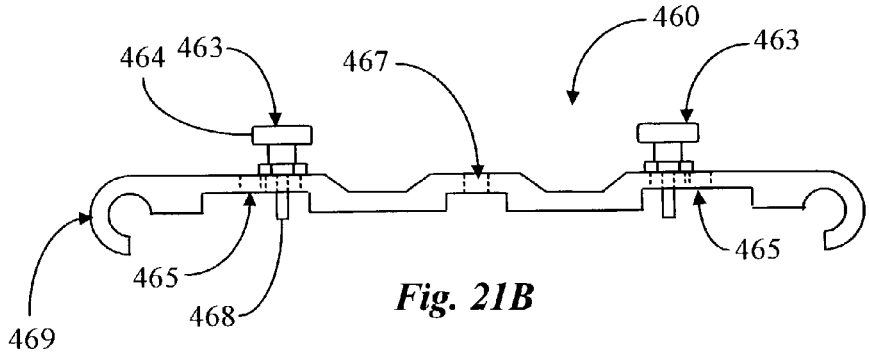
FIG. 21B is a section view of the sliding attachment plate of FIG. 21A taken along section line 21B—21B.

FIG. 21B is a section view of attachment plate 460 of FIG. 21A taken along section line 21B—21B. In this view, the rounded out and inner surfaces of edge channels 469 are clearly visible, the inner rounded surface of each edge substantially equaling the dimensions of the outer rounded surface of edges 453 of plate 451. Through opening 467 is shown passing completely through the thickness of plate 460, and mounting holes 465 are shown extending through plate 460. Mounting holes 465 in this embodiment are threaded holes for which standard bolt fasteners may be threaded for attaching such as an independent footpad assembly. In alternative embodiments however, mounting holes 465 may or may not be threaded, depending on whether or not only a threaded bolt, or bolt and nut combination is utilized for mounting the attachment to attachment plate 460.

Pull-pins 463, located on either side of the center through opening 467, are clearly shown in this view mounted to the upper surface of plate 460, each pull-pin 463 having a pin portion 468 which, in the relaxed position, are urged downward by spring tensioning, extending to a distance somewhat below the bottom surface of plate 460. Pull-pins 463 are provided with handle grasps 464 enabling the user to easily grasp the pull-pins and raise the mechanism such that the bottom of each pin portion 468 may be elevated above the bottom surface of plate 460.

A clearance channel is designed into plate 460, located directly below each row of width stance adjustment holes 465, providing clearance for the lower end of a bolt fastener, and possibly a nut fastener if so incorporated, when an attachment such as a footpad assembly is secured to the upper surface of plate 460. In such a manner, plate 460, with pull-pins 463 raised, may freely slide along the length of slide plate 451 of FIG. 20A,B while the footpad assembly is secured to plate 460.

Figure 22:
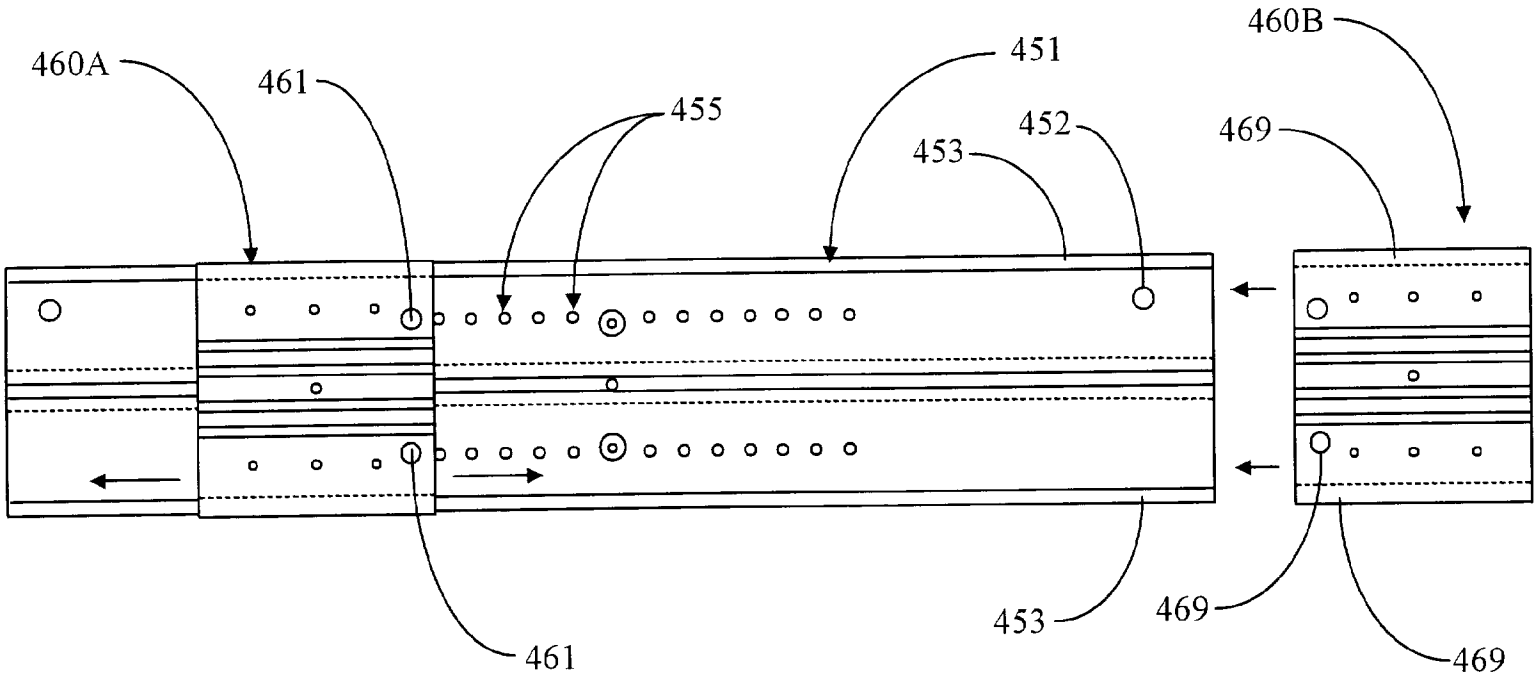
FIG. 22 is a top view of the mounting plate of FIG. 20A and a pair of sliding attachment plates of FIG. 21A according to an embodiment of the present invention.

FIG. 22 is a top view of slide plate 451 of FIG. 20A and a pair of sliding attachment plates 460A and B of FIG. 21A according to an embodiment of the present invention. The manner in which attachment plates 460A and B are adjustably mounted to slide plate 451 is illustrated in this view. For the purpose of clarity, attachment plates 460A and B are shown not to have an exercise attachment, such as a suspended footpad assembly affixed thereto.

As mentioned above, plates 460A and B are adapted to slide over the ends of slide plate 451, guided by rounded edges 453 of plate 451 which are encompassed by the rounded edge channels of each plate 460. In attaching attachment plate 460A to slide plate 451, first the user manually raises both pull-pins 463 at the same time, allowing plate 460A to slide over the end of plate 451. Next, the user releases pull-pins 463 into the relaxed, extended position, and then depresses push-pin safety button 452, such that clearance is provided for sliding attachment plate 460A further onto plate 451 towards the center. Although pull-pins 463 of attachment plate 460A are naturally extended due to the spring tensioning, plate 460A still freely slides along plate 451 until the lower pin portions of pull-pins 463 encounter one set of width stance adjustment holes 455.

Attachment plate 460B is shown in this view after sliding it over the left end of plate 451, located in a desired stance position, in this case, the sixth position to the left of center. Once attachment plate 460B slides over the end of plate 451 towards the center, the user may hold pull-pins 463 in the raised position while sliding plate 460B, until pull-pins 463 align directly above the desired set of adjustment holes 455, at which time the user releases pull-pins 463, which urges the lower pin portion of the pull-pins down into adjustment holes 455. Repositioning attachment plate 460 simply involves manually raising pull-pins 463, sliding plate 462 new desired position, aligning pull-pins 463 with the new set of adjustment holes 455 at the new location, and then releasing pull-pins 463, thereby locking plate 460 into the new position.

Figure 23:
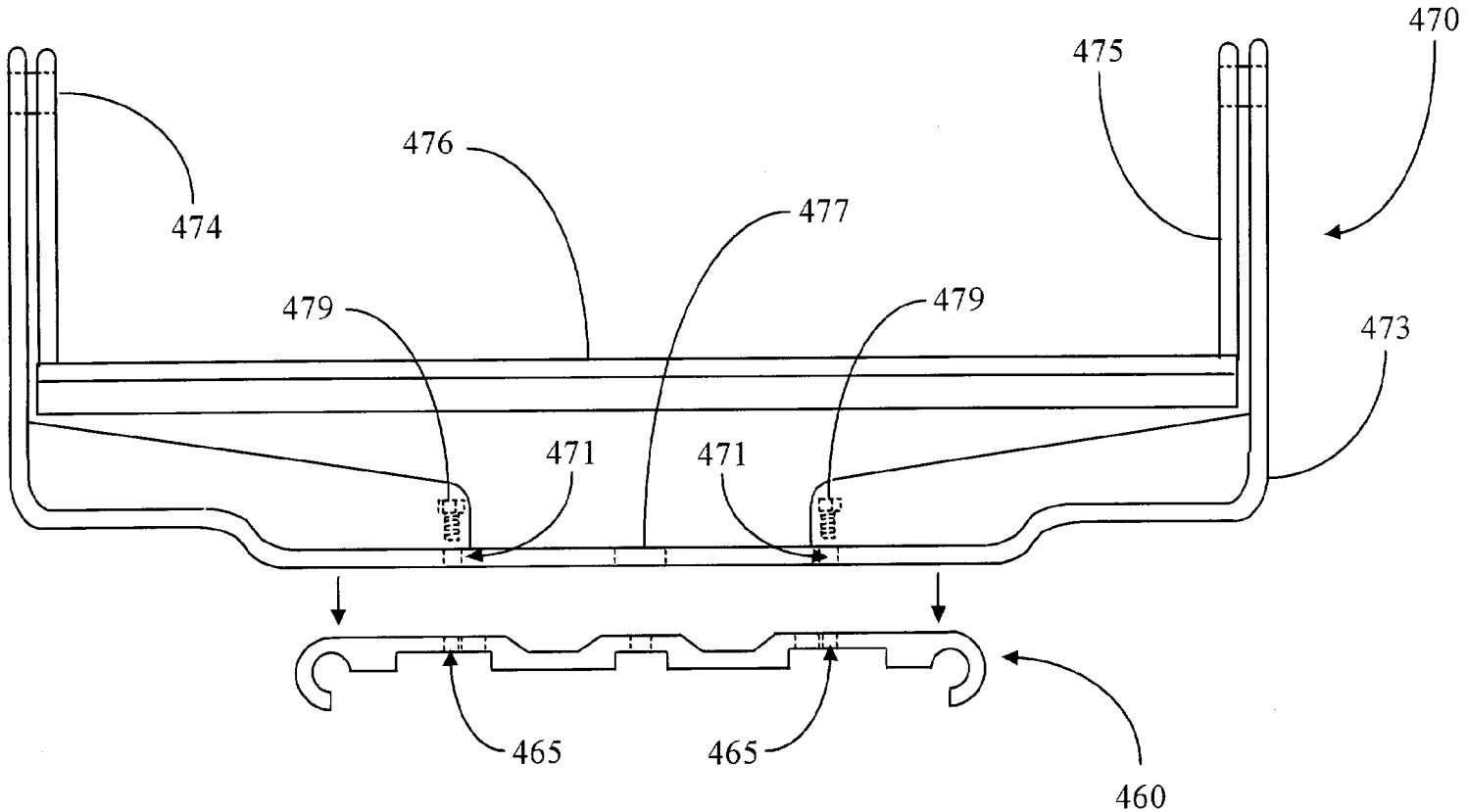
FIG. 23 is an elevation view of a suspended footpad assembly and the sliding attachment plate of FIG. 21A.

FIG. 23 is an elevation view of a suspended footpad assembly 470 and a sliding attachment plate 460 of FIG. 21A. Suspended footpad assembly 470 is similar to suspended footpad assemblies previously described herein, such as footpad 79 of FIG. 12, and in related U.S. patents and applications, comprising a footpad support structure 473, a pivoting footpad 476 which has support wings 475 extending upward from footpad 476 on either side, suspended within support structure 473 by a pair of pivot points 474 a set of four through holes 471 (only two of which are shown in this elevation view) pass through the base of support structure 473, and are aligned with a set of four mounting holes 465 of attachment plate 460. Footpad assembly 470 is lowered down onto the upper surface of attachment plate 460, holes 471 of support structure 473 aligned with holes 465 of plate 460, and footpad assembly 470 is then affixed to plate 460 utilizing standard screw fasteners 479.

Although a suspended footpad assembly is shown in the illustration for attaching to attachment plate 460, a variety of attachments other than a suspended footpad assembly as shown, such as are described further in detail, may be attached to attachment plate 460, according to alternative embodiments of the present invention, thereby providing the user the ability to perform exercises on a ski apparatus such as has been described, in training for sports other than downhill skiing, and for strengthening and rehabilitation exercises as well, without departing from the scope and spirit of the present invention.

Figure 24:
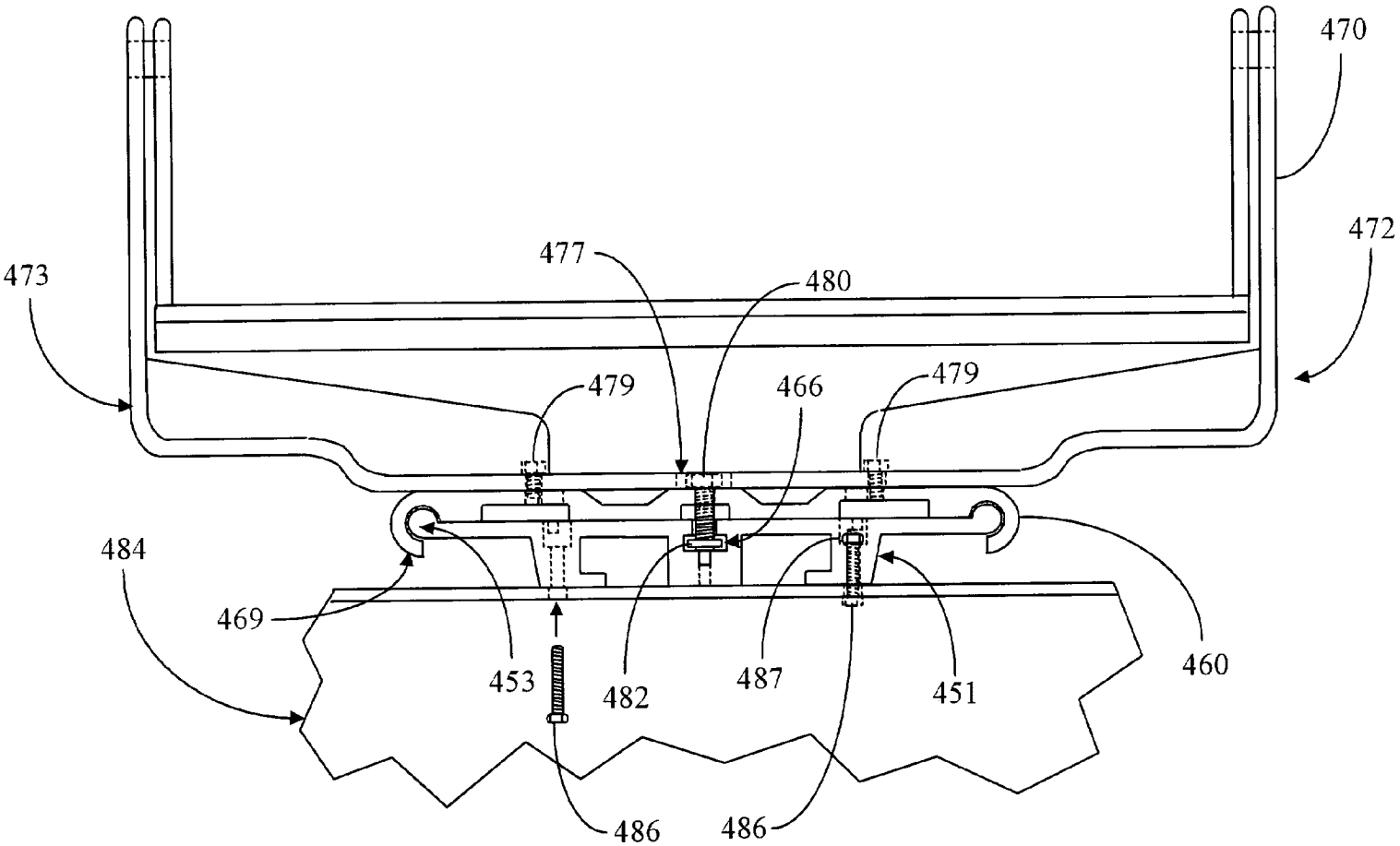
FIG. 24 is an elevation view of the footpad assembly and attachment plate of FIG. 23 and the mounting plate of FIG. 20A attached to a carriage assembly according to an embodiment of the present invention.

FIG. 24 is an elevation view of footpad assembly 470 and attachment plate 460 of FIG. 23 and slide plate 451 of FIG. 20A attached to a wheeled carriage assembly according to an embodiment of the present invention. For simplicity, not all of the elements previously described are shown in this view, only those elements pertinent to the present description.

As shown in the illustration, slide plate 451 is attached to carriage assembly 484 utilizing bolt fasteners 486, which are inserted up through openings in the upper surface of carriage assembly 484, and are then secured by nut fasteners 487. The manner in which slide plate 451 attaches to carriage 484 is not limiting, however, in describing embodiments of the present invention. For example, bolt fasteners 486 may be inserted down through the provided openings of slide plate 451, and secured with a nut fastener from below the upper surface of carriage assembly 484, or alternatively a type of fastener other than bolt fasteners 486 and nut fasteners 487 may be utilized in various embodiments. What is important, however, is that whichever type of fastener is used, the nut fastener or head of a bolt fastener must not project substantially above the upper surface of slide plate 451, so as not to interfere with the sliding of attachment plate 460.

Suspended footpad assembly 470 is affixed to attachment plate 460 utilizing screw fasteners 479, thereby forming a footpad/plate assembly 472. Assembly 472 is adjustably mounted to plate 451 according to an embodiment of the present invention, with edge channels 469 of attachment plate 460 neatly encompassing the rounded outer edges 453 of plate 451, guiding attachment plate 460 as it slides along the length of plate 451. Once assembly 472 is positioned on slide plate 451 at the desired width stance location according to location adjustment holes 455 of plate 451, pull-pins 463 (not shown) are released, urging the lower pin portions into the adjustment holes 455 of plate 451, thereby locking assembly 472 into the desired position on plate 451.

Assembly 472 is fixedly attached to slide plate 451 utilizing bolt fastener 480, which is inserted down through center hole 467 of attachment plate 460, before assembly 472 is mounted to plate 451. In practice of mounting footpad/plate assembly 472 to plate 451, suspended footpad assembly 470 is pre-attached to attachment plate 460 utilizing screw fasteners 479, as described above. Bolt fastener 480 is then inserted down through center opening 477 of the base of footpad support structure 473, through center opening 467 of attachment plate 460, and a special nut fastener 482 is then partially threaded onto the threaded portion of bolt fastener 480. Footpad/plate assembly 472, with bolt fastener 480 extending below the bottom surface of attachment plate 460, then slides onto the end of slide plate 451, as described above, such that the threaded portion of bolt fastener 480 passes along in between slot opening 461 of plate 451, and the attached nut fastener 482 slides along the rectangular passage 466 within the center structure 464 of plate 451. Once assembly 472 has been positioned as desired, and pull-pins 463 have released down into the proper set of adjustment holes 455 of plate 451, locking assembly 472 into position on plate 451, bolt fastener 480 may then be tightened from above the base of support structure 473 of suspended footpad assembly 470, thereby securing assembly 472 to plate 451. Nut fastener 482, in the embodiment shown, is square in shape and substantially flat, and is prevented from rotating within passage 466 while bolt fastener 480 is tightened, due to the width dimensions of nut fastener 482 being just somewhat less than the width of passage 466.

Figure 25A:
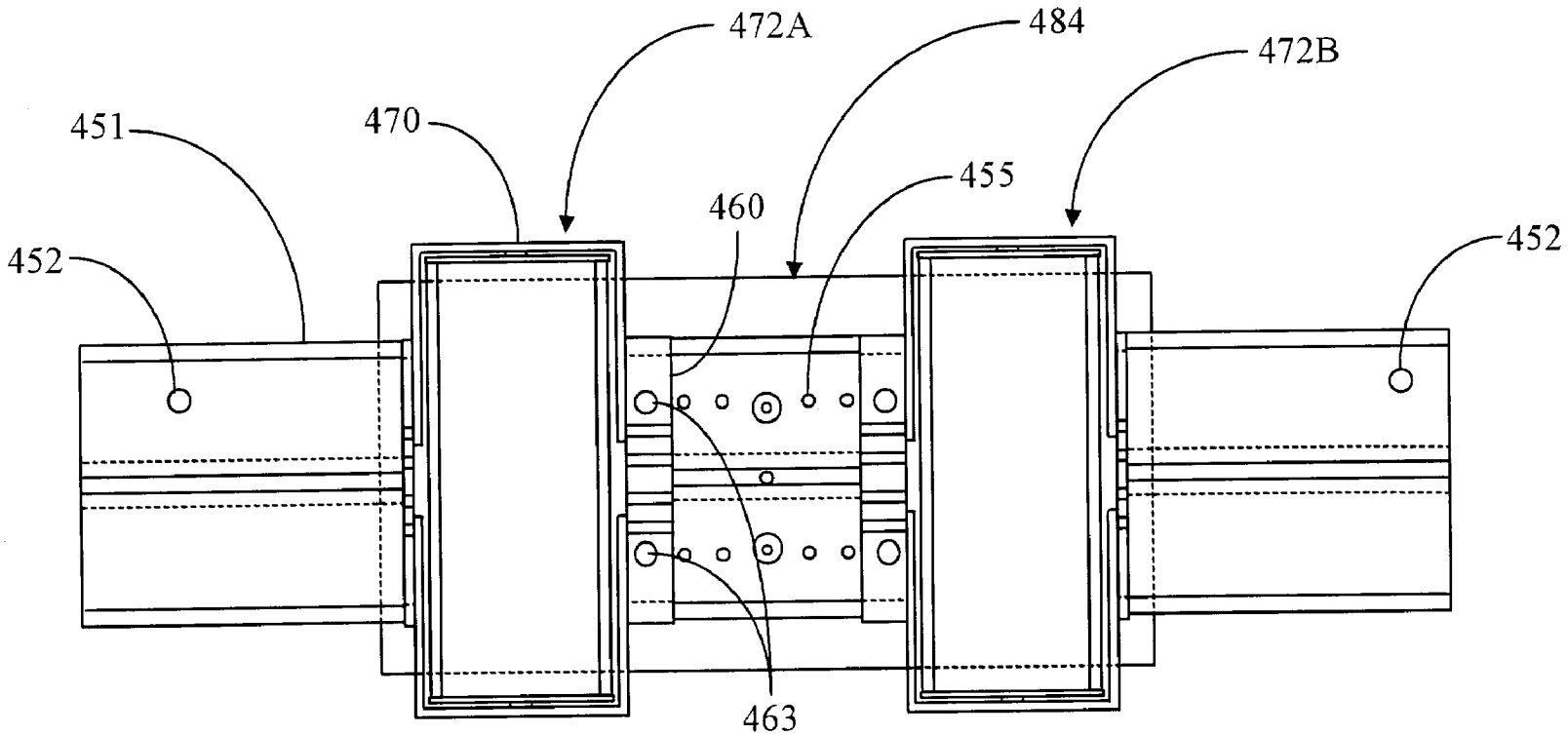
FIG. 25A is a top view of the mounting plate and attachment plates of FIG. 22, a pair of suspended footpad assemblies of FIG. 24 and a carriage assembly according to an embodiment of the present invention.

FIG. 25A is a top view of slide plate 451 and attachment plate 460 to of FIG. 22, a pair of suspended footpad assemblies of FIG. 24 attached to a wheeled carriage assembly according to an embodiment of the present invention. In this view a pair of independent footpad/plate assemblies 472, each comprising a suspended footpad assembly 470 attached to attachment plate 460, are mounted to plate 451, each assembly 472 located at the desired width stance position by aligning pull-pins 463 over the desired set of adjustment holes 455 of plate 451. In the example shown, each assembly 472 is first slid over each end of plate 451 after manually depressing each push-pin safety button 452, and is then slid towards a center of plate 451 and located at the third position outward from the center of slide plate 451. Once pull-pins 463 are centered over the desired set of adjustment holes 455, pull-pins 463 are released, thereby urging the lower pin portions down into their respective adjustment holes 455, securing each footpad assembly in its location. Each assembly 472 is then secured to plate 451 using the bolt fastener 480 and nut fastener 482, combination (not shown) as described above for FIG. 24.

Slide plate 451 is shown in this view mounted to the upper surface of wheeled carriage assembly 484 as described for FIG. 24, utilizing bolt fasteners 486 and nut fasteners 482 (not shown). In a preferred embodiment of the present invention, width stance adjustment holes 455 of plate 451, which correspond to the various different width stance locations, are sequentially numbered, or otherwise similarly marked, outward from the center on the upper surface of plate 451, such that the width stance position of the pair of footpad/plate assemblies may always be centered on plate 451, regardless of the width stance chosen. For example, in the illustration given, footpad/plate assembly 472A his located at the third width stance position to the left from the center position of plate 451, and assembly 472B is located at the third position to the right of the center position of plate 451. For proper centering and balance each assembly 472 is located at the same numbered or marked position outward from the center. For instance, for a wider width stance position, assembly 472A may be positioned at the sixth set of adjustment holes 455 to the left of the center of plate 451, as shown in FIG. 22, and assembly 472B would then be located at the six set of adjustment holes 455 to the right of the center of plate 451. The distance from the first footpad assembly from the center of plate 451 should always be equal to the distance between the second footpad assembly from the center of plate 451, for proper centering and balance.

If, for any reason, attachment bolt fastener 480 securing assemblies 472 to plate 451 loosens inadvertently, or the pull-pins somehow dislodge, during operation, push-pin safety buttons 452, always protruding upward from the upper surface of plate 451 in their normally relaxed position, will stop assemblies 472 from sliding of the end of plate 451, thereby providing an additional safety feature for the user if such an instance occurs.

Figure 25B:
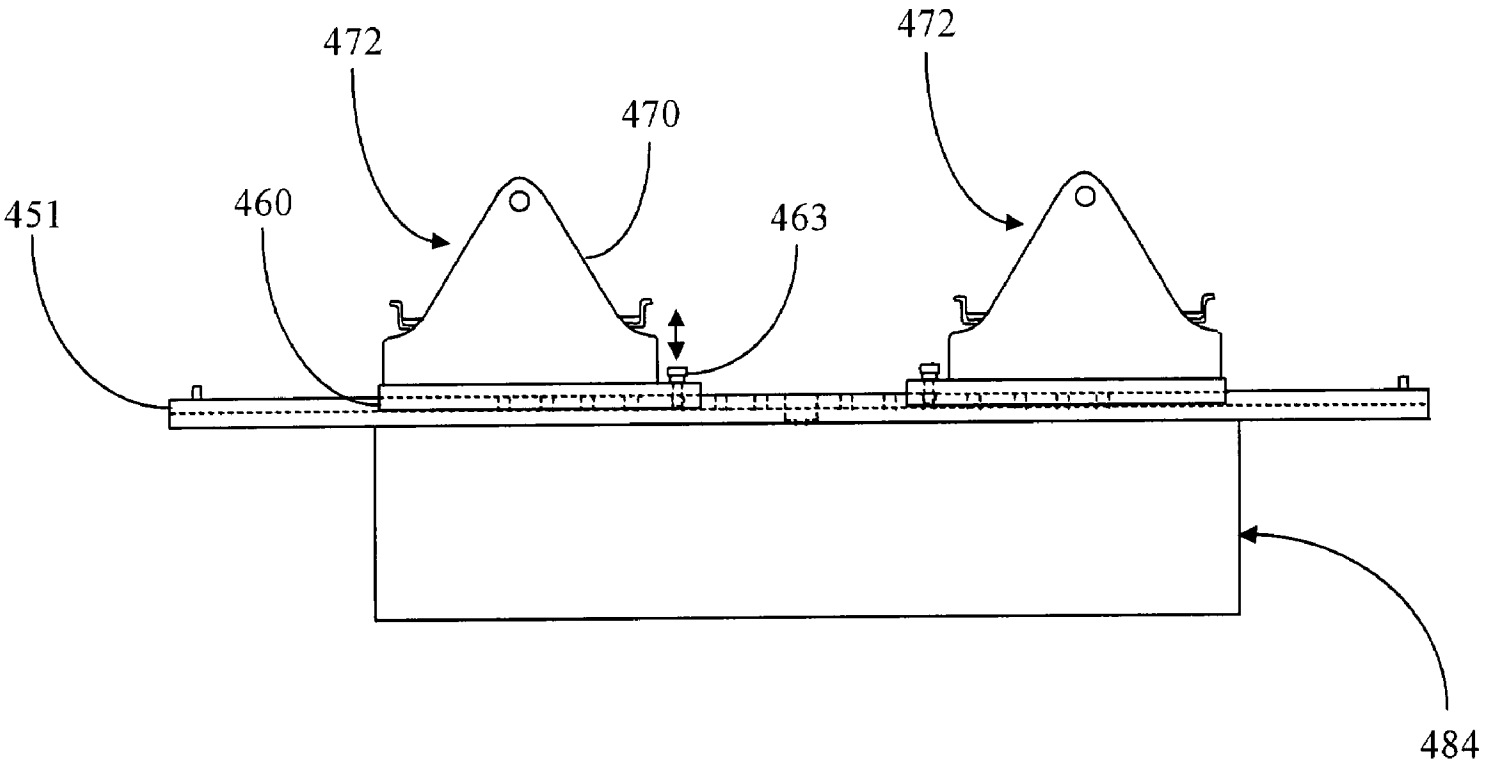
FIG. 25B is an elevation view of the mounting plate, attachment plates, suspended footpad assemblies and carriage assembly of FIG. 25A.

FIG. 25B is an elevation view of slide plate 451, attachment plates 460, suspended footpad assemblies 470 and wheeled carriage assembly 484 of FIG. 25A. Again, for simplicity, many elements previously described herein are not shown in this view, such as fasteners, elements of carriage assembly 484, and so on. Only elements pertinent to the present description are illustrated and described here. Both footpad/plate assemblies 472, each comprising a suspended footpad assembly 470 attach to an attachment plate 460 per shown mounted to plate 451 according to an embodiment of the present invention, each assembly 472 located at the third position outward from the center of plate 451. Pull-pins 463 of plates 460 are shown in the relaxed extended position, the lower pin portions of each extending down into the respective adjustment holes 455 of plate 451. Assemblies 472 may be easily and quickly repositioned inward or outward along the length of plate 451 simply by loosening bolt fastener 480 (not shown) which fixedly attaches each assembly 472 to plate 451, raising pull-pins 463 such that the lower pin portions are elevated above adjustment holes 455 of plate 451, and sliding assemblies 472 along plate 451 to the new positions, with pull-pins 463 and the desired set of adjustment holes 455 aligned with each other at the new positions, at which time pull-pins 463 will naturally extend down into the new adjustment holes 455 as described above.

Push-pin safety buttons 452 are shown at each far end of plate 451, in their relaxed extended positions, which prevent assemblies 472 from sliding of the ends of 451. Safety buttons 452 may be depressed to allow assemblies 472 to slide of the end allowing the user to quickly and easily interchange various sliding attachment assemblies formed by attachment plate 460 and a suspended footpad assembly, such as assembly 470, or other attachments for different exercises, as described previously.

As described above for previous embodiments illustrated, attachment plate 460 is adapted for mounting footpad assemblies for ski exercises, as shown in previous illustrations, and may also be used for fixing other exercising attachment elements for providing a variety of different exercises possibilities to the user utilizing a ski apparatus as described herein and in related U.S. patent and applications referenced herein.

Upper Body Conditioning

The inventor of the present invention has discovered that the ski apparatus embodied in the present application and related patents and applications, may be effectively used for allowing advanced upper body conditioning (UBC) and core muscle and body strengthening exercises. The ski apparatus of the present invention, when used with special exercise attachments as are subsequently described, provides what is known in the art as neuromuscular training. It is for this area of exercising that the following new and novel attachments, used with the ski apparatus of the present invention as described herein, are provided. Such attachments, as will be described below in enabling detail, allow the exercise therapist or trainer to accomplish a number of exercises including shoulder strengthening and stabilization, as well as alternate core muscle conditioning, while allowing the therapist/trainer to spot control upper body movements.

Figure 26A:
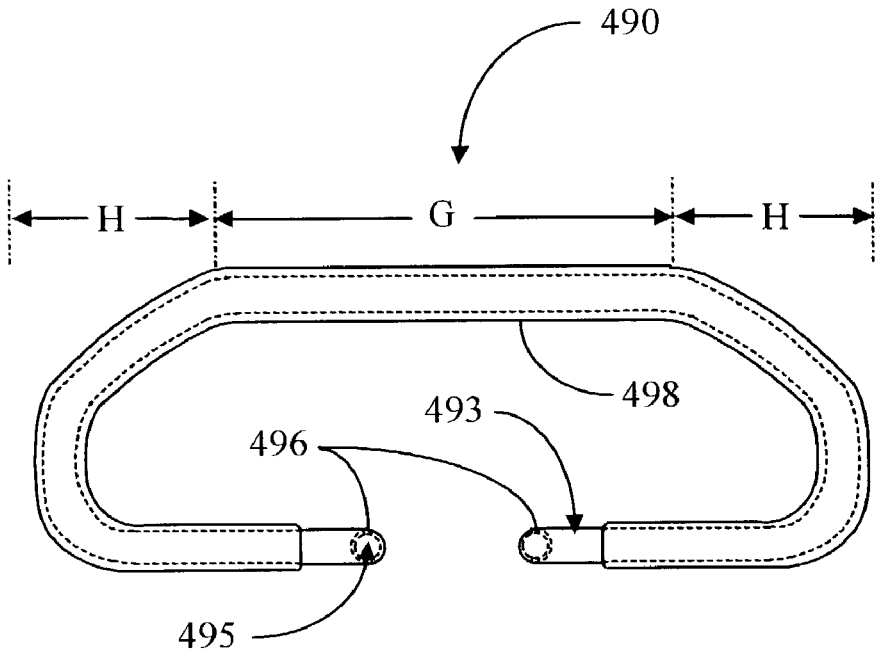
FIG. 26A is an elevation view of an upper body conditioner (UBC) elevated grip according to an embodiment of the present invention.

FIG. 26A is an elevation view of an upper body conditioner (UBC) elevated grip according to an embodiment of the present invention. UBC elevated grip 490 is provided as one part of a dual-handle attachment system allowing such exercises and strengthening/rehabilitation as described above, which can be adjusted quickly into several different width settings for providing different exercises specific to different areas of the body.

UBC grip 490 in aid for embodiment comprises a hollow, lightweight tubular metal structure formed by tubing 493, having a grip covering 498 formed of rubberized foam material or similar material providing a comfortable but secure grip to the user. UBC grip 490 as a straight portion on the upper end defined by dimension (G), which forms an upper grip portion which allows the user to grasp the attachment directly from above. Angled portions, defined by dimensions (H), extend downward from the ends of the upper grip portion G, which provide the user with an elevated gripping portion accessed from the side. Each angled portion H then curves downward and inward towards the center, and then angles perpendicular to the straight upper grip portion G, forming mounting extensions 495, which are clearly illustrated in FIG. 26B.

Mounting extensions 495 provide the mounting interface with which to mount UBC grip 490 to an attachment plate 460, such as described previously. Each mounting extension 495 has a set of through openings 496, each opening 496 passing completely through tubing 493, for accommodating standard bolt fasteners.

Figure 26B:
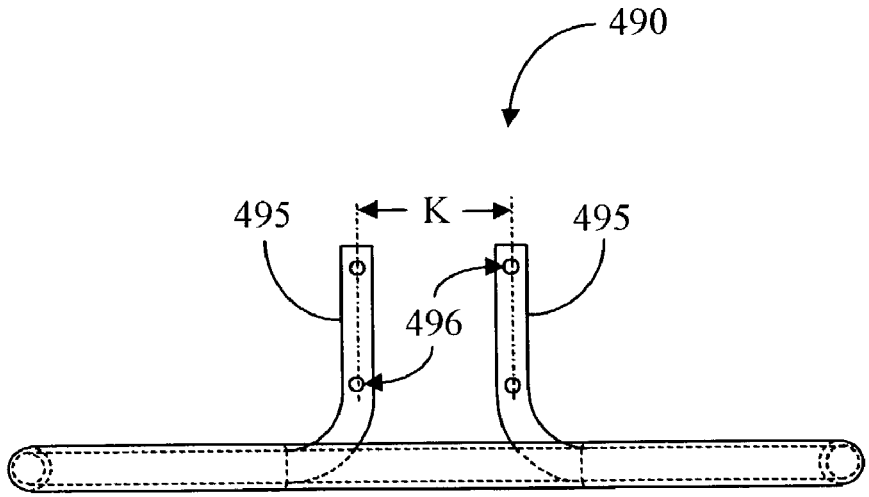
FIG. 26B is a top view of the UBC elevated grip of FIG. 26A.

FIG. 26B is a top view of UBC elevated grip 490 of FIG. 26A. From this vantage point, mounting extensions 495 can now clearly be seen extending perpendicular to the direction of upper grip portions of dimensions (G) and (H). A pair of through openings 496 are shown extending through each mounting extension 495. The distance between the center of each set of through openings 496, defined by dimension (K), is equal to the distance between the center of each opposing set of mounting holes 465 of attachment plate 460, defined by dimension (S), of FIG. 21B, such that the mounting holes 496 of mounting extensions 495 aligned with a set of mounting holes 465 of attachment plate 460.

Figure 27A:
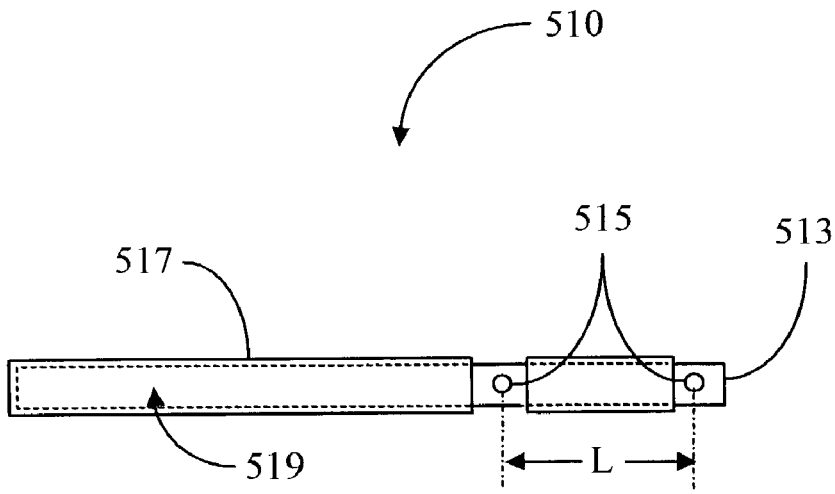
FIG. 27A is a top view of a UBC lower grip according to an embodiment of the present invention.

FIG. 27A is a top view of a UBC lower grip according to an embodiment of the present invention. UBC lower grip 510 is formed of lightweight metal tubing 513 of similar composition and diameter of that of UBC elevated grip 490 of FIG. 26A, B, and also comprises a grip covering 517 covering a substantial portion of the length of grip 510 in two sections. A pair of through openings 515 are provided for mounting grip 510 to an attachment plate assembly for ultimately mounting to a wheeled carriage assembly of a ski apparatus as will be further described herein. Through openings 515 extend completely through both sides of tubing 513, and have a center-to-center distance, defined by dimension (L), equal to that of dimension (K) of elevated grip 490 of FIG. 26B. A grip portion 519, opposite of the mounting end, having a length substantially greater than the portion defined by dimension (K), provides a large gripping area enabling the user to fully grasp grip 510 by hand.

Figure 27B:
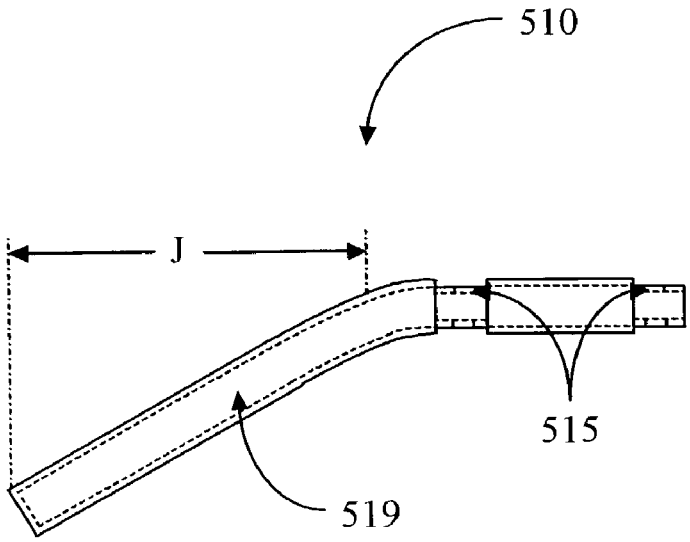
FIG. 27B is a side elevation view of the lower grip shown in FIG. 27A.

FIG. 27B is an elevation view of UBC lower grip 510 of FIG. 27A. Lower grip 490 is provided as a second part of a dual-handle attachment system allowing such exercises and strengthening/rehabilitation as described above, the system being quickly and easily adjustable into several different width settings for providing different exercises specific to different areas of the body. In this view the lower grip portion 519 is shown having an angled portion extending downward from one end of the mounting portion, the angled grip portion defined by dimension (J). Lower grip portion 519 is angled such that the user is enabled for gripping from the side, at a lower level than back at which grip 510 is mounted, providing the user with varying grip positions for strengthening and rehabilitation of different parts of the body.

Upper grip 490 and a lower grip 510, when used with the ski apparatus and wheeled carriage and attachment mounting apparatus described herein, provide a new and unique dual-handle gripping system mountable to the wheeled carriage of the ski apparatus of the present invention, having the benefits of being quickly adjustable into many different width positions and quickly and easily interchangeable with, such as, ski footpad assemblies as described herein. The user is thereby enabled for achieving a number of advanced lateral-motion strengthening, stretching, stabilization and rehabilitation exercises not previously available for any lateral-motion ski apparatus of the prior art, as well as for minimizing the time and effort involved in changing the exercise function of the ski apparatus.

Figure 28A:
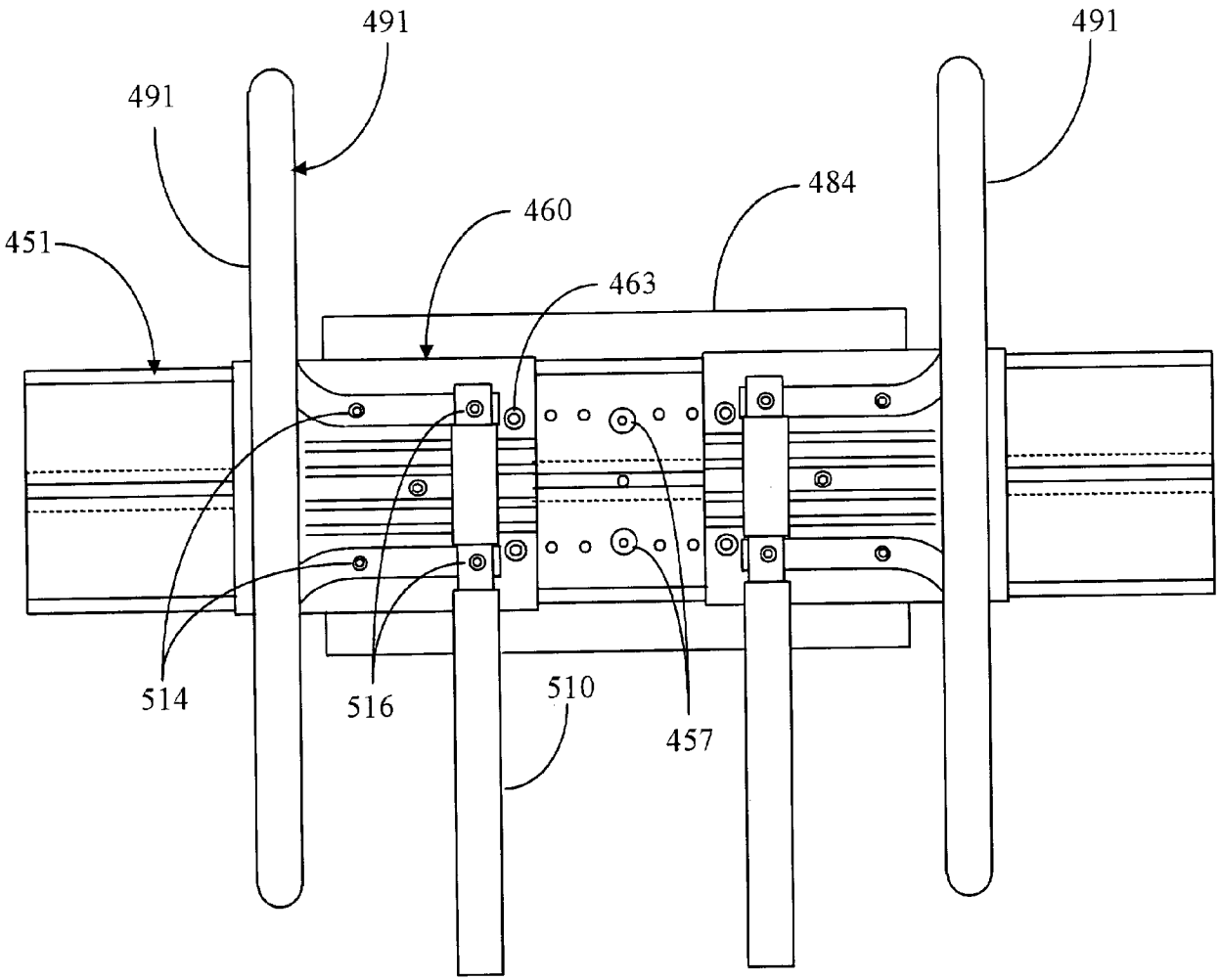
FIG. 28A is a top view of the mounting plate, attachment plates and carriage of FIG. 25A, and a pair of UBC elevated grips and a pair of UBC lower grips affixed to the attachment plates according to an embodiment of the present invention.

FIG. 28A is a top view of UBC elevated grips 490 of FIG. 26A and UBC lower grips 510 of FIG. 27A, attachment plates 460, slide plate 451 and wheeled carriage 484 of FIG. 25A, assembled according to an embodiment of the present invention. Slide plate 451 is affixed in the center position to the upper surface of roller carriage 484 utilizing standard bolt fasteners passed through openings 457 in the center, as described previously for FIG. 25A, B. Also described in FIG. 25A, B, suspended footpad assemblies are attached to the slide plates 460 forming a footpad/plate assembly 472, and the assembly then slides over the ends of plate 451 towards the center for mounting on slide plate 451 at the desired position according to width stance adjustment holes 455.

However, in the embodiment presently illustrated the suspended footpad assemblies have been replaced with two upper body conditioning (UBC) grip assemblies each comprising one elevated grip 490 and one lower grip 510, each set of grips mounted to a sliding attachment plate 460, thereby forming UBC attachment assemblies 491. UBC attachment assemblies 491, as seen from the perspective given in this view, are formed by first placing elevated grip 490 atop an attachment plate 460, aligning the four through openings of the mounting portions of grip 490 with four mounting openings of attachment plate 460, the length of the upper grip portion of grip 490 perpendicular to the longer length of attachment plate 460. A set of standard bolt fasteners 514 secure the portion of grip 490 towards the grip portion, securely to the upper surface of attachment plate 460.

Before securing the other end of the mounting portion of grip 490, a lower UBC grip 510 is placed atop each end of the mounting portion of UBC grip 490, the length of each lower grip 510 parallel to that of upper grips 491, and its pair of mounting through openings 515 aligned with the end pair of through openings 496 of upper grip 490, which align with mounting holes 465 of plate 460. A pair of standard bolt fasteners 516, significantly longer than bolt fasteners 514, having sufficient length to pass completely through the thickness of both lower grip 510 and upper grip 490, are then used to secure grips 510 over grips 490 and then to plate 460. In a preferred embodiment, as is true for suspended footpad assemblies 472 of FIG. 25A, each attachment assembly 491 comprising an elevated grip 490, lower grip 510 and sliding attachment plate 460 is pre-assembled, and therefore quickly and easily interchangeable on slide plate 451 with those of suspended footpad assemblies 472 of FIG. 25A, for example, or other attachment assemblies in alternative embodiments, and may also be quickly relocated to different positions on slide plate 451 as desired.

Figure 28B:
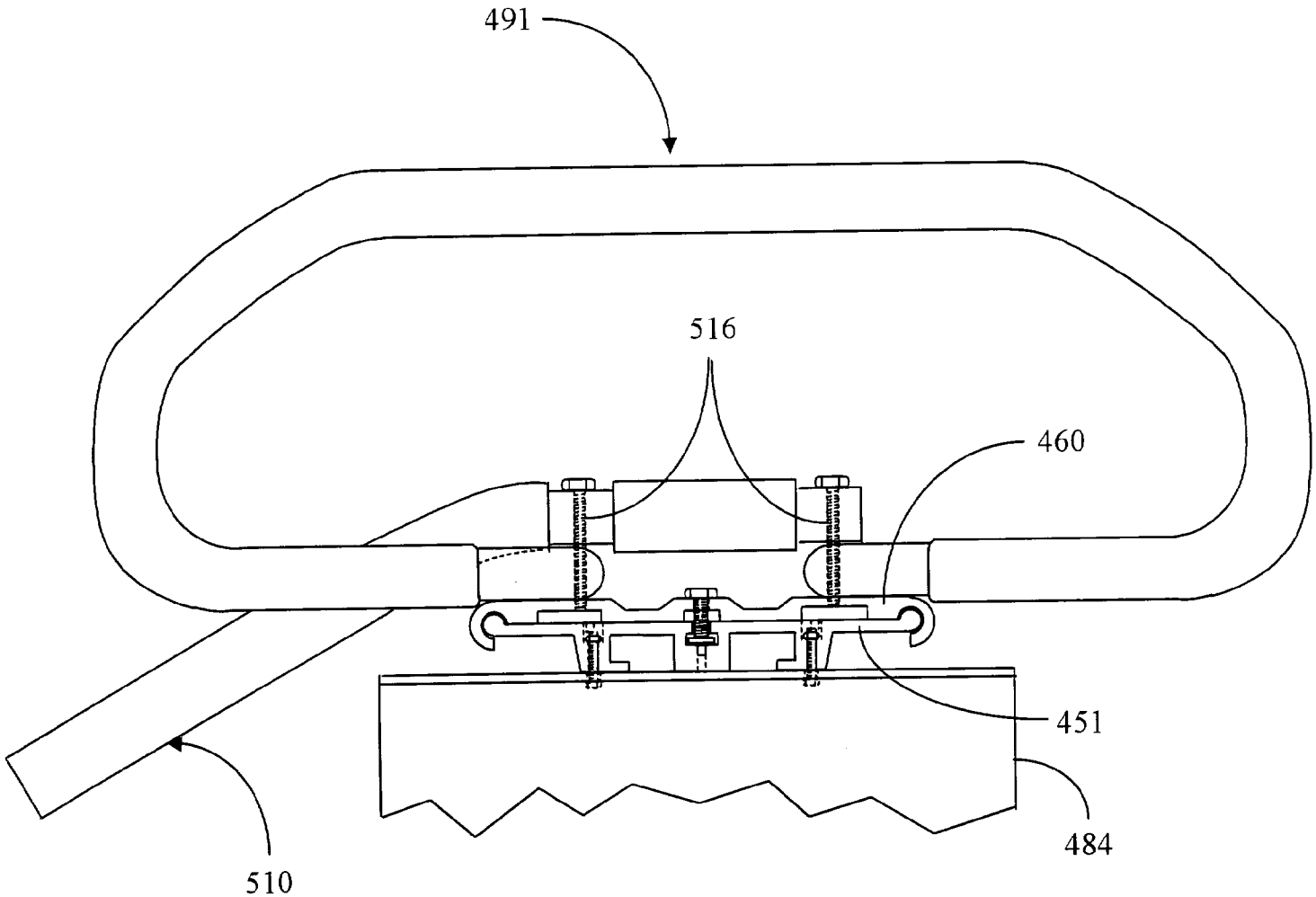
FIG. 28B is an elevation side view of the mounting plate, attachment plates, carriage, UBC elevated grips and UBC lower grips of FIG. 28A.

FIG. 28B is an elevation view of slide plate 451, attachment plates 460, wheeled carriage 484, UBC elevated grips 490 and UBC lower grips 510 of FIG. 28A. The inventor provides the elevation view to clearly illustrate the multiple gripping locations provided by the UBC system described herein, and the mounting configuration when attached to attachment plate 460. Slide plate 451 is attached to carriage assembly 484 in a similar manner to that described herein for FIG. 24 above, and attachment plate 460 is shown as it fits over slide plate 451, also similar to that previously described for FIG. 4.

Lower grip 510 is shown secured atop the mounting extensions of upper grip 490 secured with standard bolt fasteners 516 which are tightened into the mounting holes of attachment plate 460. As can be seen in this view, a void is formed by the rectangular indention into the under surface of plate 460, allowing bolt fasteners 516 to be tightly secured UBC assembly 491 is free to slide back and four along the length of slide plate 451.

The lower angled portion of lower UBC grip 510 provides the user with a gripping position from the side which positions the grip lower than the level of the upper surface of wheeled carriage 484, for enabling such exercises which require the body of the user to be at a low angle to the floor. UBC upper grips 490 provide several additional gripping angles including at least two gripping positions at different angles on either angled side, and a straight upper portion spanning the angled ends providing a lengthy gripping portion from directly above. The variety of such upper and lower gripping areas provided by UBC assembly 491 enable many different additional lateral stretching and stabilization exercise movements using the ski apparatus of the present invention, as will be apparent to the skilled artisan.

In embodiments of the present invention described herein, or part of or related to U.S. patents and applications referenced herein, independent-action suspended footpad assemblies for mounting on a wheeled carriage of the ski apparatus have been described previously utilizing embodiments of the present invention. Referring out to FIG. 25A, B, the independent footpad assemblies, such as assemblies 472 of FIG. 25A may be adjusted to different width stances on the slide plate which attaches to the wheeled carriage assembly, by means of the sliding attachment plate coupled to the suspended footpad assemblies, which forms the interchangeable footpad assembly unit. Footpad assemblies 472 slide along the length of slide plate 451 until locked into their position according to the width stance adjustment holes of the sliding plate, and are then locked into the desired location by pull-pins 463, and a securing bolt fastener as described previously, thereby preventing forward, backward or lateral of the footpad assembly 472 on plate 451.

Referring again to FIG. 25A, the suspended footpad assemblies 472 comprise a suspended footpad which pivots from side to side within the structure of the frame of the footpad assembly, to more closely simulate, during operation of the ski apparatus, at least the lateral motions, forces and dynamics exerted on the lower extremities of the user during actual downhill skiing. However, it is known that there are many other forces other than lateral forces, which exert on the lower extremities of the user during downhill skiing, particularly over steep and sharply variable terrain. During such conditions, the users feet are not held parallel for any significant period of time, and particularly when skiing over steep, bumpy terrain, the tips of the skis are constantly moving up and down, thereby pivoting each ski independently at the skiers ankles.

A significant need thereby exists in the field of ski training apparatus for such extreme conditions, and in many other conditions as well, for the capability in a ski exercise machine to accurately reproduce such forces and movements other than lateral pivoting of the footpad assembly, as described thus far. Applicant's invention, in embodiments presented below in enabling detail, provides a new and novel interface for mounting a footpad assembly to the wheeled carriage of the ski apparatus of the present invention, providing the tensioned lateral movement and footpad pivoting action of embodiments disclosed herein, and also incorporating the ability for each footpad to slide forward and backward independently from one another, and still further incorporating independent front to back pivoting of each footpad assembly. The user of such an improved apparatus is enabled to better simulate the actual movements, forces and dynamics of the sport, to a significant degree, and further achieve a level of balance controls, due to the front to back sliding and pivoting action of each independent footpad assembly, that is not achievable in prior art ski exercise apparatus.

Figure 29A:
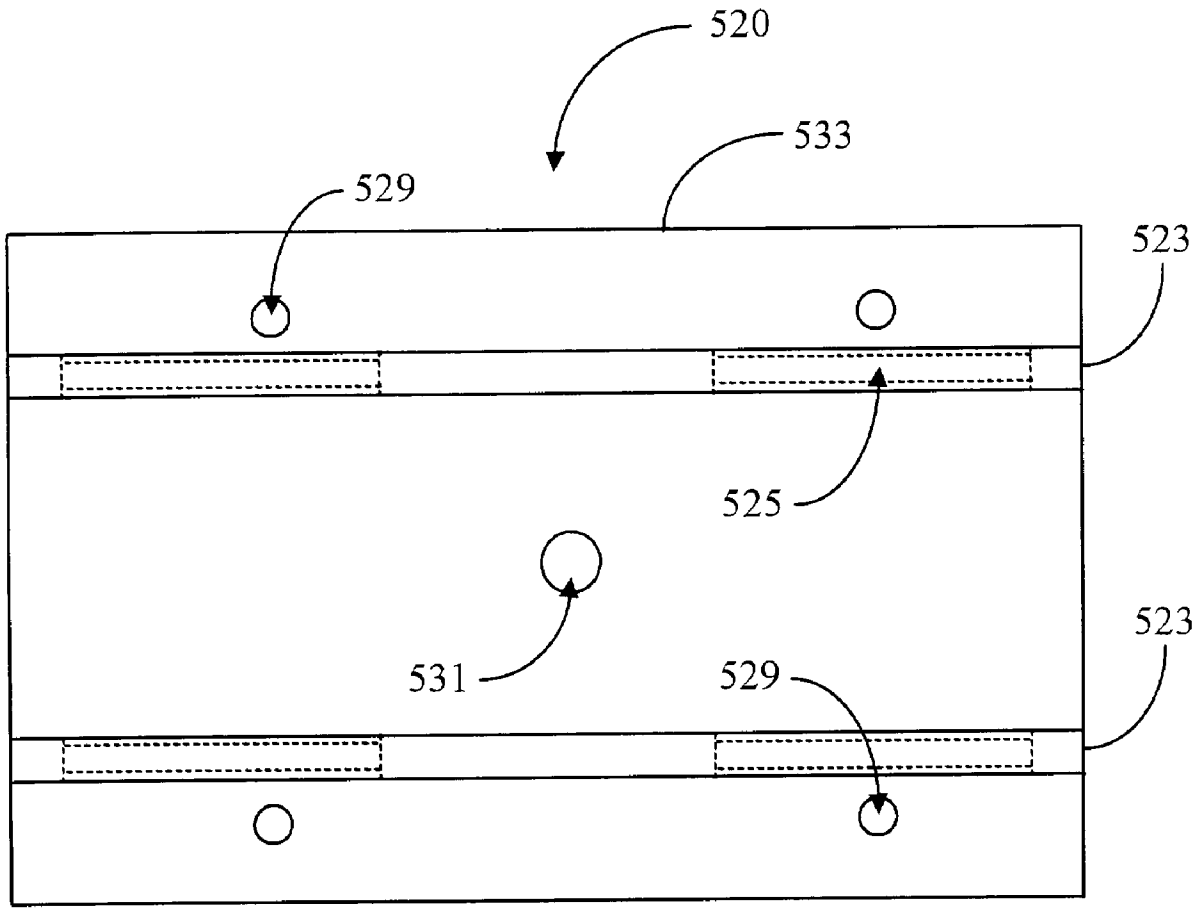
FIG. 29A is a top view of a footpad pivot base according to an embodiment of the present invention.

FIG. 29A is a top view of a footpad pivot base according to an embodiment of the present invention. Pivot base 520 is preferably manufactured of strong, lightweight metal such as aluminum or some other material of similar strength and rigidity, and provides the supporting base structure portion for a sliding/pivoting footpad attachment interface system, as well as enabling a front to back sliding action for the footpad assembly, as will be shown in the embodiments detailed below.

Pivot base 520 is rectangular in shape, having outside dimensions approximately equal to that of sliding attachment plate 460 of FIG. 21 (A, B). The Pivot base 520 comprises a support base portion 533, which is substantially flat and has a material thickness of approximately ½–¾ in., sufficient for substantial overall strength and rigidity of the structure. A set of through openings 529 extend completely through the thickness of base portion 533 located near each of the corners of base 533, located to correspond with the mounting holes of the upper surface of the sliding attachment plate 460 disclosed herein, enabling mounting of pivot base 520 to attachment plate 460 using standard bolt fasteners. Pivot base 520 is also provided with a center through opening 531 enabling access to the center sliding securing bolt and nut fastener for securing attachment plate 460 to slide plate 451, as described above.

Pivot base 520 comprises a pair of elongated support structures 523 protruding upward from base 533 to a height substantially greater than the thickness of base 533, and extending parallel to the length of base 533. Structures 523 are preferably attached permanently to the upper surface of base 533, or in alternative embodiments may be otherwise securely affixed to the upper surface of base 533 using standard fasteners, and so on. Each support structure 523 resembles a rectangular bar having a thickness approximately equal to the thickness of base 533, and a height approximately twice that distance.

Located near the outward opposite ends of each structure 523, a pair of elongated slots 525 are formed completely through the thickness of structures 523, the set of elongated slots of one structure 523 aligned with those of the opposite structure 523. Each elongated slot 525 is adapted to accommodate the wheels of a roller assembly supporting a rolling footpad pivot support structure, as will be further detailed below.

Figure 29C:
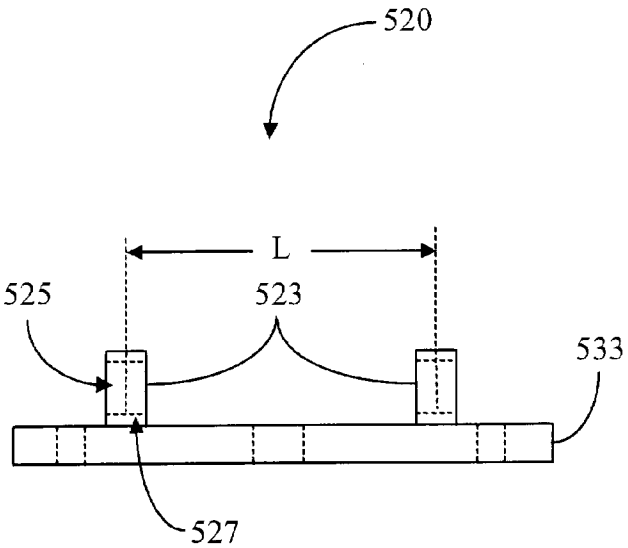
FIG. 29C is an elevation end view of the footpad pivot base of FIG. 29A.
Figure 29B:
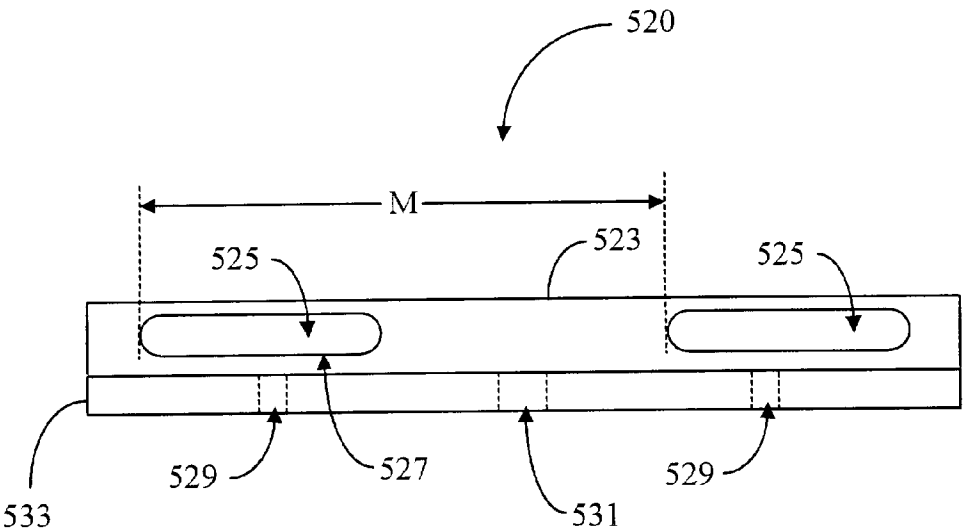
FIG. 29B is an elevation side view of the footpad pivot base of FIG. 29A.

FIG. 29B is an elevation side view of footpad pivot base 520 of FIG. 29A, which illustrates the height and shape of structure 523 and location of elongated roller slots 525. In the example shown, a pair of elongated slots 525 are shown, each slot 525 identical in size to the other within each support structure 523, the left ends of each slot 525 distanced from each other as defined by dimension (M). Dimension (M) is equal to the distance between the rollers of a pair of roller assemblies on one side of a rolling footpad pivot support structure, as will be shown below, such that the outer ends of each elongated slot 525 provide a stop point for the rolling footpad pivot support structure, providing the range limit for the rollers traveling within slots 525. The inner surfaces of each slot 525 form a roller surface 527 providing a smooth surface onto which a roller may travel.

In alternative embodiments, however, the size and number of elongated roller slots 525 may vary depending on the size of the roller assemblies adapted to travel within, and their distance apart from each other, as well as the distance of travel desired. In some alternative embodiments support structures 523 may be secured to base 533 utilizing such as standard bolt fasteners, for example, allowing the user to interchange existing structures with other structures which may have elongated slots of different length, size, location and so on, to accommodate different rolling pivot support structures, for example. The preferred embodiment illustrated utilizes a pair of elongated slots 525 which are located within structure 523 so as to form a large supporting bridge of material between each elongated slot within a structure 523. The inventor has determined that two such slots are the preferable configuration for the preferred embodiment, combining sufficient roller travel distance defined by the length and location of slots 525, with substantial structural integrity.

Through openings 529 are shown (hidden view) extending completely through the thickness of base 533 for accommodating bolt fasteners for securing structure 520 to an attachment plate 460, in one embodiment, and through opening 531 is seen extending through the thickness of base 533 at the center, allowing access from above to the sliding securing bolt and nut fastener for attachment plate 460.

FIG. 29C is an elevation end view of footpad pivot base 520 of FIG. 29A. From this perspective the pair of elongated support structures 523 can be seen extending up from support base 533 near each edge, with the elongated slots 525 shown extending completely through each support structure 523, forming the inner roller surfaces 527. The center-to-center distance between each elongated slot 525, as defined by dimension (L) is equal to the center-to-center distance between opposite rollers on a rolling support pivot plate adapted to travel within slots 525, as will be shown further in detail. The width of dimension (L) may vary, however, in alternative embodiments depending on the width of the rolling support plate utilized. For example, as mentioned above, support structures 523 may be removably and adjustably attached to base 533 using bolt fasteners such that the support structures may be repositioned at different widths on support base 533 and re-secured utilizing different sets of mounting holes in support base 533.

Figure 30B:
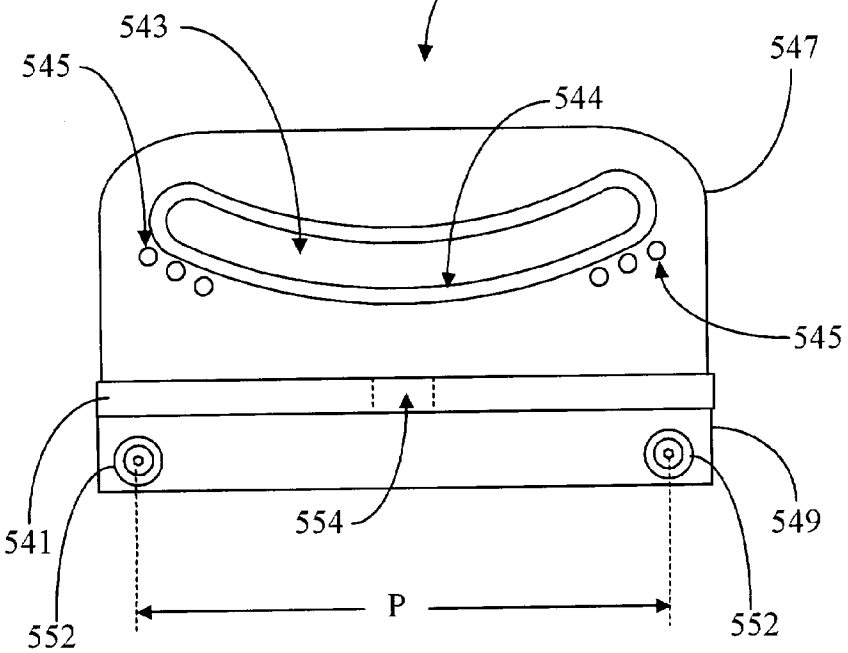
FIG. 30B is an elevation side view of the footpad pivot support structure of FIG. 30A.
Figure 30A:
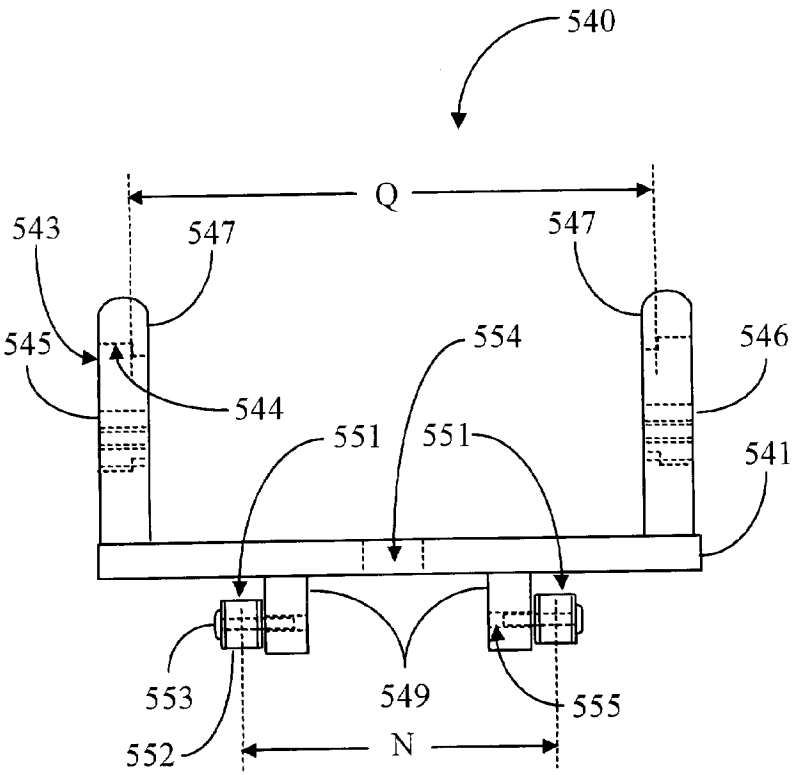
FIG. 30A is an elevation end view of a footpad pivot support structure according to an embodiment of the present invention.

FIG. 30A is an elevation end view of a footpad pivot support structure according to an embodiment of the present invention. Footpad pivot support structure 540 is a further key element in the new and innovative dual-action footpad assembly attachment system which enables an attached footpad assembly to slide forward and backward as well as pivot forward to backward, to a predetermined degree. Pivot support structure 540 is manufactured using similar materials and process as for support base 520, having the best combination of light weight and overall structural rigidity.

Pivot support structure 540 comprises a base portion 541 having a thickness approximately equal to that of base 533 of support structure 520, approximately ¾ inches in the embodiment presented, and having a rectangular shape also having similar in dimensions to that of rectangular shape of support structure 520. A center through opening 554 is provided in base 541 for allowing the user access from above to the center sliding securing fastener, such as fastener 480 describe for FIG. 24.

A pair of vertical support members 547 forms walls extending upward from the upper surface of base 541 along each opposite edge, forming a distinct U-shaped structure, support member 547 extending to a height approximately equal to half the width of base 541 in the embodiment shown, and extending along the entire length of base 541. Support member 547 has a thickness somewhat greater than that of base 541, and are preferably permanently attached to base 541 by welding, or casting, or the like, or in alternative embodiments may be removably attached to base 541 using standard bolt fasteners, for example, and the width distance between support member 547 may also be adjustable by utilizing different sets of mounting openings (not shown) through base 541, for instance, similarly to structures 523 of support structure 520, so as to accommodate additional elements of different sizes, and so on.

Each vertical support member has a large, arcuate slot 543, curving somewhat upward at each end from the center, extending completely through the thickness of walls 547. The inner surface 544 of each arcuate slot 543 is modified to provide a smooth roller surface, similarly to that of elongated roller slots 525 of FIG. 29B, except for the outer opening of arcuate slot 543 is somewhat greater than the opening to the inside of support members 547, adapted as such for accommodating a roller assembly while minimizing lateral movement of the rolling assembly, as will be shown in greater detail in embodiments presented below. Dimension (Q), as shown in the illustration, defines the distance between the beginnings of the larger outward-facing opening of arcuate slots 543 of opposing vertical support structures 547.

A plurality of through openings 545 extend completely through the thickness of one wall 547, shown on the left in FIG. 30A, and a corresponding number of threaded openings 546, having the same number and pattern of through openings 545, extend into the opposite support member 547. Arcuate slot 543 and openings 545 and 546 are better illustrated, however, in the following figures.

Pivot support structure 540 is provided with a pair of roller support structures 549 which are similar in size and rectangular bar-shape to structures 523 of support structure 520 of FIG. 29C, and are also, in a preferred embodiment, permanently attached by welding or formed by other permanent means on the bottom surface of base 541, and extend along the entire length of base 541. Roller support structures 549 extend down from the bottom surface of base 541, and are provided with a plurality of mounting holes 555, in this case a total of four, for the purpose of rotatably attaching four roller assemblies 552, one pair of roller assemblies 552 attached to each roller support structure 549, facing outward. Roller assemblies 552 comprise a roller 551 rotatably secured to support structures 549 utilizing roller axles 553 secured within mounting holes 555 of structures 549. In the embodiment presented roller assemblies 552 heavy-duty, high-performance rollers designed to withstand substantial downward force while still rotating freely. Roller assemblies 552 are designed to at least support the weight of any exercise user adding that additional lateral forces related to the tensioned side-to-side action operation of a wheeled carriage assembly during operation of a ski apparatus as previously described.

In the embodiment presented footpad pivot support structure 540 is adapted to roll freely back and forth within the set of elongated roller slots 525 of support structure 520 of FIG. 29, supported by roller assemblies 552. Roller assemblies 552 are located beneath base 541 on structures 549 such that the center-to-center distance between each opposing roller 551, defined by dimension (N) in the example presented, is equal to dimension (L) between structures 523 of support structure 520 of FIG. 29C. In alternative embodiments however, dimensions (N) and (L) may vary somewhat, as long as they are equal in dimension to each other.

FIG. 30B is an elevation side view of footpad pivot support structure 540 of FIG. 30A. The size and shape of arcuate slot 543 is clearly seen in this view, as are the locations of through openings 545. As mentioned previously, although only one vertical support member 547 is visible in this elevation view, threaded openings 546 extending into the opposite (hidden) support member 547 are located and spaced identically to through openings 545. The grooved roller surface formed by the inner walls of arcuate slot 543 is also clearly visible in this view.

Two of the four roller assemblies 552 are visible in this view attached to facing side of one of structures 549, near the forward and rearward ends of structure 549, approximately halfway between the top and bottom of structure 549. As mentioned previously relative to support structure 520 of FIG. 29B, elongated slots 525 each provide a forward or rearward stopping point for roller assemblies traveling back and forth within. Dimension (M) defines the distance between the left edge of a first elongated slot 525, and that of the second slot 525. In the embodiment presently illustrated, the center-to-center distance between the forward and rearward roller assemblies 552, defined by dimension (P) in the illustration, is exactly equal to that of dimension (M) of FIG. 29B. As with the center-to-center width dimensions of opposing roller assemblies, as shown in FIG. 30A, the center-to-center length dimension (P) of FIG. 30B may vary in alternative embodiments as long as it equals dimension (M) of FIG. 29B, as it is preferable that when footpad pivot support structure 540 is rolling back and forth within elongated slots 525 of support structure 520, the stopping points provided by the ends of elongated slots 525 should stop both rollers at exactly the same time when the rolling travel distance of support structure 540 has reached the limit.

Figure 30C:
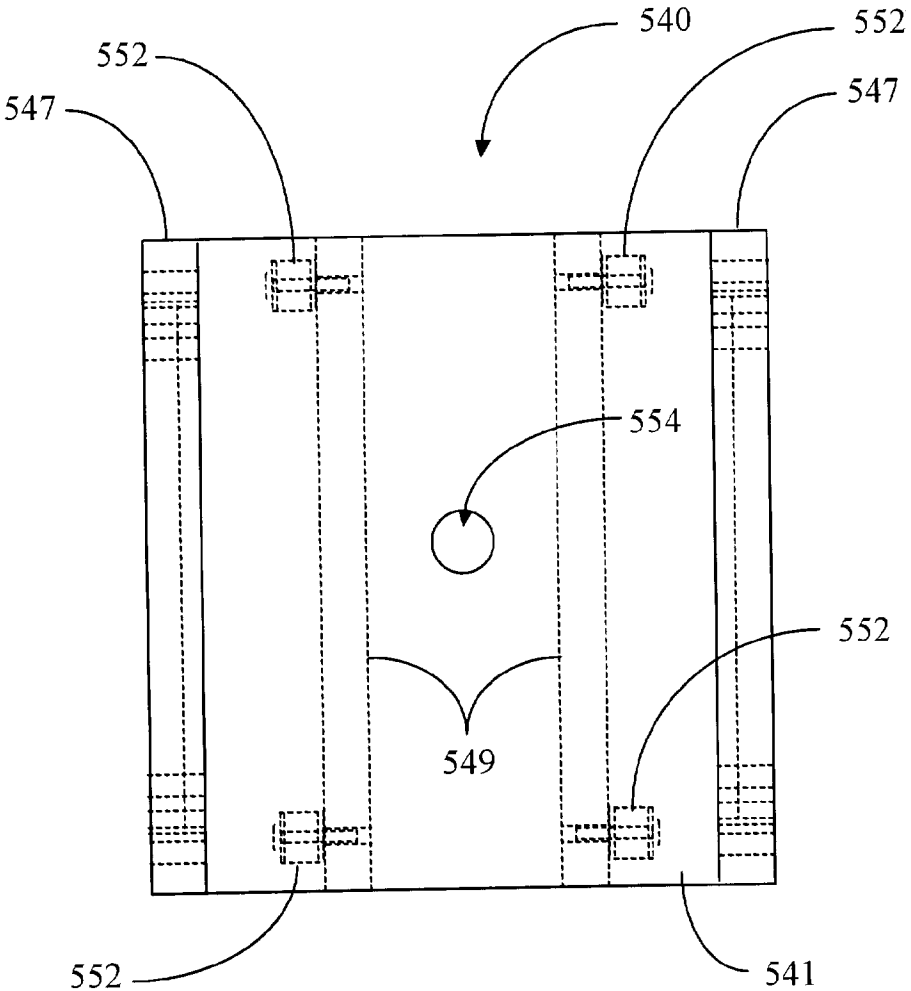
FIG. 30C is a top view of the footpad pivot support structure of FIG. 30A.

FIG. 30C is a top view of footpad pivot support structure 540 of FIG. 30A. In this view, the rectangular shape of base 541 is now clearly seen, and with vertical support members 547 located at each opposite edge of base 541. All four roller assemblies 552 are seen in the hidden view, rotatably to roller support structures 549 attached near each end, structures 549 each having a thickness approximately equal to vertical support members 547, and extending along the entire length of base 541 approximately halfway between the center and either edge of base 541. Through opening 554 is shown extending completely through the center of base 541 for accessing the sliding attachment plate securing fastener as described above.

Figure 31A:
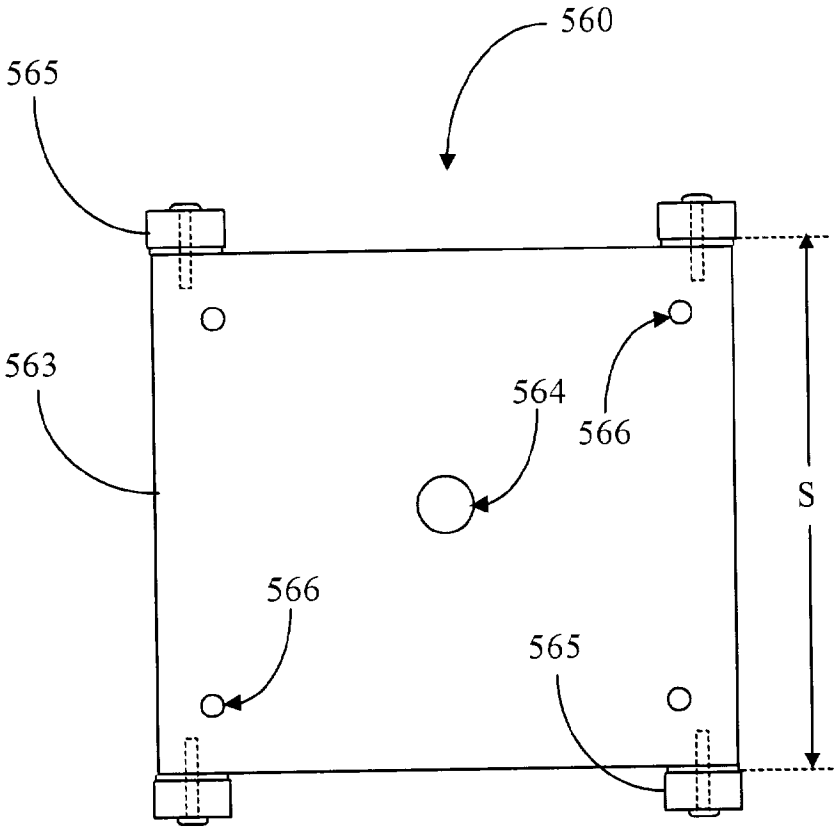
FIG. 31A is a top view of a pivot roller base assembly according to an embodiment of the present invention.

FIG. 31A is a top view of a pivot roller base assembly according to an embodiment of the present invention. Pivot roller base assembly 560 is provided as a further key element in the new and novel dual-action pivoting footpad attachment assembly of the present invention. Base assembly 560 is provided as essentially a rolling base adapted for attaching an exercise attachment such as suspended footpad assembly 470, shown in FIG. 24. Base assembly 560 comprises a base portion 563, which is rectangular in shape, substantially flat and manufactured of strong, lightweight aluminum or similar material similarly to other footpad pivot system elements described above. Base 563 has a width dimension, which is somewhat less than the distance between the internal walls of vertical support members 547 of pivot support structure 540 of FIG. 30A, enabling roller base assembly 560 to freely move forward and backward between vertical support members 547, while minimizing side play. A distance (S) defines the distance between the inner edges the rollers of each set of forward or rearward roller assemblies 565 on opposing sides of base 563, a distance defined as dimension (R) in the illustration, is equal to dimension (Q) of FIG. 30A defining the distance between the beginning of the larger outward-facing openings of arcuate slots 543 of vertical support members 547. Rollers 565 of roller base assembly 560 travel along roller surface 544, as shown for support structure 540 of FIG. 30B, within the larger outward-facing openings formed in arcuate slots 543.

A plurality of threaded mounting holes 566, one located near each corner of base 563, extend somewhat down into the surface of base 563, and are positioned on base 563 in accordance with the location of the mounting through openings 471 of footpad support structure 473 of FIG. 23, such that suspended footpad assembly 470, for example, may be mounted in a center position to the upper surface of base 563, aligning four through openings 471 of footpad assembly 470 with the four corresponding mounting holes 566, and securing with standard screw or bolt fasteners, as described for FIG. 23. As with previous elements illustrated above, a center through opening 564 is also provided extending completely through the thickness of base 563 allowing the user to access the sliding securing faster for the sliding attachment plate 460 described previously Pivot roller base 560 also comprises a set of four roller assemblies 565 rotatably mounted to the sides of base 563 near each of the forward and rearward corners, utilizing roller axles 567 and threaded openings, (not shown), extending into the sides of base 563. Roller base 560 is provided in this embodiment as essentially a sturdy, rolling platform adapted to travel forward and backward within arcuate slots 543 of vertical support members 547 of footpad pivot support structure 540 of FIG. 30, while an independent footpad assembly is mounted thereupon as described above.

As described for footpad pivot support structure 540 of FIG. 30, roller assemblies 565 are heavy-duty, high-performance roller assemblies known in the art, capable of supporting at least the weight of exercising user as well as the additional forces placed thereupon by operation of the ski apparatus machine.

Figure 31C:
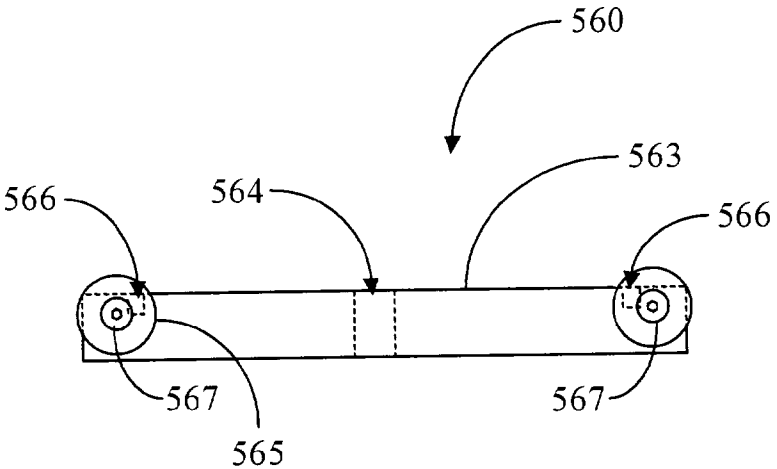
FIG. 31C is an elevation side view of the pivot roller base assembly of FIG. 31A.
Figure 31B:
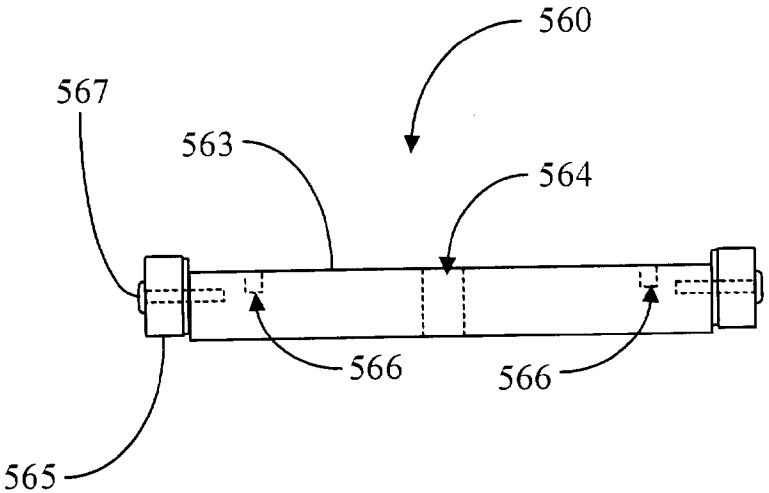
FIG. 31B is an elevation end view of the pivot roller base assembly of FIG. 31A.

FIG. 31B is an elevation end view of pivot roller base assembly 560 of FIG. 31A, clearly showing the thickness of base portion 563 and two of the four threaded mounting holes 566 (hidden view) extending somewhat down into the upper surface of base 563, and center through opening 564 can be seen extending completely through the thickness of base portion 563.

Two of the four roller assemblies 565 are shown in this elevation view, rotatably attached to the sides of base 563, each roller assembly 565 positioned approximately level with base portion 563.

FIG. 31C is an elevation side view of pivot roller base assembly 560 of FIG. 31A. From this perspective only two of the four roller assemblies 565 are shown rotatably mounted on one side of base 563, secured with roller axles 567. Mounting holes 566 can be seen at their locations near the front and rear ends of base 563, with through opening 564 extending through the thickness of base 563 at its center.

Figure 32A:
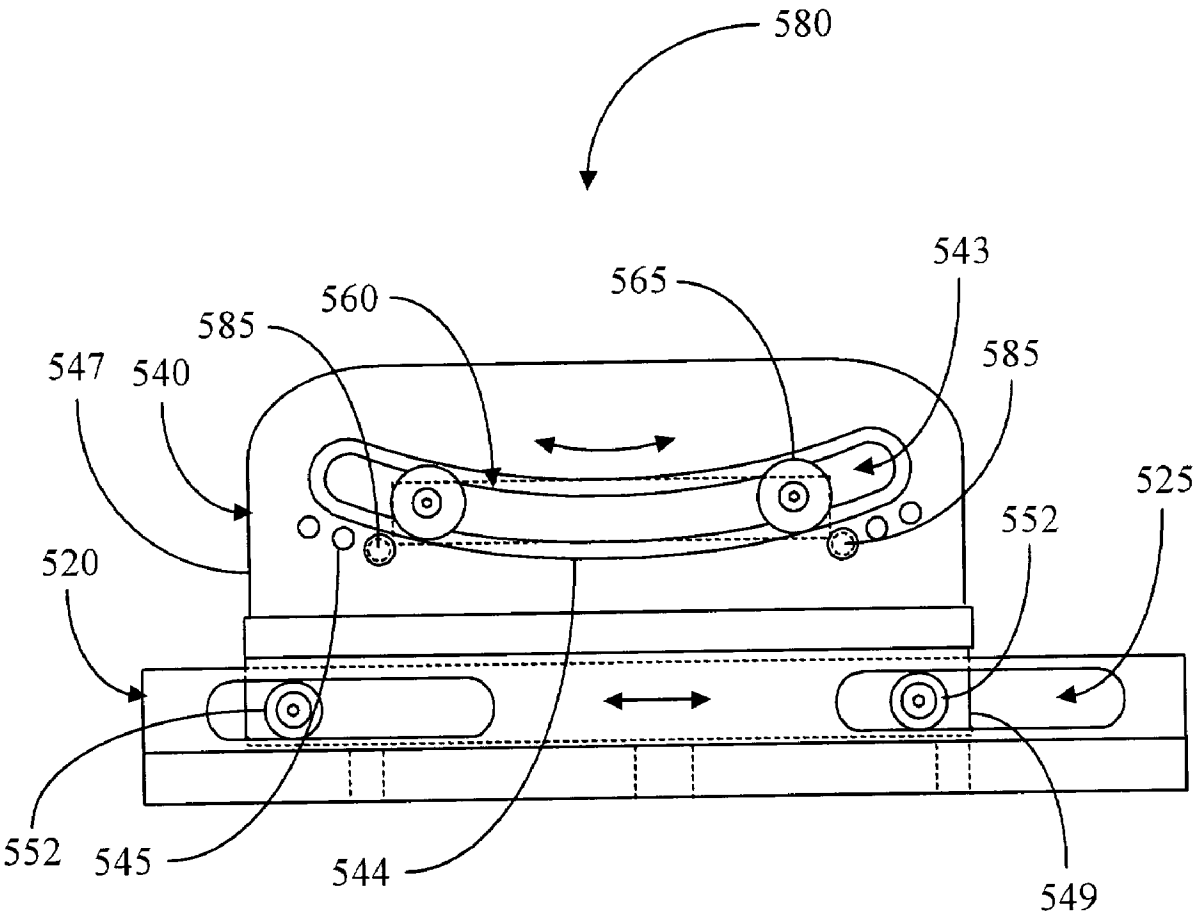
FIG. 32A is an elevation view of the footpad pivot base of FIG. 29B, footpad pivot support structure of FIG. 30B and the pivot roller base assembly of FIG. 31B according to an embodiment of the present invention.

FIG. 32A is an elevation view of footpad pivot base 520 of FIG. 29B, footpad pivot support structure 540 of FIG. 30B, and pivot roller base assembly 560 of FIG. 31C, assembled according to an embodiment of the present invention. Footpad pivot roller assembly 580 is provided as a new and novel dual-action pivoting mounting interface for attaching such as a suspended footpad assembly 470 to a sliding attachment plate 460, and ultimately to a wheeled carriage of a ski exercise apparatus such as described herein.

As shown in this view, and described previously, footpad pivot support structure 540 rolls back and forth freely within elongated roller slots 525 of roller base 520, suspended by roller assemblies 552 rotatably attached to the sides of roller support structures 549 of pivot support structure 540. The distance range of travel for pivot support structure 540 within roller base 520 is limited by the length of each elongated roller slot 525.

Although it is not shown in this view for reasons of simplicity, roller base 520, in practice of the invention, may be preassembled to a sliding attachment plate 460 for adjustably mounting onto a slide plate 451 mounted to a wheeled carriage 484, as described for previous figures, or alternately, may also be mounted directly to the upper surface of the wheeled carriage of the ski apparatus exercise machine. In either application, pivot support structure 540 travels freely within elongated slots 525, providing the free range of motion forward and backward for pivot support structure 540.

Pivot base assembly 560 is shown in this view positioned between vertical support members 547, only one of which is seen in this elevated view, supported by roller assemblies 565 rotatably attached to each side of base assembly 560, which travel freely within arcuate slots 543 along roller surface 544 adapted for the purpose. As can be seen in this view, base assembly 560 is enabled to travel within arcuate slots 543, a distance range defined by the outer ends of arcuate slots 543, and in doing so, enables a tilting action forward or backward for base assembly 560. In practice of the invention, a suspended footpad assembly, such as footpad assembly 484 of FIG. 24 is secured to the upper surface of base assembly 560, and therefore, when attached, tilts forward and backward in accordance with base assembly 560 within arcuate slots 543.

The purpose and function of the plurality of through openings 545 of vertical support members 547 also now becomes apparent in this view. From this perspective, through opening 545 are shown arranged linearly, at a slight angle, near each end of arcuate slot 543. As mentioned previously for FIG. 30B, a corresponding set of threaded openings 546 (not shown) extending into the opposing vertical support member 547 (also not shown), arranged according to the locations of through openings 545. Through openings 545 accommodate insertion of a threaded pivot stop bolt 585, which is of sufficient length such that when fully inserted through an opening 545 the threaded end of pivot stop bolt 585 extends to a corresponding threaded hole 546 in the opposite vertical support member 547, such that pivot stop bolt 585 may be secured to the threaded hole 546. An identical pivot stop bolt 585 may also be inserted and threaded as described above that the opposite end of arcuate slot 543, such that a stop bolt 585 is secured at either end of arcuate slot 543. The purpose of stop bolts 585 is to provide the user a means for limiting the amount of travel of base assembly 560 within arcuate slot 543, thereby limiting the tilting action of base assembly 560, and ultimately an attached suspended footpad assembly. The travel of base assembly 560 within arcuate slot 543 is limited by the bottom corner of base assembly 560 making contact with an inserted pivot stop bolt 585, as shown in the example presented. The travel/tilting range of base assembly 560 within arcuate slots 543 is increased by inserting pivot stop bolts 585 through outward sets of through openings 545 and threaded holes 546 of vertical support members 547, and is thereby decreased by inserting pivot stop bolts 585 through inward sets of openings 545 and threaded holes 546. The number and location of through openings 545 and threaded holes 546 in vertical support members 547 may vary in alternative embodiments of the present invention, those shown in this view are only exemplary.

Figure 32B:
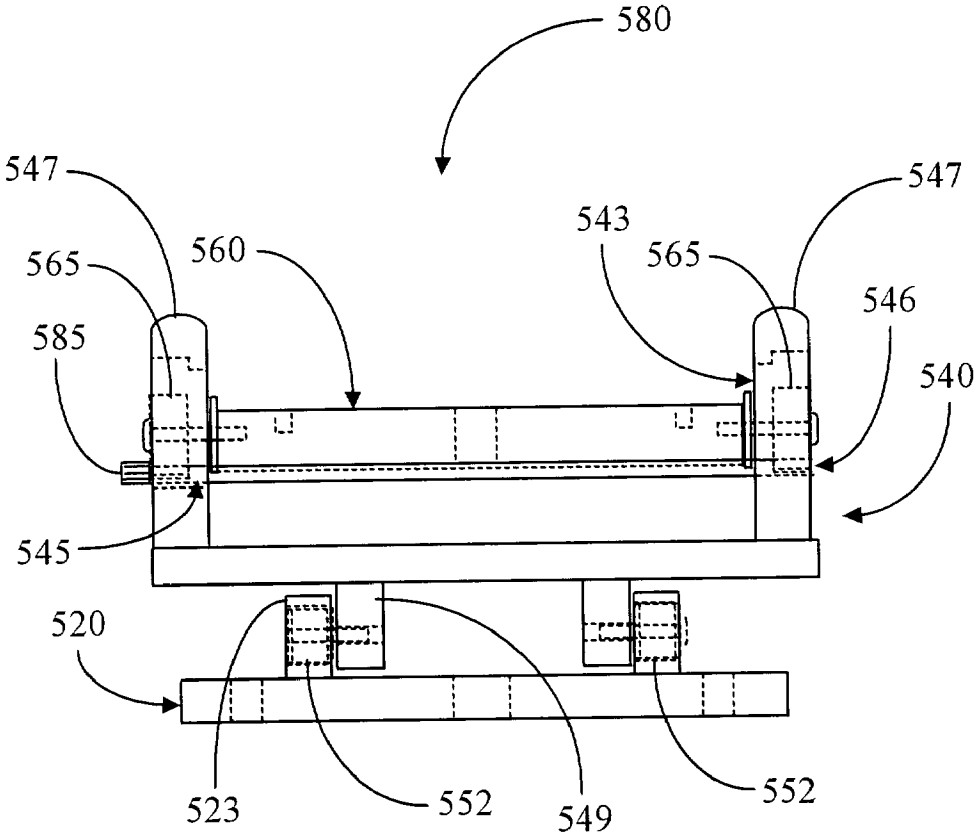
FIG. 32B is an elevation end view of the footpad pivot base, footpad pivot support structure, and pivot roller base assembly of FIG. 32A.

FIG. 32B is an elevation end view of footpad pivot base assembly 520, footpad pivot support structure 540, and pivot roller base assembly 560 of FIG. 32A. In this view, roller assemblies 552 are shown rotatably attached to roller support structures 549, and positioned within the elongated slots of structures 523 of support structure 520. Roller assemblies 565, rotatably attached to pivot base assembly 560, are positioned within arcuate slots 543 of vertical support members 547 of pivot support structure 540. One of stop bolts 585 is shown in this elevation view inserted through opening 545 of a first vertical support member 547, and its threaded end secured into threaded hole 546 of the second vertical support member 547.

The assembly shown in FIGS. 32A and 32B is meant to be mounted in pairs in a preferred embodiment to a wheeled carriage in the exercise apparatus such that the direction of translation of support structure 540 and of pivot base 560 is at right angles to the direction of travel of the wheeled carriage side-to-side. This arrangement allows a foot pads engaged to elements 560, thus to a user's two feet, to translate to a limited degree forward and backward independently and to also rock arcuately, adding these degrees of freedom to the action of the overall apparatus, simulating much more truly the actual experience of slalom skiing.

Energy Monitoring

As mentioned above in the background section of the present application, one object of the present invention is to provide a ski apparatus having a monitoring system integrated therein which provides the user with information pertaining to the workout in order to enable the user to best utilize the apparatus and maximize effectiveness of the workout or training. Such information may include elapsed time from start to finish of the workout, goal determination and accomplishment, energy or calories expended by the user, speed of turns, side travel distance of the wheeled carriage, and so on. It is preferable that such a monitoring system is electronic and capable of being retrofitted to all ski exercise apparatus described herein in the present application and in related U.S. patents and applications included herein by reference. Elements of such a new and novel electronic monitoring system and apparatus, termed LifeBeat (LB) by the inventor of the present application, are disclosed in the following figures in enabling detail.

Figure 33B:
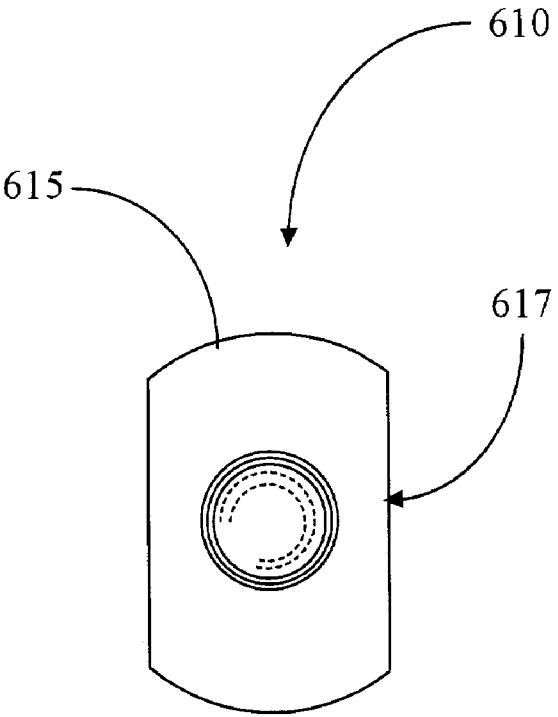
FIG. 33B is an elevation end view of the roller axle assembly of FIG. 33A.
Figure 33A:
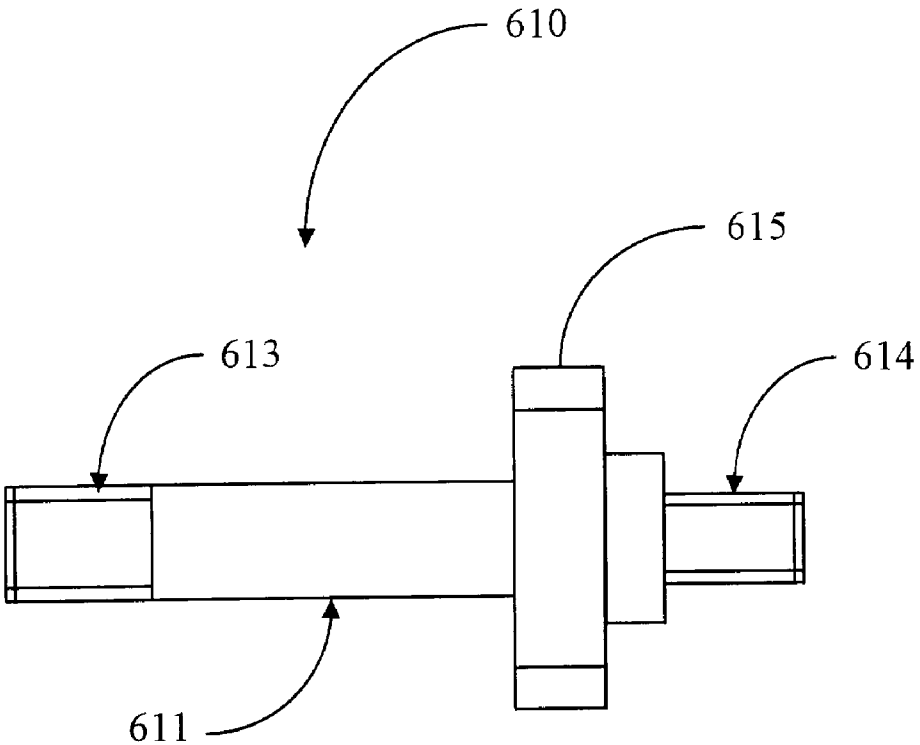
FIG. 33A is an elevation view of a roller axle assembly according to an embodiment of the present invention.

FIG. 33A is an elevation side view of a LifeBeat (LB) cable-securing axle according to an embodiment of the present invention. LifeBeat (LB) axle 610 is provided in this embodiment as a roller axle mechanism which enables the connection of an optical sensor actuating cable (not shown) to the underside of a wheeled carriage assembly of a ski exercise apparatus as described herein. LB axle 610 is designed to replace an existing roller axle mounted beneath the wheeled carriage assembly of a ski exercise apparatus which is being retrofitted with monitoring sensor elements as will be described further below in enabling detail.

LB axle 610 comprises an axle shaft portion 611 onto which an existing carriage roller, such as roller 59 of FIG. 4, is rotatably mounted. LB axle 610 also comprises an enlarged stop collar 615 adapted for preventing LB axle 610 from rotating within the carriage roller bracket beneath the wheeled carriage. LB axle 610 comprises an internal threaded portion 614 on one end for securing LB axle 610 to the roller bracket utilizing a standard threaded nut fastener, and an external threaded portion at the opposite end of axle shaft portion 611, for securing the end of an actuating cable for the optical sensor system as will be described below.

FIG. 33B is an elevation end view of cable-securing LB axle 610 of FIG. 33A. Stop collar 615 of LB axle 610 is clearly shown in this view having a flat portion 617 on either side for preventing LB axle 610 from rotating within the roller mounting bracket of the wheeled carriage assembly, once LB axle 610 is attached.

Figure 34:
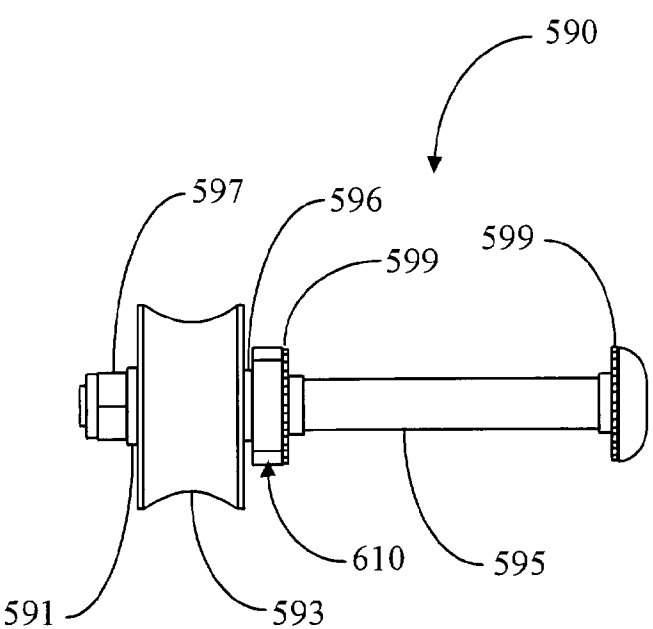
FIG. 34 is an elevation side view of a cable-securing axle according to an embodiment of the present invention.

FIG. 34 is an elevation side view of a LifeBeat (LB) carriage wheel roller axle assembly according to an embodiment of the present invention. LB roller axle 590 is adapted for retrofitting with roller axles securing existing end rollers of a ski exercise apparatus being retrofitted with the monitoring system of the invention, such as those securing rollers 35 and 37 of ski apparatus 9 of FIG. 2. However, LB roller axle assemblies 590 provide a carriage wheel rotatably mounted to roller axle 595 at one end, secured by lock nut 597 and washers 591 and 596.

Roller axle 595 is shown in this embodiment as an existing roller axle securing the end power band rollers, such as rollers 35 and 37 of apparatus 9 of FIG. 2. LB axle 610 of FIG. 33A is shown in this view threaded onto the threaded end of existing roller axle 595, and a carriage wheel 593 is rotatably mounted over LB axle 610, secured by lock nut 597. Star washers 599 are provided for more securely attaching roller axle 595 to the end power band roller mounting brackets, as is illustrated further below.

Figure 35:
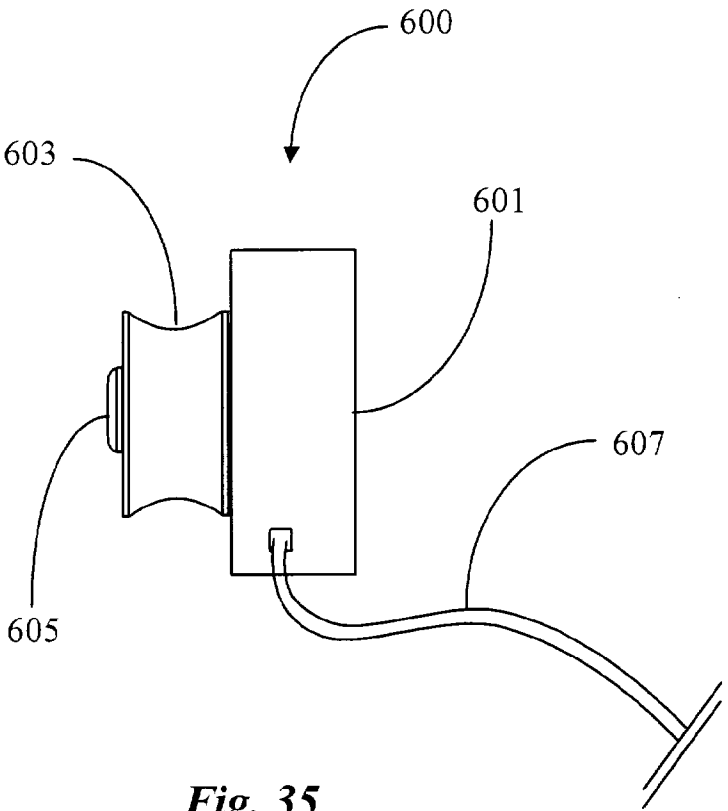
FIG. 35 is an elevation side view of an optical sensor assembly according to an embodiment of the present invention.

FIG. 35 is an elevation side view of an optical sensor unit according to an embodiment of the present invention. LB sensor assembly 600 comprises an optical sensor unit 601, which senses rotational changes of an attached sensor carriage wheel 603, secured to optical sensor unit 601 by roller axle bolt 605. A monitor wire 607 carries the sensed signals from the optical sensor unit to a conventional electronic monitor display unit (not shown) which may be attached to the frame of the ski apparatus, or may otherwise be provided with its own stand, enabling viewing of the displayed monitoring results by the exercising user, and enabling the exercising user to enter information into the monitor display unit. Such a unit and display is common to, for example, commercially-available treadmills.

Figure 36:
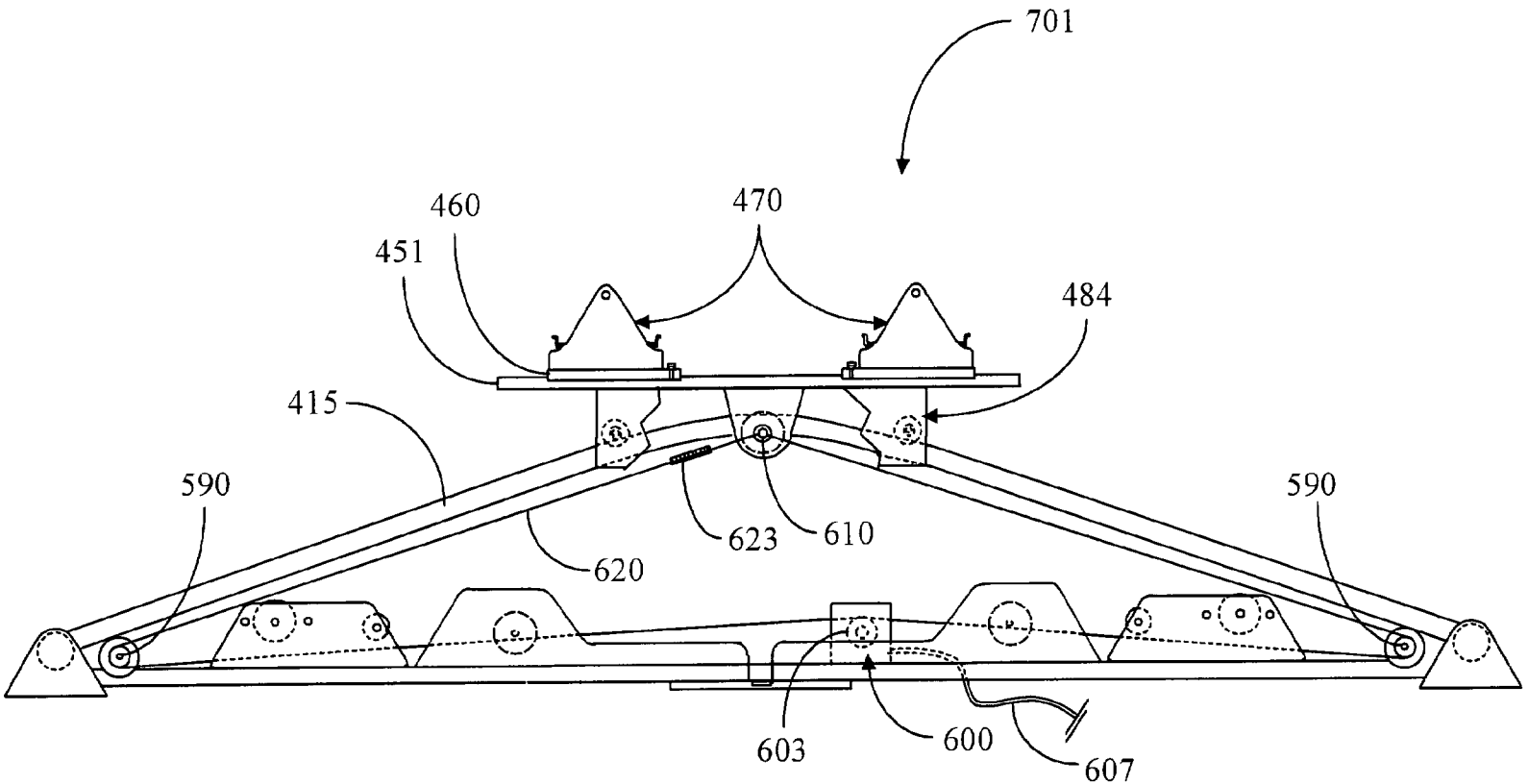
FIG. 36 is an elevation view of the frame structure of FIG. 17, the carriage assembly, mounting plate, attachment plate, and suspended footpad assemblies of FIG. 25A, and sensor system according to an embodiment of the present invention.

FIG. 36 is an elevation view of frame structure 404 of FIG. 17, wheeled carriage assembly 484, slide plate 451, attachment plate 460, and suspended footpad assemblies 472 of FIG. 25A, incorporating an electronic monitoring sensor system according to an embodiment of the present invention. As previously mentioned, elements comprising the LB monitoring system herein described may be retrofitted to existing ski exercise apparatus described in and in related U.S. patents and applications. Ski apparatus 701 is one such machine, comprising a set of semi-arcuate rails 415 upon which wheeled carriage 484 travels back and forth as described herein. For simplicity, a broken view is given for wheeled carriage 484 to show hidden elements, and many other elements such as the three power bands have also been omitted from this view for enabling a detailed view of the key components of the LB monitoring system.

Suspended footpad assemblies 470 are mounted to sliding attachment plates 460, which in turn are mounted to slide plate 451, which is mounted to the upper surface of wheeled carriage 484, as previously described herein. Wheeled carriage 484 has a power band roller bracket extending down from the underside containing a mounted power band roller, but in the embodiment shown the existing power band roller axle has been retrofitted with LB axle 610, as shown in FIG. 33A.

At each end of apparatus 701, the existing roller axles rotatably mounting the outer power band rollers at each end, have been replaced with LB roller axle assemblies 590 as shown in FIG. 34. LB sensor assembly 600 is mounted to the lower frame structure, near the center, as shown in the illustration, and be attached monitor wire leads away from LB sensor assembly 600 to an external monitor display and input device, as described above.

An actuating cable 620 is attached at one end of LB axle 610 under wheeled carriage 484, and is then routed to a first LB roller axle assembly 590 as shown, around the carriage wheel of the first roller axle assembly 590, and then towards the LB sensor assembly 600. Cable 620 is then wrapped once around sensor carriage wheel 603 of LB sensor assembly 600, and then routes on towards the second LB roller axle assembly 590 securing the opposite end roller, where it is routed up and over the carriage wheel of the second LB roller axle assembly 590, and then back up to LB axle 610 under carriage 484. The second end of cable 620 is then secured along with the first end to LB axle 610 utilizing standard lock nut fasteners.

Spring 623 provides constant tension to LB cable 620 once it is properly routed as described around the carriage wheels of LB roller axle assemblies 590 at each end of apparatus 701, around sensor carriage wheel 603 of LB sensor assembly 600 and attached at both ends at LB axle 610 under carriage 484. During operation of ski apparatus 701 wheeled carriage travels laterally along rails 415, as described previously, but sensor carriage wheel 603 of LB sensor assembly 600 is now rotated in one direction or the other in direct relation to physical movements of wheeled carriage 484 along rails 415. LB sensor assembly 600 and its monitoring display device (not shown) are adapted to interpret the signals provided by the rotating carriage wheel of LB sensor assembly 600 and reproduce the signals on the display monitor in meaningful information readable by the user, such as elapsed time from start to finish of the workout, goal determination and accomplishment, energy or calories expended by the user, speed of turns, side travel distance of the wheeled carriage, and so on.

Figure 37:
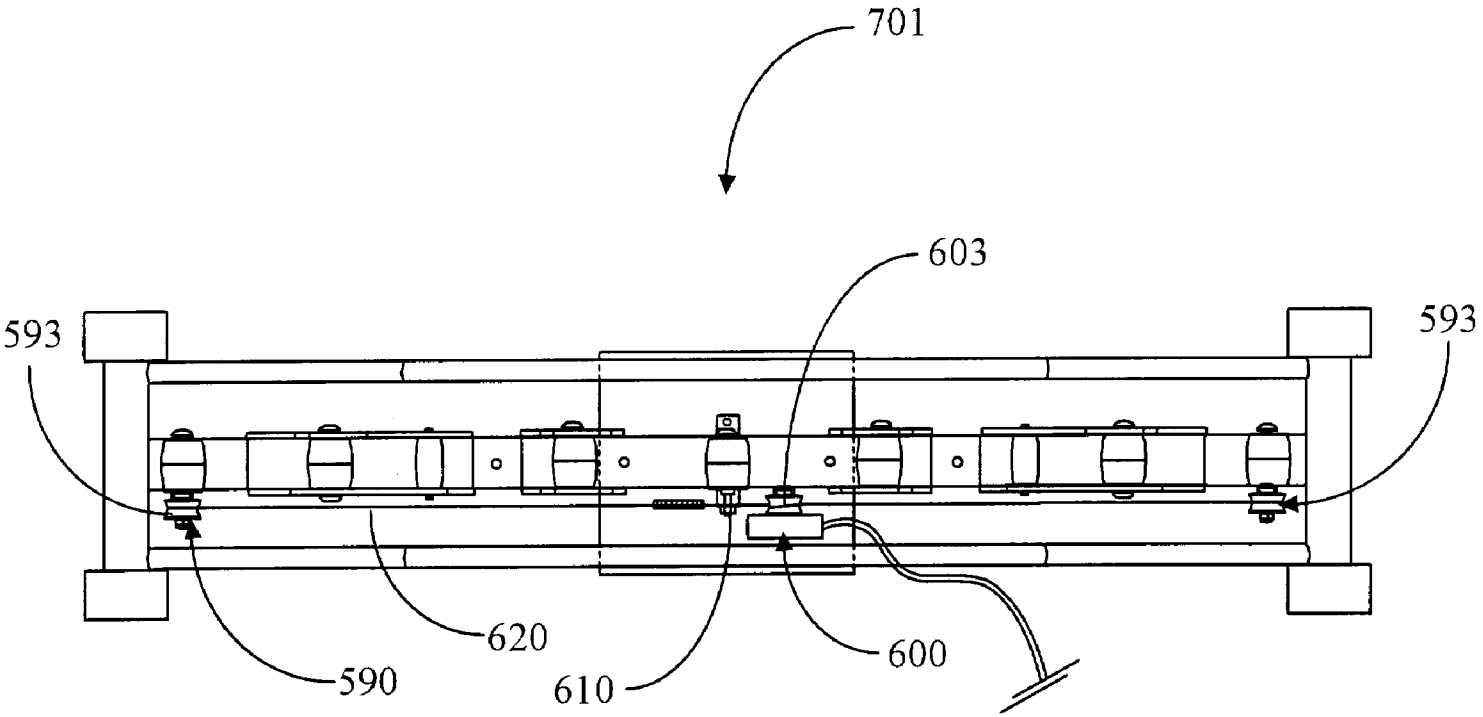
FIG. 37 is a top view of the carriage assembly, mounting plate, attachment plate, suspended footpad assemblies, and sensor system of FIG. 37.

FIG. 37 is a top view of the frame structure and sensor system of FIG. 36. In this view, LB cable 620 is clearly shown as it routes over carriage wheels 593 of end LB roller axles 590, and once around sensor carriage wheel 603 of LB sensor assembly 600, each free end of LB cable 620 attached to LB axle 610. For simplicity, wheeled carriage 484 is not shown in this view. As shown in the illustration, roller axle carriage wheels 593, sensor carriage wheel 603, and a cable attach point of LB axle 610 or all aligned with each other such that LB cable 620 routes over and around them in a straight line.

Figure 38:
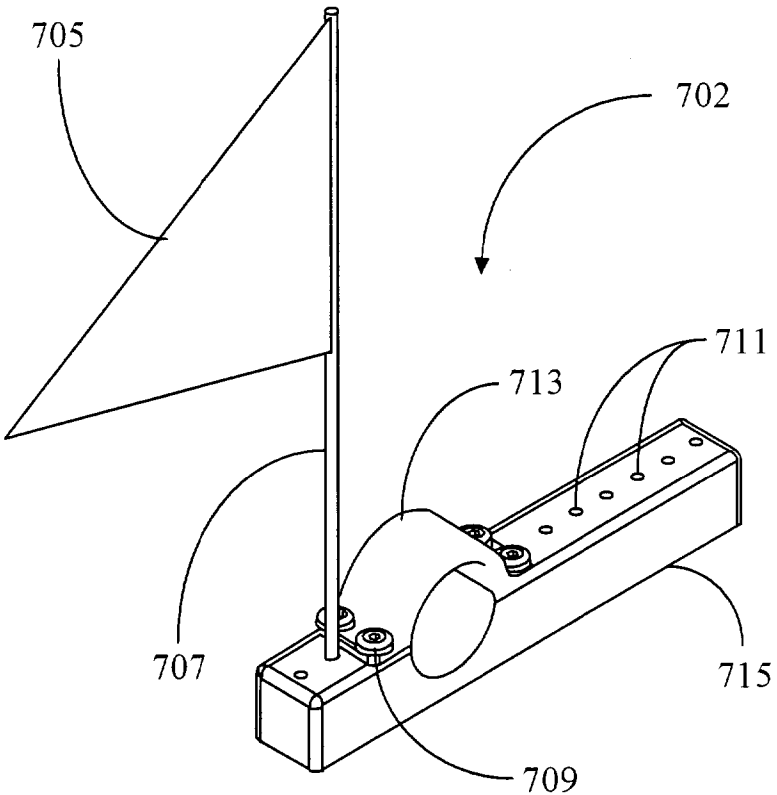
FIG. 38 is a perspective view of an adjustable flag assembly according to an embodiment of the present invention.

FIG. 38 is a perspective view of an adjustable flag assembly according to an embodiment of the present invention. Flag assembly 702 is provided by the inventor as part of the LifeBeat monitoring system described thus far, and has the purpose of giving the exercising user a clear visual and audible indication when the wheeled carriage assembly reaches a certain lateral range limit. Flag assembly 702 comprises a mounting base 715 having an upper clamp 713 secured to mounting base 715 by four bolt fasteners 709. Clamp 713 is adapted to fit snugly over the rounded shape of transverse end-members 27 of the frame structure of the ski apparatus, a shown in FIG. 7A, B.

Flag assembly 702 is also provided with a plurality of flag locator holes 711 extending down into the upper surface of mounting base 715, adapted for attaching a flag 705 by inserting flag stem 707 into one of locator holes 711, providing a wide choice of flag stem mounting positions on mounting base 715.

Figure 39:
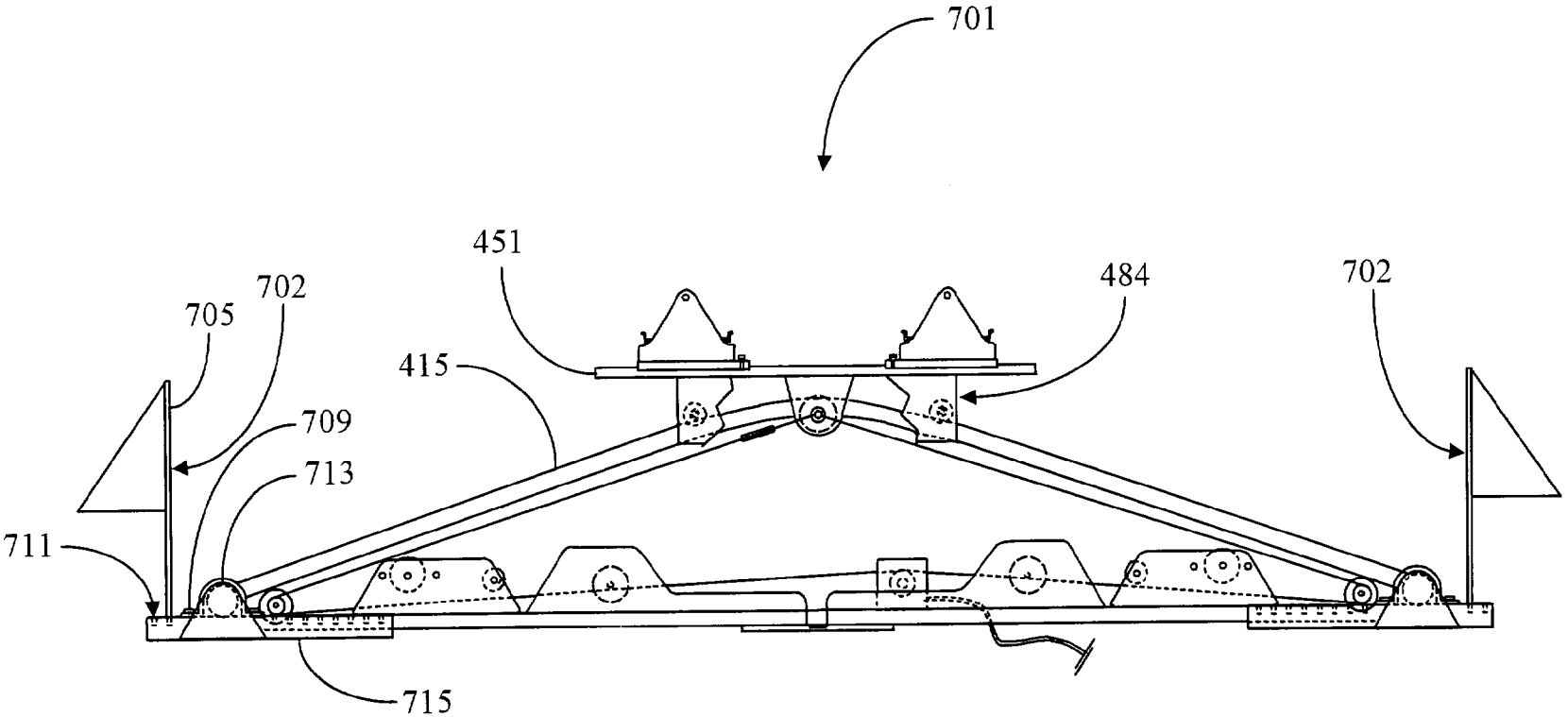
FIG. 39 is an elevation view of the carriage assembly, mounting plate, attachment plate, suspended footpad assemblies, and sensor system of FIG. 38 incorporating a pair of flag assemblies of FIG. 36 according to an embodiment of the present invention.

FIG. 39 is an elevation view of the frame structure, wheeled carriage assembly, slide plate, attachment plate, suspended footpad assemblies, and sensor system of FIG. 36 incorporating a pair of flag assemblies 702 of FIG. 38 according to an embodiment of the present invention. The manner in which flag assemblies 702 are attached at each end of frame structure 701 in one embodiment is clearly seen in this view, utilizing clamp 713 and bolts 709, which secure mounting base 715 to each rounded transverse member at either end of frame structure 701. In this example flag 705 are inserted into locator holes near the outermost locator hole position. In other embodiments the method and apparatus for holding flags may be different. During operation of the ski exercise apparatus, carriage 484 travels laterally along rails 415, and when the outermost travel distance range is achieved by the user, the end of plate 451 mounted on wheeled carriage 484 makes physical contact with flag 705, giving the user an instant visual and audible indication that the desired outermost travel distance range has been achieved.

Additional Exercise Equipment

As previously mentioned, a still further object of the present invention to enable the ski exercising apparatus of the present invention to be used with additional special attachments and other new and novel apparatus, to become a versatile rehabilitation and training tool that simulates the range of motion and balance required in many sports other than downhill skiing, and for selectively stretching, strengthening or rehabilitating specific areas of the body, core stabilization, balance training and many other aspects of selected training and exercise, not possible with using only the ski apparatus as described thus far in the present application. Such a ski exercise apparatus used with such special attachments accurately reproduces the lateral movements required in most sports, thereby optimizing rehabilitation and helping to prevent injury to the user.

The inventor of the present application has discovered that the ski apparatus of the present invention, in addition to providing the tensioned lateral movement and balance exercises described herein utilizing suspended footpad assemblies and dual-action pivoting independent footpad attachment mechanisms, may also be used for exercises which create progressive resistance to the knee, hip and pelvic core musculature, allowing the user and therapist/trainer the option of implementing isolated progressive resistance at different levels.

Figure 40:
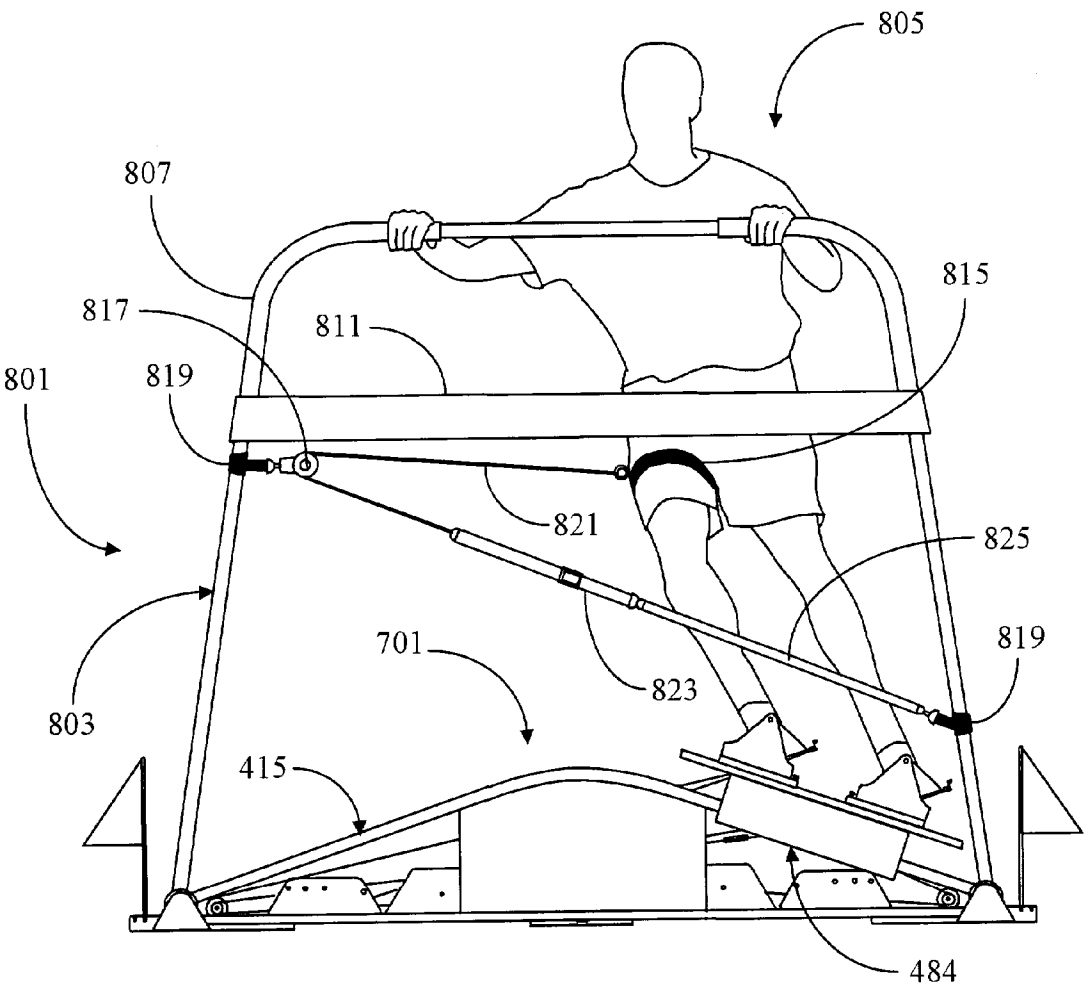
FIG. 40 is an elevation view of the carriage assembly, mounting plate, attachment plate, suspended footpad assemblies, sensor system and flag assemblies of FIG. 39, incorporating a progressive resistance cord system according to an embodiment of the present invention.

FIG. 40 is an elevation view of the frame structure, wheeled carriage assembly, slide plate, attachment plate, suspended footpad assemblies, sensor system and flag assemblies of FIG. 39, an optional support frame and an exercising user, incorporating a progressive-resistance cord system according to an embodiment of the present invention, for providing such isolated progressive resistance exercises, as described above. Ski exercise apparatus 801 comprises the frame structure 701 previously described, including improved semi-arcuate rails 415, and wheeled carriage assembly 484 utilizing a set of suspended footpad assemblies adjustably attached to carriage 484, as described above.

The embodiment illustrated however, comprises an optional support frame 803 for a novice user to hold on to for stabilization while using ski apparatus 801. Support frame 803, termed Assistant Coach by the inventor, is equivalent to support frame 14 as described for FIG. 1A, comprising a set of arcuate rails 807, each having a grip covering portion, and a transverse cross member 811 which provides stability to the overall frame structure.

An exercising user 805 is shown operating ski exercise apparatus 801 according to embodiment of the present invention described herein thus far, except that additional resistance is incorporated into the lateral movements of the user, by using the new and unique attachment cord with pulley system, anchor straps and resistance cords designed to be used with support frame 803.

Core muscle strengthening may be accomplished utilizing the ski exercise apparatus of the present invention with the use of resistance during exercises on the machine. Resistance cords attached to the upper leg of the user, for example, provide resistance for internal and external rotation, abduction and adduction of the femur during the lateral movements. Resistance cords may also be alternatively attached to a waist strap worn by the exercising user giving resistance to the pelvis and lumbar spine through lateral movements on the exercise apparatus.

In the embodiment shown, a strap 815 is attached around the upper thigh of the user, and attached to strap 815 is an attachment cord 821. Attachment cord 821 is routed to and through pulley 817, which is anchored to support frame 803 just below where it meets cross member 811, utilizing anchor strap 819. Cord 821 is routed around the wheel of pulley 817 and then down at an angle where it is attached to an adjusting strap 823. An elastic resistance cord 825 is anchored at one end to the lower straight portion of support frame 803 opposite from pulley 817, utilizing another anchor strap 819, and is connected at the other end to adjusting strap 823.

As user 805 moves wheeled carriage assembly 804 laterally across rails 415, added resistance is selectively applied to the upper thigh area of user 805, by virtue of the resistance of cord 825. Resistance cords 825 may be supplied with varying lengths and elasticity to allow the option of implementing isolated progressive resistance at different levels. The length of adjusting strap 823 may also be adjusted to further add to the choice of resistance options. The system comprising movable anchor straps 819 cord 821, pulley 817 and adjusting strap 823 allow the option of implementing isolated progressive resistance from multiple heights and angles along support frame 803. Further, a larger version of strap 815 may be used to secure cord 821 to the user's hip, waist, or chest area, depending on the selective training preference.

It is noted that the example shown in FIG. 40 is exemplary only, as the possibilities for achieving different resistance and selectively applying the resistance to specific areas of the body while exercising are plentiful. For example, the user may attach strap 815 to the opposite leg, switch locations of anchor straps 819 and pulley 817 for adding resistance to the other leg while exercising, or in other instances, cord 821, pulley 817 and adjusting strap 823 may not be used at all, and the user may wish to anchor a resistance cord by one end to each side of a waste belt, and anchor the other ends of the resistance cords directly to frame 803 to the side, giving resistance to the pelvis and lumbar spine through the lateral movements to both sides of the ski apparatus. It will be apparent to the skilled partisan that the possibilities for applying selective resistance to specific parts of the body utilizing the elements described herein is virtually unlimited.

It will also be apparent to one with skill in the art that the many improvements to existing ski-exercising equipment described as separate embodiments herein add durability, safety, much-improved operating characteristics which more closely simulate the lateral movements required in many sports, adjustability of footpad or other exercise attachments, manufacturability, and convenience over apparatus of the prior art. Moreover, future applications may now be implemented by developing new upper platform assemblies, and still be integrated easily with the improved rail and carriage apparatus, and improved adjustable attachment mechanisms as taught herein. Therefore, the present invention should be afforded the broadest scope possible. The spirit and scope of the present invention is limited only be the claims that follow.

What is claimed is:

1. A ski exercising apparatus, comprising:

a set of at least two parallel, partially arcuate rails joined to an underlying frame structure at opposite ends, the rails providing a track rising from each end;

a wheeled carriage riding on the track, such that the carriage, in side-to-side movement rises to a maximum height at the center of the track, and descends from the center to each side;

at least one articulated footpad mounted to the wheeled carriage; and a set of three power bands;

characterized in that the power bands are arranged concentrically, with an outer, an inner, and a middle band, joined at one point each to the wheeled carriage and at at least two points each to the underlying frame structure, and in that the attachment of the middle power band to the underlying frame structure is through a pair of adjustment mechanisms having two rollers each, the adjustment mechanisms attached to the underlying frame structure on each side of center.

2. The ski exercising apparatus of claim 1 wherein, in each adjustment mechanism, the middle power band passes under one of the rollers and around the other.

3. The ski exercising apparatus of claim 2 wherein the roller which the middle band passes around can be fixed at any one of at least three positions in the adjustment mechanism, each position at a different distance from the center of the apparatus, to adjust tension on the middle band.

4. In a mechanism for mounting a roller between two vertical walls spaced apart by a first distance, the roller for restraining and guiding a power band for a ski exercising apparatus having a wheeled carriage rolling on partially arcuate rails, the power band affixed to the carriage and passing around a roller in the mechanism, an improved roller axle comprising:

a first element including an axle portion of a first diameter and a length equal to the first distance, having a concentric threaded hole on a first end, an engagement portion concentric with the axle portion, of a length equal to a thickness of one of the walls, and larger in diameter than the axle portion to match a diameter of a hole in the one of the walls, and a head portion concentric with the axle portion and larger in diameter than the hole, for inserting through the hole and extending the axle portion between the two walls; and a second element including a head portion equivalent to the head portion of the first element and an engagement portion equivalent to the engagement portion of the first element, and also including a male threaded portion extending from the engagement portion for mating with the concentric threaded hole of the first element, the second element for inserting through a hole in the other of the two walls, equivalent to the hole ion the first of the two walls, and for engaging with the first element to form an axis for a roller to be mounted between the walls, and also for stabilizing and strengthening the mechanism.

5. A ski exercising apparatus, comprising:

a set of at least two parallel, partially arcuate rails joined to an underlying frame structure at opposite ends, the rails providing a track rising from each end;

a wheeled carriage riding on the rails, such that the carriage, in side-to-side movement rises to a maximum height at the center of the track, and descends from the center to each side;

at least one power band attached to the carriage and engaging mechanisms mounted to the underlying frame structure at opposite sides of center of the track; and a slide plate mounting to the wheeled carriage for providing attachment of elements interfacing to a human user;

characterized in that the slide plate comprises spaced apart rounded parallel rails extending in the direction of movement of the wheeled carriage, the rails for engaging rounded grooves of one or more separate elements to be mounted to the slide plate.

6. The apparatus of claim 5 characterized in that the slide plate further comprises a plurality of holes arranged in linear matrix in the direction of the extension of the rails, the holes for selective positional mounting of the separate elements to be mounted.

7. The apparatus of claim 5 further comprising one or more spring-loaded pin extensions from the slide plate to act as safety retainers for the separate elements joined to the slide plate by engaging with the rounded rails.

8. A ski exercising apparatus, comprising:

a set of at least two parallel, partially arcuate rails joined to an underlying frame structure at opposite ends, the rails providing a track rising from each end;

a wheeled carriage riding on the rails, such that the carriage, in side-to-side movement rises to a maximum height at the center of the track, and descends from the center to each side;

at least one power band attached to the carriage and engaging mechanisms mounted to the underlying frame structure at opposite sides of center of the track;

a substantially linear slide plate having spaced apart rounded rails extending in the direction of movement of the wheeled carriage, the slide plate mounting to the wheeled carriage; and at least one attachment plate having rounded grooves spaced-apart compatibly with the rounded rails, the attachment plate mounted to the liner slide plate by engaging the rounded grooves of the attachment plate with the rounded rails of the slide plate.

9. The apparatus of claim 8 comprising two attachment plates.

10. The apparatus of claim 8 wherein the attachment plate further comprises a normally extended spring pin, which, by being refracted, allows the attachment plate to be translated along the rails of the slide plate, and by being allowed to extend, engages a hole in the slide plate to position the attachment plate on the slide plate.

11. A ski exercising apparatus, comprising:

a set of at least two parallel, partially arcuate rails joined to an underlying frame structure at opposite ends, the rails providing a track rising from each end;

a wheeled carriage riding on the rails, such that the carriage, in side-to-side movement rises to a maximum height at the center of the track, and descends from the center to each side;

at least one power band attached to the carriage and engaging mechanisms mounted to the underlying frame structure at opposite sides of center of the track;

a substantially linear slide plate having spaced apart rounded rails extending in the direction of movement of the wheeled carriage, the slide plate mounting to the wheeled carriage;

at least one attachment plate having rounded grooves spaced-apart compatibly with the rounded rails, the attachment plate mounted to the linear slide plate by engaging the rounded grooves of the attachment plate with the rounded rails of the slide plate; and a foot pad attached to the attachment plate for engaging a user's foot to operate the apparatus.

12. The apparatus of claim 11 comprising two attachment plates engaging the slide plate and two foot pads, one attached to each attachment plate.

13. The apparatus of claim 11 wherein the foot pad comprises a planar portion for engaging a user's foot at a first height, and a pivot axis at a second height above the first height, such that the plane of the planar portion may rotate as the carriage descends from side to side.

14. A ski exercising apparatus, comprising:

a set of at least two parallel, partially arcuate rails joined to an underlying frame structure at opposite ends, the rails providing a track rising front each end;

a wheeled carriage riding on the rails, such that the carriage, in side-to-side movement rises, to a maximum height at the center of the track, and descends from the center to each side;

at least one power band attached to the carriage and engaging mechanisms mounted to the underlying frame structure at opposite sides of center of the track;

a handgrip apparatus joined to the wheeled carriage, enabling a user to grasp the handgrip apparatus and operate the exercising apparatus;

a substantially linear slide plate mounted to the wheeled carriage and having spaced apart rounded rails extending in the direction of movement of the wheeled carriage; and at least one attachment plate having rounded grooves spaced-apart compatibly with the rounded rails, the attachment plate mounted to the linear slide plate by engaging the rounded grooves of the attachment plate with the rounded rails of the slide plate, the handgrip apparatus attached to the attachment plate.

15. The exercising apparatus of claim 14 wherein the handgrip apparatus provides two handgrips, one for each of a user's hands, spaced apart in the direction of translation of the wheeled carriage on the track.

16. A ski exercising apparatus, comprising:

a set of at least two parallel, partially arcuate rails joined to an underlying frame structure at opposite ends, the rails providing a track rising from each end;

engaging mechanisms mounted to the underlying frame structure at opposite sides of center of the track;

a wheeled carriage riding on the rails, such that the carriage, in side-to-side movement rises to a maximum height at the center of the track, and descends from the center to each side;

at least one power band attached to the carriage and engaging mechanisms; and a system for monitoring travel of the wheeled carriage in operation;

wherein the system for monitoring comprises an endless tether attached to the carriage and passing over rollers mounted to the underlying frame structure at points spaced to either side from center.

17. The exercising apparatus of claim 16 wherein the system for monitoring further comprises a sensing roller turned by the tether as the carriage translates, the sensing roller enabled to provide a signal proportional to the direction and extent of rotation of the sensing roller.

18. The exercising apparatus of claim 17 wherein the sensing is accomplished by interruption of an optical sensor.

19. The exercising apparatus of claim 16 wherein the rollers mounted to the underlying frame structure are integrated with rollers provided for anchoring and guiding the at least one power band.

20. The exercising apparatus of claim 16 further comprising an electronic system including a display for compiling and displaying movement statistics related to the exercising apparatus.

21. The exercising apparatus of claim 20 wherein input and output elements of the electronic system, including the display, are located at a position observable by and accessible to a user of the apparatus.

* * * * *